US006988470B2

(12) United States Patent
Brueckmueller

(10) Patent No.: US 6,988,470 B2
(45) Date of Patent: Jan. 24, 2006

(54) SWASH PLATE COMBUSTION ENGINE AND METHOD

(76) Inventor: Helmut Brueckmueller, No. 83, A-3601, Unterloiben (AT)

( * ) Notice: Subject to any disclaimer, the term of this patent is extended or adjusted under 35 U.S.C. 154(b) by 0 days.

(21) Appl. No.: 10/365,256

(22) Filed: Feb. 11, 2003

(65) Prior Publication Data

US 2004/0118365 A1 Jun. 24, 2004

Related U.S. Application Data

(60) Provisional application No. 60/434,565, filed on Dec. 18, 2002.

(51) Int. Cl.
*F02B 75/18* (2006.01)

(52) U.S. Cl. ..... 123/56.3

(58) Field of Classification Search ..... 123/56.3, 123/56.6, 56.1, 56.2
See application file for complete search history.

(56) References Cited

U.S. PATENT DOCUMENTS

| | | | | |
|---|---|---|---|---|
| 1,370,927 | A * | 3/1921 | Gustave | 123/56.3 |
| 1,808,380 | A | 6/1931 | Royal | |
| 1,869,189 | A * | 7/1932 | Eggert | 74/123 |
| 1,904,499 | A | 4/1933 | McLaren | |
| 2,236,738 | A * | 4/1941 | Swensen | 74/60 |
| 2,387,908 | A | 10/1945 | Howard | |
| 2,940,325 | A | 6/1960 | Nakesch | |
| 3,196,698 | A * | 7/1965 | Liddington | 74/60 |
| 3,198,179 | A * | 8/1965 | Stephens | 123/51 B |
| 3,319,874 | A | 5/1967 | Welsh et al. | |
| 3,511,102 | A | 5/1970 | Brandes | |
| 3,528,396 | A * | 9/1970 | Cummins | 123/265 |
| 4,088,033 | A | 5/1978 | Harr | |
| 4,129,102 | A | 12/1978 | van der Lely | |
| 4,174,684 | A * | 11/1979 | Roseby et al. | 123/48 B |
| 4,294,139 | A * | 10/1981 | Bex et al. | 74/839 |
| 4,433,596 | A | 2/1984 | Scalzo | |
| 4,505,187 | A | 3/1985 | Burgio di Aragona | |
| 4,523,549 | A | 6/1985 | Lacy | |
| 4,622,927 | A * | 11/1986 | Wenker | 123/51 B |
| 5,269,193 | A * | 12/1993 | Rabinow | 74/60 |
| 5,273,012 | A | 12/1993 | Brock | |
| 5,437,251 | A | 8/1995 | Anglim et al. | |
| 5,438,251 | A | 8/1995 | Chen et al. | |
| 5,638,778 | A | 6/1997 | James | |
| 5,782,219 | A | 7/1998 | Frey et al. | |
| 6,164,252 | A | 12/2000 | Kuhn et al. | |
| 6,202,606 | B1 | 3/2001 | Anttila | |

OTHER PUBLICATIONS

"Alternate Energy", specification, copyright 2001 Signapore Technologies Kinetics Ltd.

* cited by examiner

*Primary Examiner*—Henry C. Yuen
*Assistant Examiner*—Jason Benton
(74) *Attorney, Agent, or Firm*—Klarquist Sparkman, LLP

(57) ABSTRACT

A swash plate engine comprises a counterbalancing swash plate assembly. In certain embodiments, the angle of a first swash plate assembly may be varied to vary the stroke of the engine. The swash plate assemblies may be operable such that during certain operating conditions of the engine a portion of one swash plate assembly passes at least partially through an interior passage provided in another swash plate assembly. In desirable embodiments, the stroke to bore ratio of the engine may be varied from greater than 1 to less than 1 depending on a vehicle operating parameter, such as the horsepower and/or torque of the vehicle engine and/or the position of a vehicle throttle pedal.

148 Claims, 16 Drawing Sheets

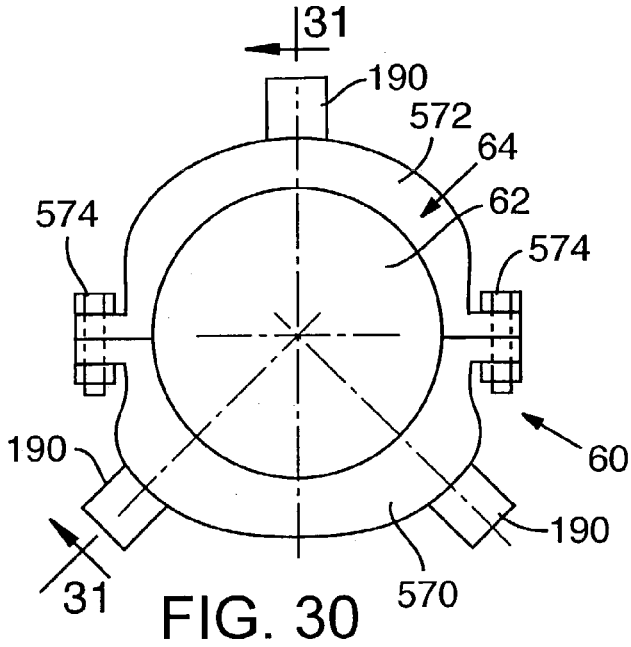
FIG. 30
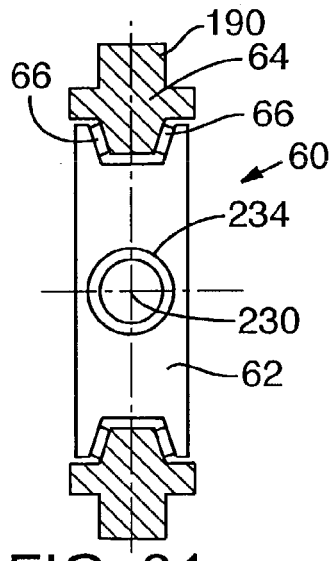
FIG. 31
FIG. 32
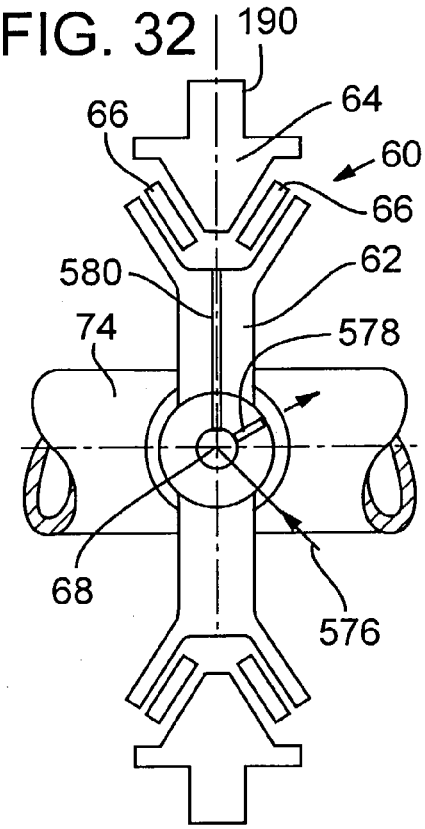
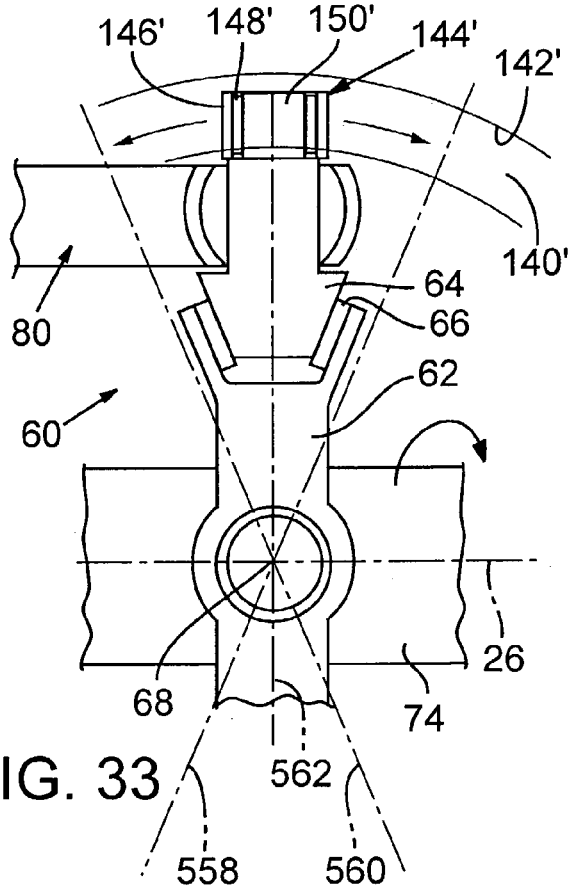
FIG. 33

SWASH PLATE COMBUSTION ENGINE AND METHOD

CROSS REFERENCE TO RELATED APPLICATIONS

This application is based on provisional patent application No. 60/434,565, filed on Dec. 18, 2002. The entire disclosure of the provisional application is considered to be part of the disclosure of the following application and is hereby incorporated by reference herein.

The present invention relates to improved swash plate combustion engines and related methods.

BACKGROUND

Swash plate engines with various features are known. For example, FIG. 1 of U.S. Pat. No. 5,437,251 to Anglim et al. is understood to disclose pistons at opposite ends of an engine housing which drive respective swash plate assemblies to in turn rotate an output shaft. Anglim mentions that a cylinder head can have threads used in linearly adjusting the position of the cylinder head relative to the piston heads to achieve variable compression in a combustion envelope between the piston head and the linearly-adjustable cylinder head. Rotating cam members of respective swash plate assemblies are shown supported at equal, but opposite, angles from perpendicular with respect to the power output shaft of the engine. This provides counterbalanced reciprocative travel of pistons. The rotatable cam members are each understood to be maintained at a fixed angle relative to the output shaft by a structure including a starter gear which interconnects the rotatable members. A pinch plate guide prevents rotation of non-rotatable or pinch plate portions of the swash plate assemblies. In the form shown in FIG. 1 of this patent, the pinch plate guide for each swash plate assembly comprises guide rods extending radially outwardly from the pinch plates into sliding contact with guide slots and guide members attached to the engine housing. These guide rods prevent rotation of the non-rotatable members of the swash plate assemblies. These non-rotatable members are driven by the reciprocating pistons such that the non-rotatable members reciprocate and drive the rotatable members of the swash plate assemblies and thus the output shaft.

U.S. Pat. No. 4,174,684 to Roseby et al. is understood to disclose a variable stroke internal combustion engine which includes first and second swash plate assemblies with rotatable members which are interconnected by a sliding bar. A crank arm coupled to the sliding bar can shift the position of the sliding bar to adjust the angle of the swash plate assemblies to adjust the engine stroke. The crank is actuated by a link coupled to an actuating mechanism such as a hydraulic piston, a screw or other actuating means. In the embodiment of FIG. 2 of this patent, the two swash plate assemblies are maintained by the sliding bar in what appears to be substantially parallel positions. In Roseby, a carrier has a central plate portion which is positioned between and separates the two swash plate assemblies.

Another example of a swash plate engine is disclosed in U.S. Pat. No. 3,319,874 to Welsh et al. In this patent, reciprocating pistons drive a first member of a swash plate assembly. The first member in one embodiment is restrained against rotation by an arm which extends through a ball of a ball and socket carried by a support block which reciprocably slides in a channel of the housing as the pistons move. Reciprocating motion of a first non-rotatable member of the swash plate assembly drives a rotatable member of the swash plate assembly and an output shaft. The rotatable member is coupled by a fixed link to a collar. In one example, a hydraulically actuated piston, acting through linkages, shifts the angle of the swash plate assembly to thereby vary the stroke of the engine. This hydraulically actuated piston is shown at the opposite end of the engine housing from the cylinders and thus adds to the overall length of the engine.

Although a number of swash plate engines are known, a need exists for an improved swash plate combustion engine and related methods. The present invention is related to new and unobvious swash plate combustion engine improvements alone and in various combinations and sub-combinations with one another as set forth in the claims below. It is a not a requirement that all of the disadvantages, or any one or more specific disadvantages, of known swash plate engines be overcome for a swash plate engine to fall within the inventive concepts set forth herein and in the claims below.

SUMMARY

An internal combustion engine in accordance with one embodiment comprises an engine housing. At least one cylinder, and more typically a plurality of cylinders, is/are positioned within the engine housing. The at least one cylinder has a longitudinal cylinder axis extending in a first direction. A piston is positioned within the at least one cylinder for reciprocation therein. One such reciprocatable piston is associated with and positioned within each of the respective cylinders in embodiments where a plurality of cylinders are provided. A rotatable output member is rotatably coupled to the housing for rotation about a first axis. Desirably, first and second swash plate assemblies are positioned within the engine housing. The first swash plate assembly comprises a first member and a second member. The first member is rotatably coupled to the second member for rotation relative to the second member and about the first axis. The second member is coupled to the housing such that the second member is restrained against rotation. The first member may be pivotally coupled to the output member for pivoting about a second axis which is transverse to the first axis. A piston rod is pivotally coupled to the piston and also pivotally coupled to the second member. The piston rod reciprocates with the reciprocal movement of the piston. Reciprocal movement of the piston results in reciprocal movement of the second member and rotation of the first rotatable member and output member about the first axis. The second swash plate assembly comprises a third rotatable member and a fourth member. The third member is rotatably coupled to the fourth member for rotation relative to the fourth member and about the first axis. The fourth member is also coupled to the housing such that the fourth member is restrained against rotation. The third member may also be pivotally coupled to the output member for pivoting about a third axis which is transverse to the first axis. The third member rotates with the rotation of the output member and with the rotation of the first member. Rotational movement of the third member results in reciprocal movement of the fourth member. Desirably, the reciprocal movement of the fourth member counterbalances the reciprocal movement of the second member.

In desirable embodiments, the second and third axes are parallel to one another and are in a common plane. Desirably, the first axis about which the output member rotates may also be in this common plane.

Throughout this description, the term "coupling" encompasses both direct connection of one member to another as well as indirect connection of one member to another through one or more intervening components.

In accordance with one alternative embodiment, the cylinders of the engine are all positioned adjacent to the same end portion of the housing and at the same side of the swash plate assemblies. This results in a more compact engine construction in comparison to a less desirable embodiment in which the swash plate assemblies are positioned between respective sets of cylinders adjacent the opposite end portions of the housing.

In a desirable embodiment, the first and second swash plate assemblies are positioned and coupled to one another such that the second and fourth members reciprocate relative to one another in opposite directions with the rotation of the first and third members. As a result, the swash plate assemblies at least partially counterbalance or vibration balance the operation of one another.

As an aspect of an embodiment, the second swash plate member may be coupled to the housing to restrain the second member against rotation. In one specific embodiment, a piston rod confining member is provided and is coupled to the housing. The piston rod confining member is configured to slidably engage the piston rod to permit reciprocal movement of the piston rod while restricting rotation of the piston rod about the first axis. This restricts the second member against rotation about the first axis as a result of the coupling of the second member to the piston rod. The fourth member in one specific embodiment is restrained to reciprocate without rotation about the first axis by a track and track follower mechanism. The track may be coupled to the housing with the track follower engaging and traveling along the track. The orientation of the track permits reciprocation of the fourth member without rotation. The track follower may comprise a rolling track follower which rotatably engages the track. In an alternative embodiment, the track follower comprises a slide member which slidably engages the track. The track may comprise a channel with spaced apart track follower engaging wall surfaces positioned for engagement by the track follower. A similar track and track follower arrangement may be used to couple the second member to the housing to restrict the second member against rotation, although this is less desirable. Other mechanisms may be used for directly or indirectly coupling of the second and fourth members to the housing to restrict the second and fourth members against rotation about the first axis.

Respective sets of bearings may be used to rotatably couple the first member to the second member and the third member to the fourth member. In specific examples, ball bearings or conical barrel bearings are used for this purpose. To facilitate installation of these bearings, in one embodiment, at least one of the first and second members and at least one of the third and fourth members may comprise a plurality of interconnected sections. The first member may comprise first and second annular sections which are sandwiched together and interconnected to comprise the first member. In a desirable embodiment, the first and second annular sections each define a portion of a first annular rotating surface. In addition, the second member comprises a second annular rotating surface which faces the first annular rotating surface. A first set of bearings is positioned between the first and second annular rotating surfaces in this embodiment. In addition, the fourth member may comprise at least first and second sections which each define a portion of a fourth annular rotating surface. The sections of the fourth member may be ring sections which are interconnected to comprise an annular fourth member with the fourth annular rotation surface. The third member may comprise a third annular rotation surface which faces the fourth annular rotating surface. A second set of bearings may be positioned between the third and fourth annular rotating surfaces.

Bearings may be used to couple the piston rod to the reciprocating swash plate member or members. Universal joints may be used for this purpose in one specific example. As another specific example, coupling members may be pivotally connected to the reciprocating swash plate member or members and project outwardly therefrom. A respective piston rod may be pivotally connected to each projecting coupling member portion. In variable stroke engine embodiments, bearings, such as tilt bearings may be used to pivotally couple the respective first and third members to the output member such that the first and third members pivot about the respective second and third axis. This allows the adjustment of the angles of the swash plate assemblies to vary the stroke of the engine, as explained below.

In one exemplary embodiment, a plurality of cylinders are provided. A respective piston and piston rod is associated with each cylinder. Although not required in all embodiments, the cylinders may be positioned closer to one end portion of the housing than any of the swash plate assemblies. This results in a more compact engine in comparison to an engine with cylinders at both sides of swash plate assemblies. The piston rods may each be coupled to the same reciprocating member of one swash plate assembly. Reciprocation of the pistons causes a reciprocation of the respective second and fourth members and results in rotation of the respective first and third members and the rotation of the output member about the first axis.

In an embodiment, a first set of bearings may pivotally couple the first member to the output member, a second set of bearings may pivotally couple the third member to the output member, a third set of bearings may rotatably couple the first member to the second member and a fourth set of bearings may rotatably couple the third member to the fourth member. A pressurized lubricating fluid supply in communication through a lubricating fluid passageway with each of the first, second, third and fourth bearings may be provided and be operable to provide lubricating fluid to such bearings.

In accordance with certain embodiments, the number of cylinders included in the engine, the firing order of such number of cylinders, and the swash plate rotation angle through which the first member rotates between firing of one cylinder and the next cylinder to fire are in accordance with the following table:

| Number of Cylinders | Firing Order | Swash Plate Rotation Angle |
|---|---|---|
| 1 | 1 | 720° |
| 2 | 1, 2, 1 | 360° |
| 3 | 1, 3, 2, 1 | 240° |
| 5 | 1, 3, 5, 2, 4, 1 | 144° |
| 7 | 1, 3, 5, 7, 2, 4, 6, 1 | 102.857° |
| 9 | 1, 3, 5, 7, 9, 2, 4, 6, 8, 1 | 80° |
| 11 | 1, 3, 5, 7, 9, 11, 2, 4, 6, 8, 10, 1 | 65.454° |

In the above table, the first member rotates 720 degrees during a complete firing cycle. In a specifically desirable embodiment, the engine includes five cylinders which fire in the following sequence: 1, 3, 5, 2, 4, and 1 and wherein the first member rotates through 144 degrees between the firing of one cylinder and the next cylinder to fire. The third member similarly rotates through 144 degrees between firing of one cylinder and the next cylinder to fire.

The swash plate assemblies may be spaced apart sufficiently that they move along paths of travel that do not intersect one another. However, in desirable embodiments, which result in a more compact engine, the first and second swash plate assemblies may be configured such that the second and fourth members travel past one another as the engine operates during at least certain engine operating conditions. For example, at least one of the first and second swash plate assemblies may define an interior swash plate passageway. The other of the first and second swash plate assemblies is sized and positioned to reciprocate at least partially through the interior swash plate passageway as the second and fourth members reciprocate at least during certain operating positions of the first and second swash plate assemblies. For example, the reciprocating member of first swash plate assembly may swing through an interior swash plate passageway defined by the second swash plate assembly as the engine operates.

In embodiments where there are two swash plate assemblies, the interior swash plate passageway may be defined by either the first or second swash plate assemblies. In embodiments where the swash plate passageway is defined by the second swash plate assembly, the first swash plate assembly is sized and positioned such that the reciprocating member of the first swash plate assembly reciprocates at least partially through the interior swash plate passageway as the second and fourth members reciprocate, at least during certain operating positions of the first and second swash plate assemblies. Alternatively, in embodiments where the first swash plate assembly defines the interior swash plate passageway, the second swash plate assembly is sized and positioned such that the reciprocating member of the second swash plate assembly reciprocates at least partially through the interior swash plate passageway of the first swash plate assembly as the second and fourth members reciprocate, at least during certain operating positions of the first and second swash plate assemblies.

The first member may comprise a first annular rotation surface and the second member may comprise a second annular rotation surface. The first annular rotation surface rotates relative to the second annular rotation surface as the first member rotates relative to the second member. In addition, the third member may comprise a third annular rotation surface and the fourth member may comprise a fourth annular rotation surface. The third annular rotation surface rotates relative to the fourth annular rotation surface as the third member rotates relative to the fourth member. The first annular rotation surface may face outwardly with the second annular rotation surface facing inwardly. In addition, in this example, at least a major portion, and more desirably substantially all, of the first member may be positioned inwardly of the first annular rotation surface and at least a major portion, and more desirably substantially all, of the second member may be positioned outwardly of the second annular rotation surface. By a major portion in this description it is meant at least 50 percent. The term "substantially all" when used in this description means at least 80 percent. Alternatively, the first annular rotation surface may comprise a first inwardly facing surface and the second annular rotation surface may comprise a second outwardly facing surface. In this example, at least a major portion, and more desirably substantially all, of the first member may be positioned outwardly of the first annular rotation surface and at least a major portion, and more desirably substantially all, of the second member is positioned inwardly of the second annular rotation surface. Thus, in the first of these two examples, at least a major portion of the first member may rotate inwardly of the second member and in the second of these two examples, at least a major portion of the first member may rotate outwardly of the second member. In addition, in either of these two examples, a major portion of the third member may be rotating inwardly of the fourth member or alternatively outwardly of the fourth member. That is, the third annular rotation surface may comprise a third outwardly facing surface with the fourth annular rotation surface comprising a fourth inwardly facing surface. In this example, at least a major portion, and more desirably substantially all, of the third member may be positioned inwardly of the third annular rotation surface and at least a major portion, and more desirably substantially all, of the fourth member may be positioned outwardly of the fourth annular rotation surface. Alternatively, the third annular rotation surface may comprise a third inwardly facing surface and the fourth annular rotation surface may comprise a fourth outwardly facing surface. In this case, at least a major portion, and more desirably substantially all, of the third member may be positioned outwardly of the third annular rotation surface and at least a major portion, and more desirably substantially all, of the fourth member may be positioned inwardly of the fourth annular rotation surface. Thus, a major portion of the third member may rotate inwardly or alternatively outwardly of the fourth member.

In accordance with one embodiment, a link or other coupling member or assembly may be utilized to couple the rotatable first member of the first swash plate assembly to the rotatable third member of the second swash plate assembly. This coupling assembly may comprise first, second and third elements. In one specific example, the first element may pivotally couple the rotatable first member of the first swash plate assembly to the second element at a first location positioned at one side of a plane bisecting the first axis. In addition, in this example, the third element may pivotally couple the rotatable third member of the second swash plate assembly to the second element at a second location at the other side of the plane bisecting the first axis. Desirably, the first and second locations are opposite to one another. In addition, the second element desirably rotates about the first axis with the rotation of the rotatable first and third swash plate assembly members.

In accordance with certain embodiments, the housing may comprise a valve cover portion, a cylinder head portion, a cylinder case portion, a swash plate case portion and an output member supporting portion. A plurality of cylinders having respective bores may be positioned within the cylinder case portion. Each of the bores has a bore diameter and a longitudinal cylinder axis. At least one combustion air intake port is provided in communication with each cylinder and at least one exhaust gas port is provided in communication with each cylinder. A respective air intake valve for each air intake port of each cylinder is provided and is selectively operable to open and close the associated air intake port. A respective exhaust valve for each exhaust gas port of each cylinder is provided and is selectively operable to open and close the associated exhaust gas port. The air intake valve or valves associated with each cylinder are opened to permit the ingress of combustion air into the associated cylinder and closed during combustion of an air-fuel mixture within the associated cylinder. The exhaust valve or valves associated with each cylinder are opened to permit the exhaust of combustion gases from the associated cylinder and through the associated exhaust gas port following combustion of the air-fuel mixture within the associated cylinder. A valve actuator is positioned within the valve cover portion of the housing and is operable to selectively open and close the air intake and exhaust valves. A respective piston is positioned within each cylinder and driven along the longitudinal cylinder axis of the associated cylinder in one direction in response to combustion of the air-fuel mixture in the associated cylinder. A respective piston rod is pivotally coupled to each piston. Respective first and second swash plate assemblies are positioned within the swash plate case portion of the housing. The first swash plate assembly comprises a first rotatable member for rotating about a first axis and relative to a second member. In this example, the piston rods are pivotally coupled to the second member. The engine also comprises an output member coupled to the output shaft supporting portion of the housing and which is rotatable about a first axis. The first member is desirably coupled to the output member for pivoting about a second pivot axis which is transverse to and which desirably is perpendicular to the first axis. The first member is drivenly coupled to the output member such that rotation of the first member rotates the output member. The second member is coupled to the housing to prevent rotation of the second member relative to the first member while permitting rotation of the first member relative to the second member. The second member is reciprocated by pistons when the pistons are driven to thereby cause rotation of the first member and rotation of the output member. In this embodiment, a second swash plate assembly is positioned within the swash plate case portion of the housing and comprises respective third and fourth members. The third member is rotatable relative to the fourth member and the fourth member is coupled to the housing so as to prevent the fourth member from rotating while permitting the third member to rotate relative to the fourth member. The third member is desirably coupled to the output member for pivoting about a third pivot axis which is transverse to and which desirably is perpendicular to the first axis. The first and third members are coupled together such that they rotate together. In addition, the second swash plate assembly is desirably oriented relative to the first swash plate assembly such that, as the second member of the first swash plate assembly reciprocates in a first direction, the fourth member of the second swash plate assembly reciprocates in a direction which is opposite to the first direction.

In a desirable optional configuration, the exhaust gas ports are shorter than the air intake ports to reduce the heating of the engine which is caused by hot exhaust gas exiting the engine through the exhaust gas ports. The air intake ports and exhaust gas ports, in one alternative embodiment, exit from the cylinder head portion in directions extending generally radially outwardly from the first axis. An exhaust gas port or ports for each cylinder may communicate with the cylinder at a location which is positioned radially outwardly from the first axis relative to the location where the air intake port or ports communicate with the cylinder.

In certain embodiments, respective portions of the housing may be interconnected discrete components. However, selected portions of the housing may be of a single monolithic one-piece construction. For example, selected components may be machined together, and more desirably cast together, as a unit. Thus, the cylinder head portion and cylinder case portion may be formed as single monolithic one-piece construction. Alternatively, the cylinder case portion and swash plate case portion may be formed of a single monolithic one-piece construction. The output member support portion may also be of a one-piece monolithic construction with the swash plate case portion. In addition, the longitudinal axes of the respective cylinders in plural cylinder engines may be parallel to one another, but this is not required. In addition, the longitudinal axes of the respective cylinders in plural cylinder engine embodiments may be positioned at a common distance or radius from the first axis about which the output member rotates. The longitudinal cylinder axis of each of the respective cylinders may be at an acute angle relative to the first axis about which the output member rotates. The acute angle in certain embodiments may be no greater than thirty degrees.

The cylinders may be of a monolithic one-piece construction with casting being a desirable method of forming the cylinders. The cylinders may have a gap between the cylinders such that cooling fluid may pass through the gap. The gap may be formed, for example, by machining or during casting if the cylinders are cast. Alternatively, the cylinders may have no gap between them.

Any suitable valve actuator mechanism for operating air intake and exhaust gas valves may be used. As a specific example, one form of a valve actuator may comprise a cam body supported for rotation about a cam body axis aligned with the first axis about which the output member rotates. The cam body may comprise at least one cam projecting from the cam body and at least one cam follower. The at least one cam and at least one cam follower are operable to open and close respective air intake and exhaust valves of the engine as the cam body rotates. The cam body may in one form comprise a cam disk with an outer periphery. The cam may comprise at least one projection extending outwardly from the outer periphery of the cam disk with the cam follower being engaged by the cam to operate the at least one of the air intake and exhaust valves. The cam body may comprise first and second major surfaces with the second major surface being positioned adjacent to the cylinders and the first major surface being positioned further from the cylinders than the second major surface. The cam may comprise at least one projection extending from the first surface and away from the second surface. Alternatively, the cam body may comprise a cam supporting projection spaced from the cam body axis and extending from the second major surface and away from the first major surface. The at least one cam may project radially inwardly from the cam supporting projection and toward the cam body axis.

The number of cams provided on the cam body and the rate of rotation of the cam body relative to the output member, as well as the direction of rotation of the cam body, may be varied depending upon the number of cylinders included in the engine.

In one example, for a one cylinder engine, the cam body may be rotated at one-half the speed of the output member and in either direction (the same or the opposite direction) relative to the direction of rotation of the output member. In this example, a first cam may be provided on the cam body in a position to selectively open and close the air intake valve for the cylinder and a second cam may be provided on the cam body in a position to selectively open and close the exhaust gas valve for the cylinder.

As another specific example, for a two cylinder engine with two associated pistons, the cam body may be rotated at one-half the speed of the output member and in either direction of rotation relative to the direction of rotation of the output member (in the same direction as the direction of rotation of the output member or a direction opposite to the direction of the rotation of the output member). In this example, a first cam may be provided on the cam body in a position to selectively open and close the air intake valves of both cylinders and a second cam may be provided on the cam body in a position to selectively open and close the exhaust valves of both cylinders.

As another example, for a three cylinder engine the cam body may be rotated at one-half the speed of the output member and in a direction which is opposite to the direction of rotation of the output member. The cam body, in this example, may include a first cam in position to selectively open and close the air intake valves of the three cylinders and a second cam in a position to selectively open and close the exhaust valves of the three cylinders.

As yet another example, the engine may consist of five cylinders. The cam body in this example may be rotated at a rate which is one-fourth of the rate of rotation of the output member and in a direction which is opposite to the direction of rotation of the output member. The cam body, in this example, may include a first set of two cams spaced 180 degrees apart from one another on the cam body in a position to selectively open and close the air intake valves of the five cylinders and a second set of two cams spaced 180 degrees apart on the cam body in a position to selectively open and close the exhaust valves of the five cylinders.

As a further example, in the case of a seven cylinder engine, the cam body may be rotated at a speed which is one-fourth the speed of rotation of the output member and in a direction which is the same direction as the direction of rotation of the output member. The cam body, in this example, may include a first set of four cams spaced 90 degrees apart on the cam body in a position to selectively open and close the air intake valves of the seven cylinders and a second set of four cams spaced 90 degrees apart on the cam body in a position to selectively open and close the exhaust valves of the seven cylinders.

The engine may be oriented horizontally with an oil pan positioned below the engine housing and coupled to the housing for collecting oil which is pumped to lubricate components of the engine within the housing, for example at least within the swash plate case portion, the cylinder head portion, and the cylinder case portion of the housing.

As mentioned above, the rotatable first and third members of the respective swash plate assemblies are desirably coupled together. In addition, as mentioned above, a coupling assembly which in one example is comprised of first, second and third coupling elements may be used for this purpose. In this example, the second coupling element may comprise a first collar portion having a longitudinal axis aligned with the first axis. A coupler such as a second collar may be slidably and drivenly coupled to the first collar portion such that the second collar rotates with the first collar portion and thereby with the second coupling element. The first rotatable member of the first swash plate assembly may be pivoted to the second collar for pivoting about a second pivot axis which is transverse to, and desirably perpendicular to, the first axis about which the output member rotates. Another coupler, such as a third collar in this embodiment, is provided and desirably surrounds a portion of the second collar. The third rotatable member of the second swash plate assembly may be pivoted to the third collar for pivoting about a third pivot axis which is transverse to, and desirably perpendicular to, the first axis. The second and third pivot axes are desirably parallel to one another. In addition, in one embodiment, the second and third pivot axes may be aligned with one another with the reciprocating portion of one of the swash plate assemblies reciprocating within the other of the swash plate assemblies to provide an extremely compact engine. The second and third collars may be shifted axially along the first axis, and desirably together to adjust the angle of the first and second swash plate assemblies relative to the first axis to thereby vary the stroke of the engine. The first collar portion and second collar may, in one specific example of an approach which allows axial movement of these components, be splined together by splines which extend in a direction parallel to the first axis such that the first collar portion and second collar may be moved relative to one another in a direction parallel to the first axis while remaining drivenly coupled together.

As one aspect of an embodiment, a first rotatable member of the first swash plate assembly may be coupled to the output member at a first location and the third rotatable member of the second swash plate assembly may be coupled to the output member at a second location with the first and second locations being positioned 180 degrees apart about the output member.

As an aspect of an embodiment, the reciprocating portion of a counterbalancing or second swash plate assembly may be comprised of a material which is heavier than the material comprising the reciprocating portion of the first swash plate assembly. As a result, the size of the second swash plate assembly may be reduced while still providing the desirable counterbalancing effect.

In accordance with other embodiments, a first swash plate assembly may be pivotally coupled to an output member for pivoting about a second axis which is perpendicular to the first axis about which the output member rotates. When the first swash plate assembly is in a first position, the first swash plate assembly defines a first plane at a first angle of inclination relative to a second plane perpendicular to the first axis and which intersects the second axis. The engine may comprise a mechanism operable to change the first angle of inclination and to shift the location of the second axis in a direction along the first axis to thereby vary the stroke of the engine.

A variable engine stroke adjuster may be included as an aspect of an embodiment and may be coupled to at least the first swash plate assembly to vary the tilt of the first swash plate assembly about the second axis and relative to the first axis so as to adjust the stroke of the engine. As a desirable aspect of an embodiment, the variable stroke adjuster may be operable to adjust the tilt of the first swash plate assembly so as to provide a minimum engine displacement for certain engine operating conditions, such as idle, and a maximum engine displacement for certain engine operating conditions, such as full power, which results in a stroke to bore rate ratio which is greater than one. More desirably, the variable engine stroke adjuster is coupled to both first and the second swash plate assemblies and is operable to vary the tilt of the second swash plate assembly relative to the first axis in the opposite direction from the change in tilt of the first swash plate assembly.

In accordance with an embodiment, each piston cylinder of the engine comprises a cylinder head portion and a cylinder wall portion. In addition, each piston comprises a piston head surface adjacent to the cylinder head portion of the associated cylinder in which the piston travels. Each piston repeatedly travels during a piston stroke between a top dead center position in which the piston head surface is closest to the cylinder head portion and a bottom dead center position in which the piston head surface is furthest from the cylinder head portion. In this example, the term "combustion chamber" is defined as the volume of the cylinder between the cylinder head portion and piston head surface when the piston head surface is in the top dead center position. In this embodiment, the piston, or pistons in plural cylinder embodiments, is/are coupled to a reciprocating member of a swash plate assembly such that the volume of the combustion chamber associated with the piston increases as the length of the piston stroke increases and decreases as the length of the piston stroke decreases. The term "combustion ratio" is defined as the ratio of the volume of the combustion chamber to the volume of the portion of the cylinder through which each piston travels between the top dead center position and the bottom dead center position. In a desirable embodiment, the combustion ratio is substantially constant as the stroke of the piston is varied. By substantially constant, it is meant that the combustion ratio is within plus or minus ten percent of a value for the ratio. As a specific example, the combustion ratio is about 1 to 10 for a gasoline combustion engine and 1 to 15–17 for a diesel combustion engine.

The engine may comprise a diesel fuel engine, wherein diesel fuel is injected into the compressed combustion air in the combustion chamber when the piston is at the top dead center position for combusting in the combustion chamber to drive the associated piston. Desirably, the quantity of diesel fuel injected into the combustion chamber is reduced with a reduction of the stroke or displacement. Alternatively, the engine may comprise a gasoline engine, wherein gasoline and combustion air is delivered as an air fuel mixture to the combustion chamber for combustion therein to drive the associated piston. Desirably, the quantity of gasoline and combustion air mixture delivered to the combustion chamber is reduced with a reduction in the volume of the stroke or displacement. As another alternative, the engine may comprise a direct injection engine which has a gasoline fuel supply which is delivered in a similar manner as fuel in a diesel fuel engine.

The angle of the swash plate assembly may be varied in response to at least one vehicle parameter (thus, in response to one or more such parameters). For example, the vehicle parameters may be selected from the group comprising a vehicle throttle pedal position, engine torque, engine horsepower requirements and/or to optimize fuel consumption efficiency for a given engine horsepower or torque. The engine may have a piston stroke to bore ratio which is less than one under certain engine operating conditions and which is greater than one under other engine operating conditions. For example, at highway cruising speed on flat ground, or under other conditions where the load on the engine is reduced, the stroke of the engine may be reduced. As a result, less fuel is required to operate the engine and greater fuel efficiency is achieved.

The operation of the swash plate engine may be controlled in accordance with a wide variety of methods. As a specific example, for a diesel engine, under idle conditions, the engine stroke may be maintained at a level which is greater than the minimum engine stroke with the fuel supply reduced. When the fuel accelerator pedal is depressed, the engine is more responsive because the stroke has not been reduced to a minimum stroke. Under coasting conditions (e.g., when a vehicle is coasting and no engine braking is desired), the fuel supply may be reduced, for example to zero and the stroke reduced toward its minimum (e.g., toward or at zero displacement) level. Under an engine braking condition (e.g., a truck is traveling downhill and it is desired to have the engine assist in braking the vehicle), the stroke may be set at a high level, for example at or toward the maximum stroke with the fuel reduced to zero. A direct injection gasoline engine may be operated, for example, in the same manner. For a gasoline engine of the type with an air throttle which regulates the supply of combustion air to the engine, under idle conditions, the engine stroke may be maintained at a level which is greater than the minimum engine stroke with the combustion air supply and fuel supply both being reduced, for example by the throttle. This improves engine responsiveness in comparison to the case if the displacement had been reduced toward or to the minimum level. In this case, the fuel and combustion air supply is increased when the engine is operated at above idle conditions. Under coasting conditions, the engine displacement is reduced (e.g., toward or at the minimum, such as zero displacement) with the combustion air supply and fuel supply reduced (e.g., toward or at a minimal level or totally closed off). This increases engine fuel efficiency under these conditions. Under engine braking conditions, the engine displacement may be set at a high level (e.g., at or toward the maximum displacement level), the engine fuel may be reduced (e.g., toward a minimum fuel level or shut off), and the air supply may be maintained at a high level. Again, other engine control approaches may also be used.

In one specific form of variable stroke adjuster, an engine stroke varying cylinder and piston is positioned at least partially in the center of a plurality of cylinders of the engine. More desirably, the engine stroke varying cylinder and piston may be positioned entirely between the engine cylinders. The engine stroke varying piston may be coupled to the housing and is positioned within the engine stroke varying cylinder. Delivery of operating fluid to the stroke varying cylinder at one side of the stroke varying piston moves a first output shaft section of the output member in a first direction along the first axis. Delivery of operating fluid to the stroke varying cylinder at the opposite side of the stroke varying piston moves the first output shaft section in a second direction opposite to the first direction along the first axis. The first section of the output member is correspondingly shifted relative to a second shaft section of the output member. Swash plate assemblies in this embodiment are coupled to the first output shaft section such that movement of the first output shaft section changes the angle of tilt of the swash plate assemblies relative to the first axis about which the output member rotates. As a result, the stroke of the piston or pistons of the engine is increased or decreased.

In another form, a drive mechanism such as at least one adjustment gear is drivenly coupled to the first section and rotatable in a first direction to shift the first section in a first direction along the first axis. The adjustment gear is rotatable in a second direction opposite to the first direction to shift the first gear in a second direction opposite to the first direction. Rotation of the adjustment gear shifts the first section in either the first or second direction depending upon the direction of rotation of the adjustment gear to thereby adjust the angle of the swash plate assemblies to vary the stroke of the engine. An endless ball bearing track may be used to couple the first section to the housing.

Other mechanisms may be used to adjust the swash plate angle of at least one of the swash plate assemblies to vary the stroke of the engine. Desirably, the angle of the counterbalancing swash plate assembly is also adjusted in a direction opposite to the adjustment of the other swash plate assembly to enhance the counterbalancing function performed by the counterbalancing swash plate assembly.

As an engine operates, a piston travels within its associated cylinder between a top dead center position and a bottom dead center position and back to the top dead center position during a piston stroke. A piston tends to exert a force or ride against a first portion of the associated cylinder (one portion of the cylinder wall) during one portion of the piston stroke and against a second portion of the cylinder (a second portion of the cylinder wall) during another portion of the piston stroke. As an aspect of an embodiment, desirably the geometries of coupling of one or more pistons to the swash plate assembly or assemblies is such that each such piston shifts from exerting a force against a first portion of the cylinder to exerting a force against a second portion of the cylinder when the piston is in either the top dead center position or the bottom dead center position. In this embodiment, the shifting of forces between sections of the cylinder wall thus takes place desirably only when the piston is changing its direction of motion as it passes through the top dead center and bottom dead center positions.

It should be again noted that the present invention is directed to new and non-obvious aspects of a swash plate combustion engine both alone and in various combinations and sub-combinations with one another as set forth in claims below. In addition, the embodiments described herein are provided as examples with the invention not being limited to the described embodiments.

DETAILED DESCRIPTION OF THE DRAWINGS

Figure 24:
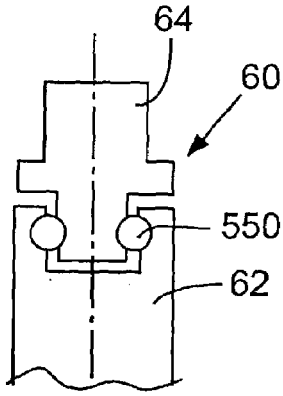
Figure 25:
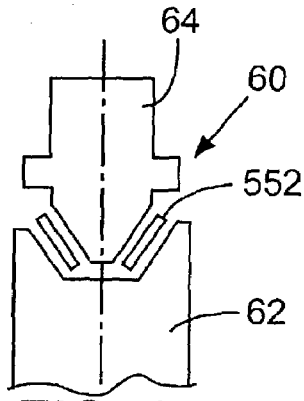
Figure 26:
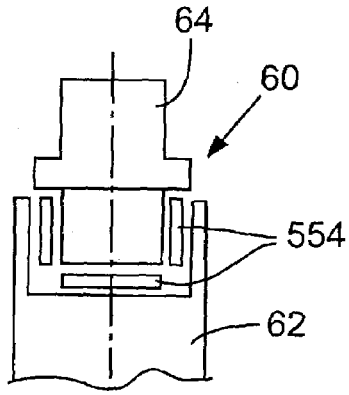

FIGS. 24–26 schematically illustrate exemplary bearing arrangements for coupling a rotatable portion of a swash plate assembly to a reciprocating portion of a swash plate assembly.

Figure 27:
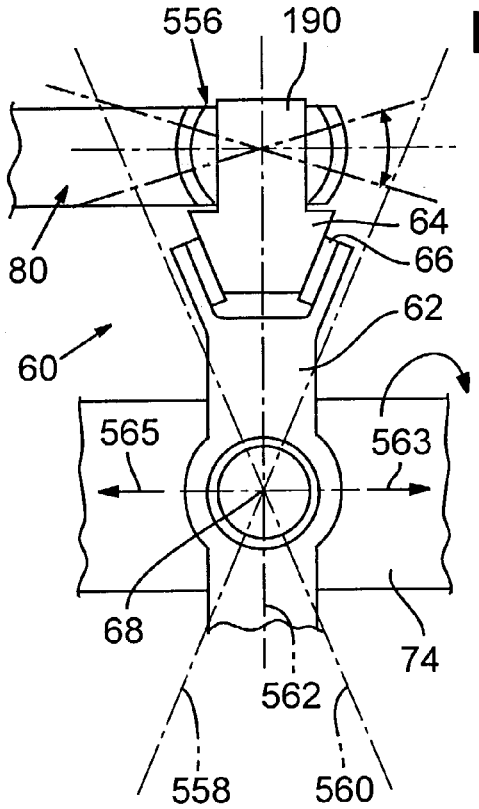

FIG. 27 schematically illustrates a construction in which a ball bearing structure is utilized for coupling a piston rod to a reciprocating disk portion of a swash plate assembly.

Figure 28:
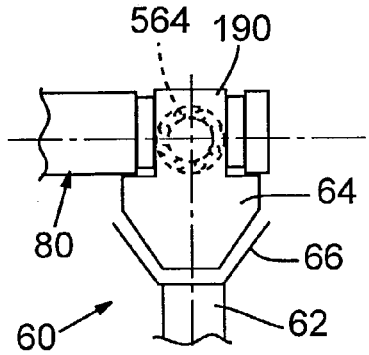

FIG. 28 schematically illustrates an embodiment in which a universal joint is used to couple a piston rod to a reciprocating member of a swash plate assembly.

Figure 28A:
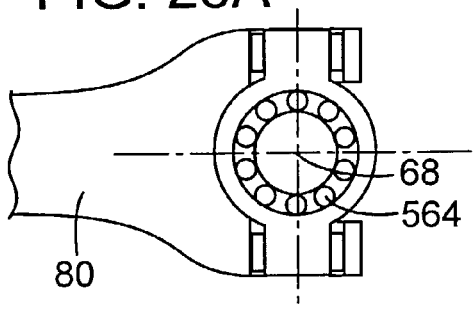

FIG. 28A is an end schematic view of the FIG. 28 construction looking down from the top of FIG. 28.

Figure 29:
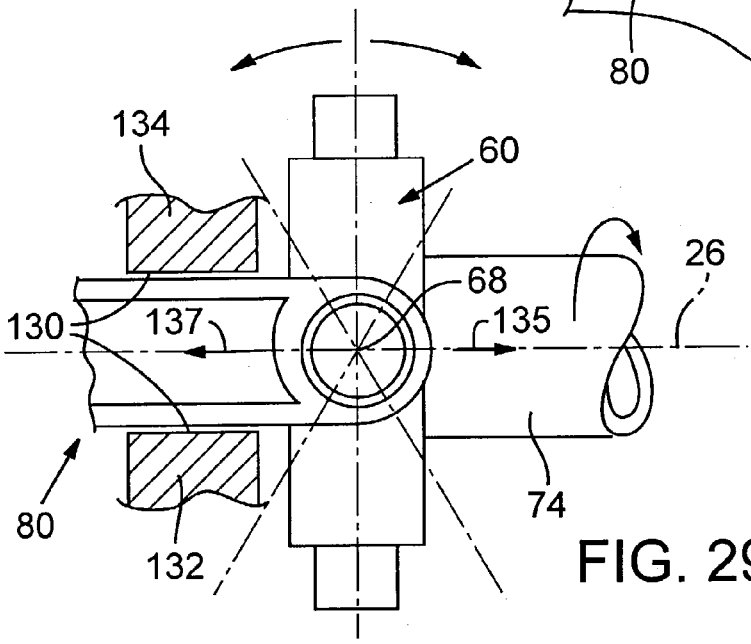

FIG. 29 schematically illustrates one form of a guide member positioned to slidably engage a piston rod with the piston rod being coupled to a reciprocating portion of a swash plate assembly, the guide member restricting the reciprocating portion of the swash plate assembly against rotation.

FIG. 30 schematically illustrates a form of swash plate assembly having a reciprocating portion formed of plural ring sections, in this case two such sections, and a single piece rotating swash plate assembly member.

FIG. 31 is a schematic sectional view of the swash plate assembly of FIG. 30 taken along lines 31—31 of FIG. 30.

FIG. 32 schematically illustrates a swash plate assembly with a lubricating fluid supply for delivering lubricating fluid to the bearings of the assembly.

FIG. 33 schematically illustrates a construction in which a rotating track follower travels within a track to restrict a reciprocating portion of a swash plate assembly against rotation.

Figure 34:
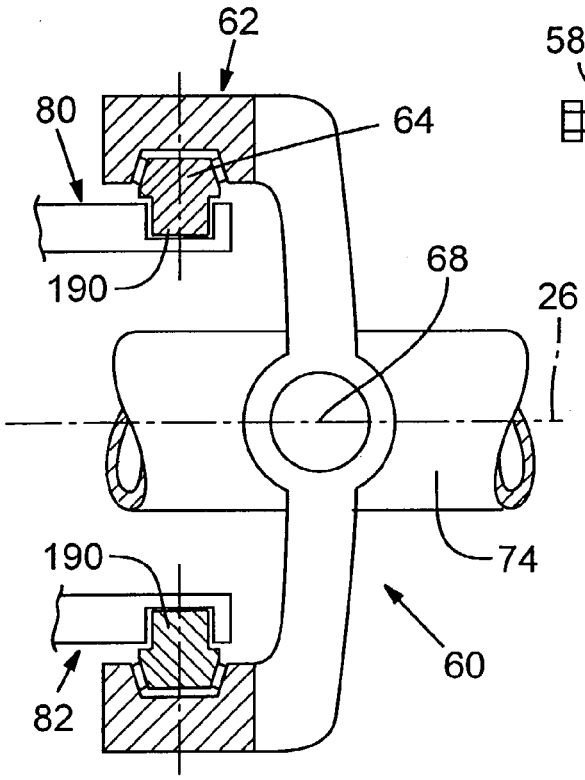

FIG. 34 schematically illustrates an embodiment of a swash plate assembly in which a reciprocating portion of the swash plate assembly is positioned inside a rotary portion of a swash plate assembly.

Figure 35:
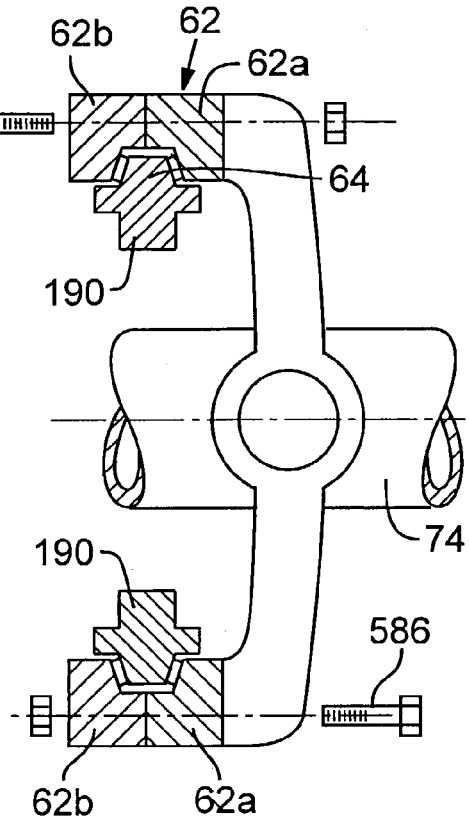

FIG. 35 schematically illustrates a swash plate assembly similar to FIG. 34 wherein the rotary portion of the swash plate assembly is formed of plural annular pieces which are interconnected in face-to-face relationship.

Figure 36:
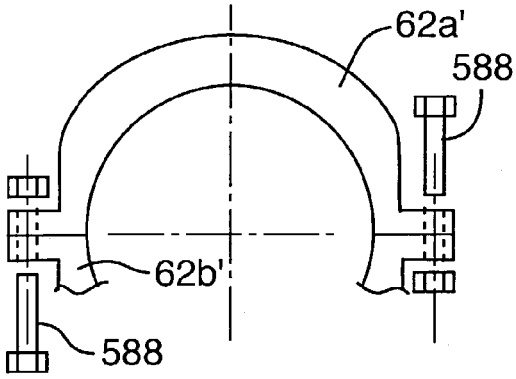

FIG. 36 is a schematic embodiment which is similar to FIG. 35 in which the rotary portion of the swash plate assembly is formed of plural interconnected ring sections.

Figure 37:
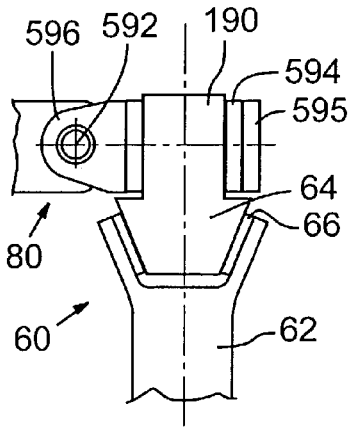

FIG. 37 schematically illustrates an embodiment of a swash plate assembly in which a piston rod is pivoted to a projecting element which is coupled by a bearing, such as a universal bearing, to a reciprocating portion of a swash plate assembly to thereby couple the piston rod to the swash plate assembly at an off-center location.

Figure 38:
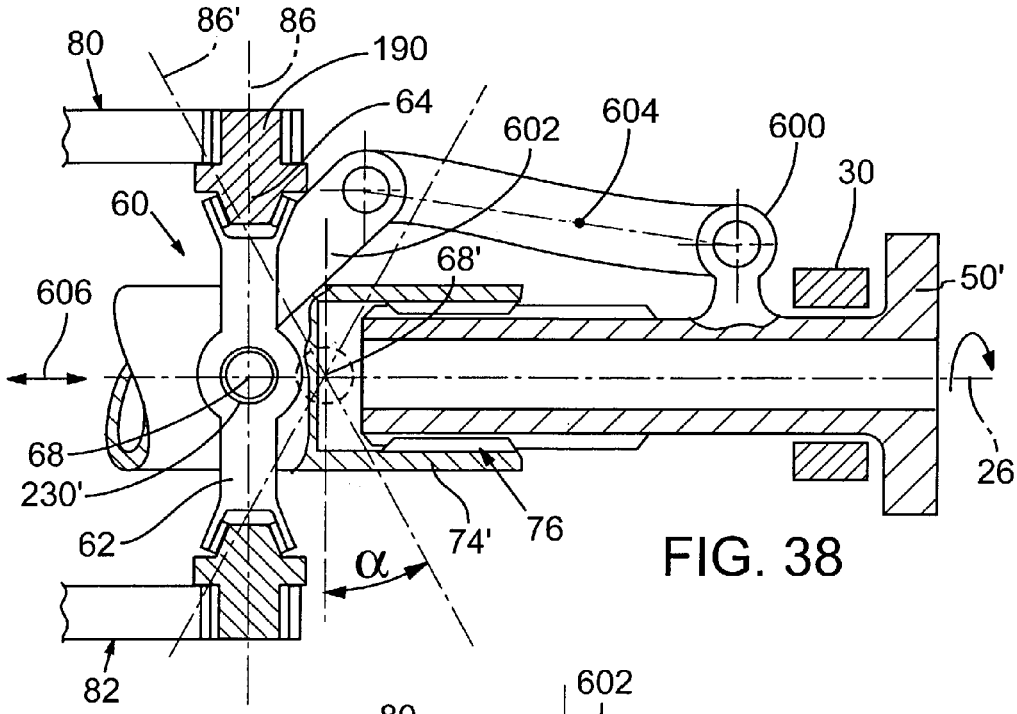

FIG. 38 schematically illustrates one form of a mechanism which may be used to vary the angle of a swash plate assembly to thereby vary the piston stroke or engine displacement.

Figure 1:
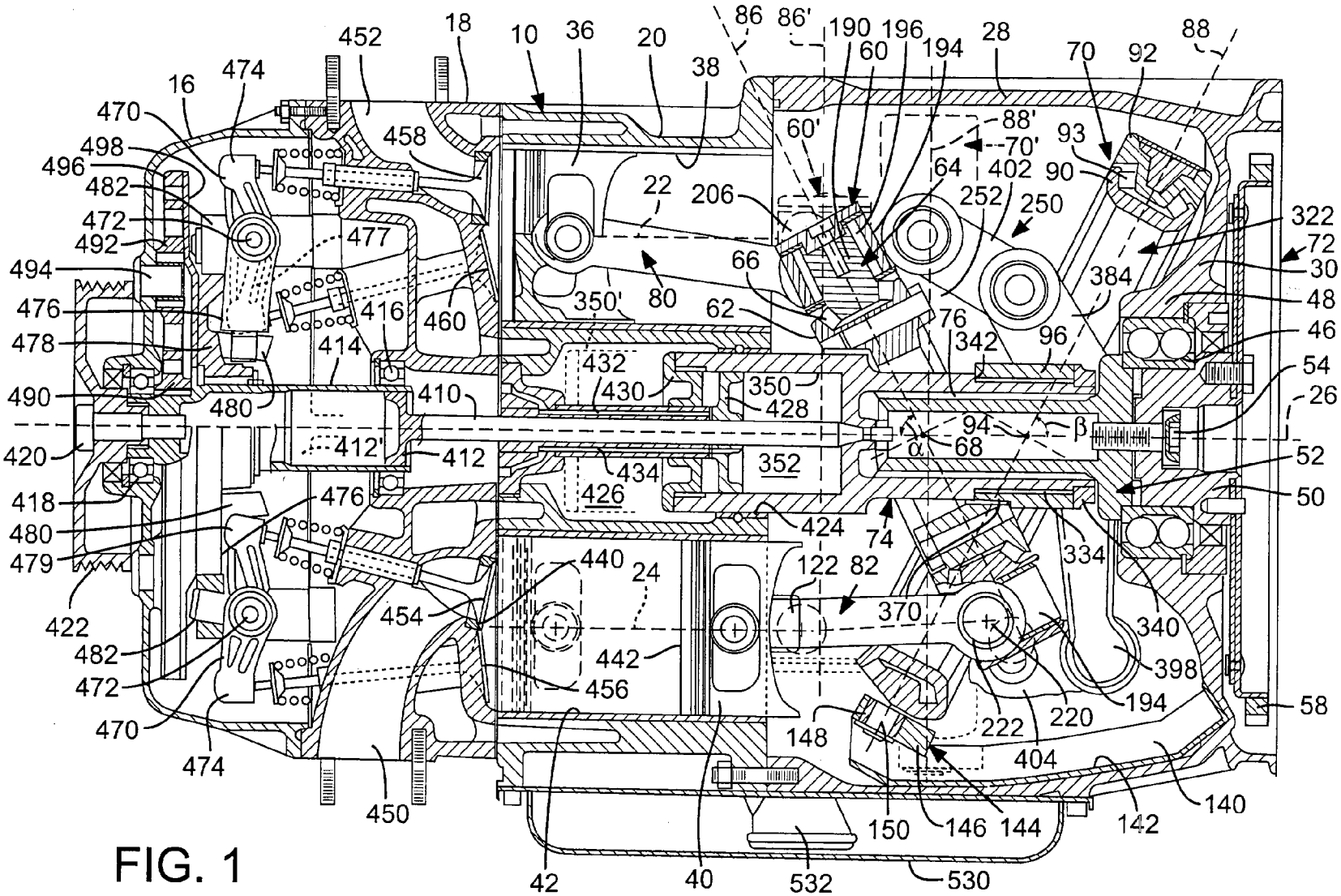
FIG. 1 is a vertical sectional view through a first embodiment of a swash plate engine.
Figure 39:
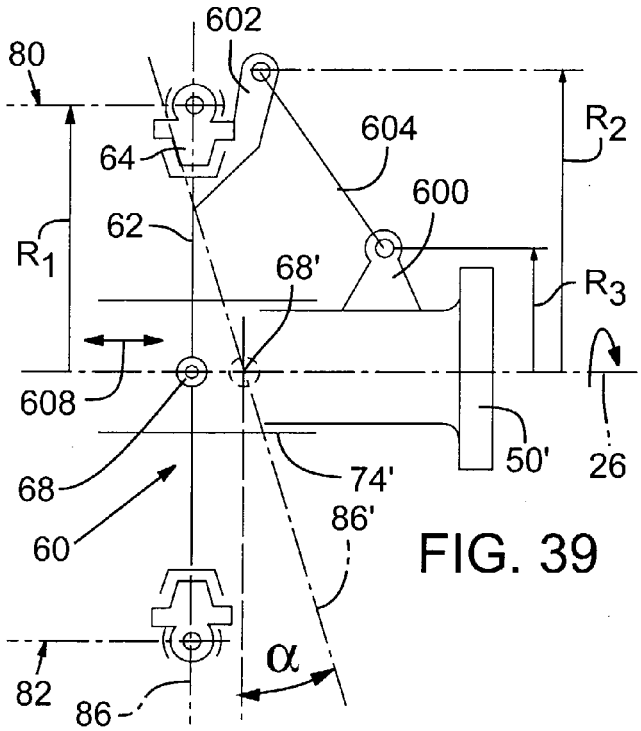

FIG. 39 schematically illustrates an engine construction which, like the embodiment of FIG. 1, provides a substantially equal combustion ratio for various swash plate assembly angles.

Figure 40:
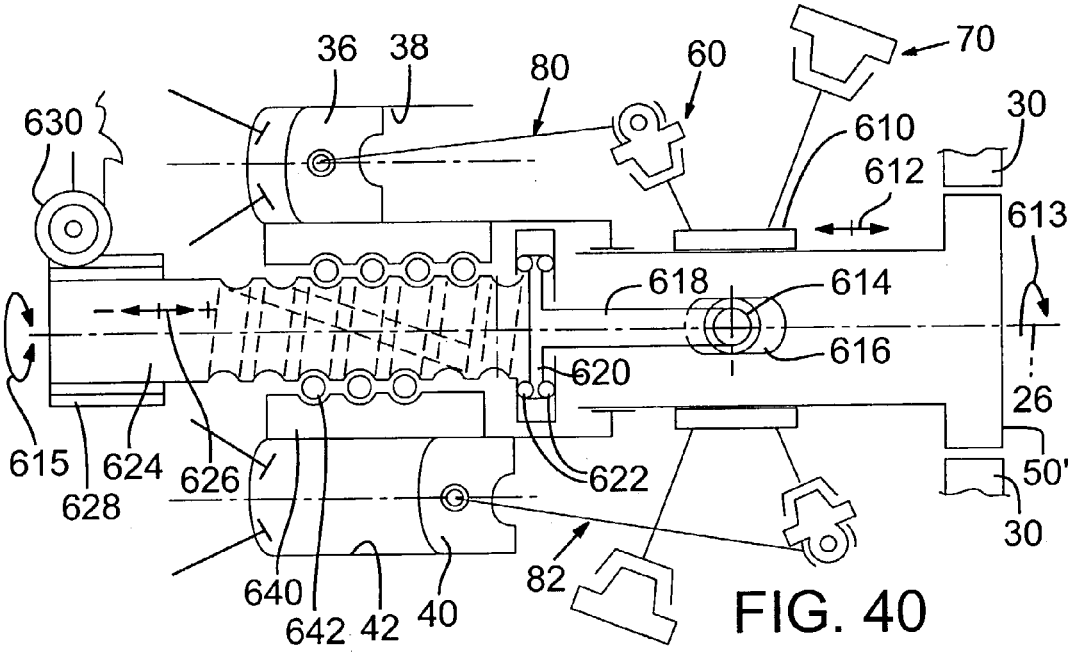

FIG. 40 schematically illustrates an alternative mechanism for varying the angle of a swash plate assembly.

Figure 41:
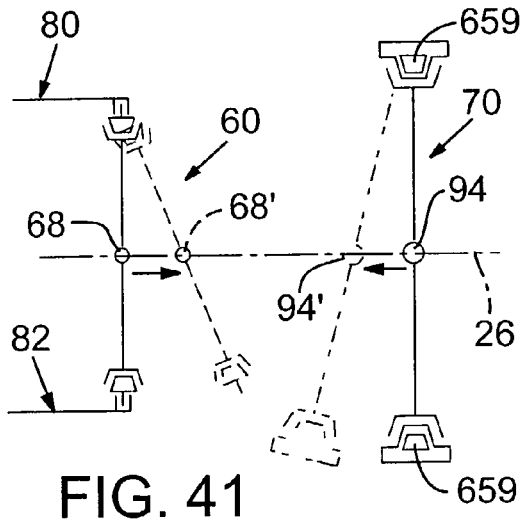

FIG. 41 schematically illustrates a swash plate engine embodiment in which a counterbalancing swash plate assembly is positioned far enough away from a driven swash plate assembly such that the reciprocating portions of the two swash plates do not pass through or interfere with the motion of one another during operation of the engine.

Figure 42:
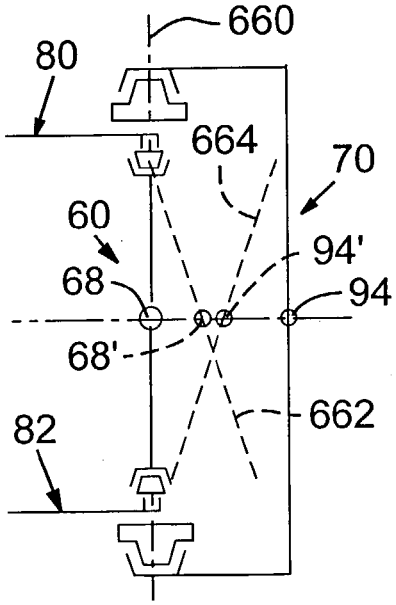

FIG. 42 schematically illustrates a swash plate engine in which, during at least one operating position of the engine, first and second swash plate assemblies have rotating members which are in a common plane.

Figure 43:
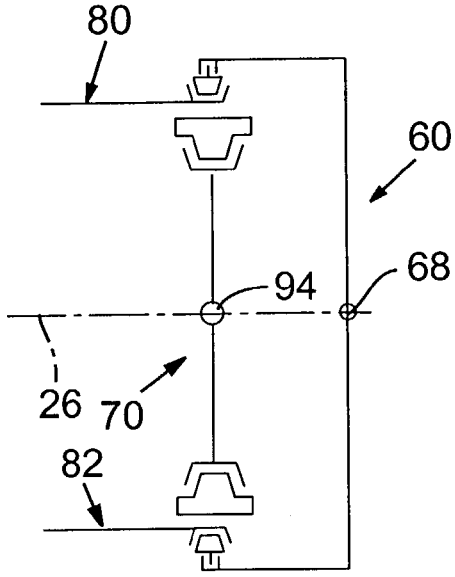

FIG. 43 schematically illustrates a portion of a swash plate engine in which a counterbalancing swash plate assembly is positioned inwardly of a driven swash plate assembly.

Figure 44:
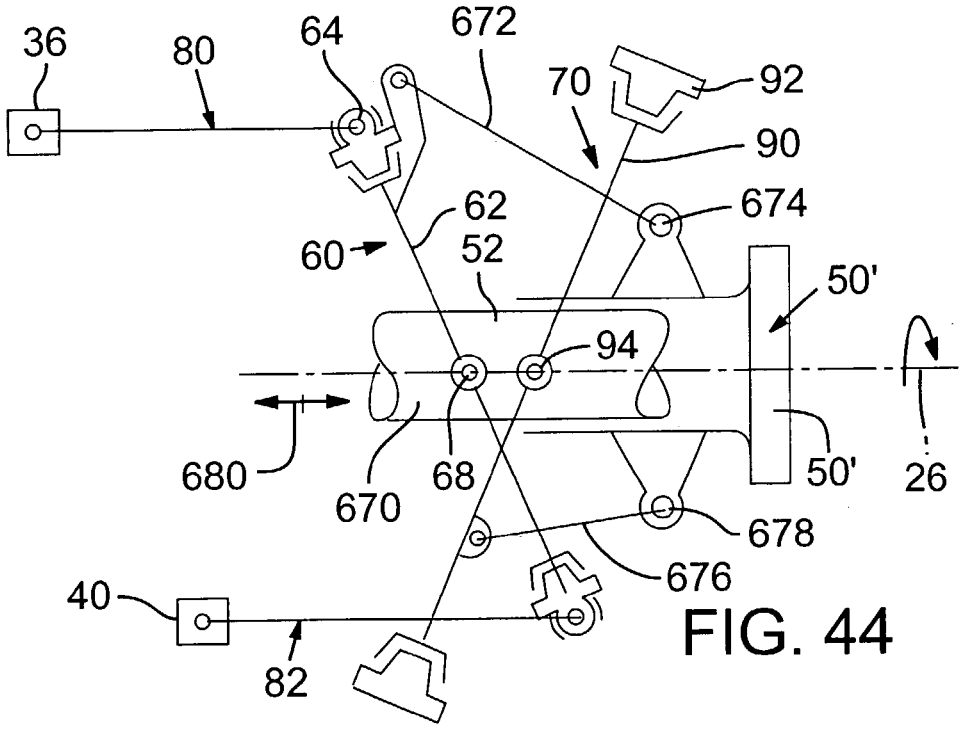

FIG. 44 schematically illustrates a swash plate engine having plural swash plate assemblies which are pivotally supported by a common shaft with links which couple rotating members of each swash plate assembly to an output member or shaft.

Figure 45:
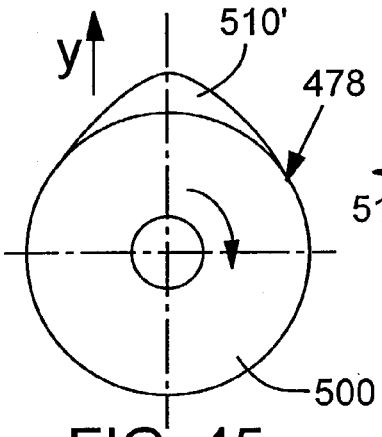
Figure 46:
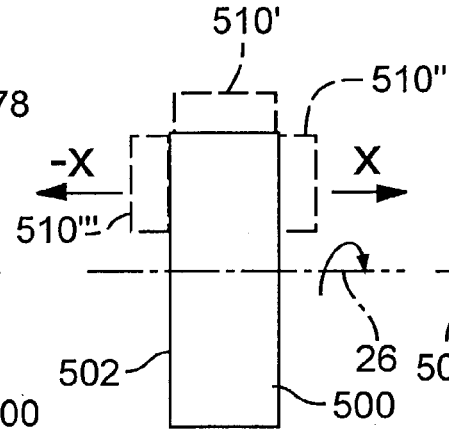
Figure 47:
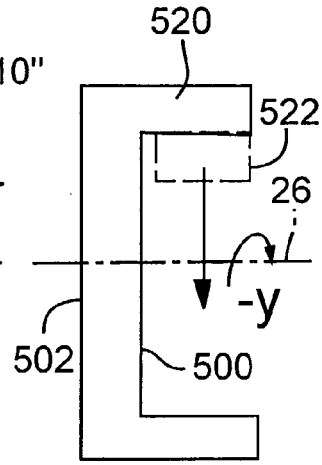

FIGS. 45–47 schematically illustrate exemplary cam body constructions for use in operating air intake and exhaust valves of a swash plate engine.

Figure 48:
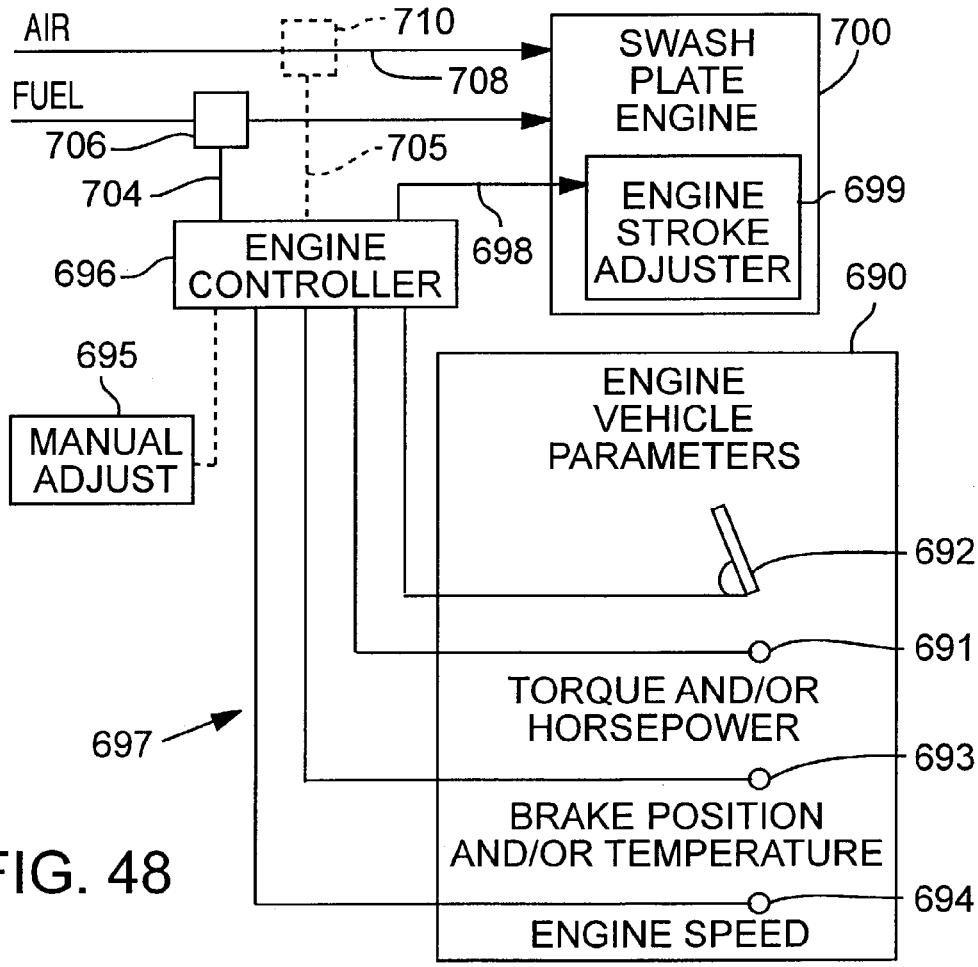

FIG. 48 schematically illustrates a form of a control mechanism usable in certain embodiments for controlling the angle of a swash plate assembly to vary the engine stroke in response to at least one vehicle parameter.

DETAILED DESCRIPTION

With reference to FIG. 1, one form of an internal combustion engine is illustrated which comprises at least first and second swash plate assemblies wherein one of the swash plate assemblies is a counterbalancing swash plate assembly. The engine of FIG. 1 comprises a housing 10 which may comprise a plurality of housing sections. In the FIG. 1 form of housing 10, the housing comprises a valve cover portion 16 within which valves and a valve actuator mechanism is positioned. The housing 10 also comprises an engine head portion 18 comprising the head or heads to one or more cylinders included within the engine and further defining air intake and air exhaust gas passageways leading to the cylinders and which are opened and closed by respective intake and exhaust valves as described below. The illustrated housing 10 further comprises a cylinder case portion 20 within which at least one cylinder is positioned. The FIG. 1 engine comprises a five cylinder engine for illustration. In the embodiment of FIG. 1, the longitudinal axes of the respective cylinders are indicated by 22 and 24 (for two cylinders shown therein). Longitudinal axes 22,24 extend in a first direction and, in the FIG. 1 embodiment, the first direction is parallel to a longitudinal axis 26 of the engine. The housing 10 also comprises a swash plate engine housing portion 28 within which swash plate assemblies of the engine are positioned. The engine housing of FIG. 10 also comprises an output support portion 30 positioned to support an output member such as an output shaft 50 of the engine.

The various housing components may comprise separate elements which are interconnected, such as by bolts or other fasteners, with respective gaskets or seals between the housing sections. Alternatively, and as explained in greater detail below, a plurality of the housing sections may be formed of a single monolithic one-piece construction, such as being cast together. In the embodiment of FIG. 1, the swash plate engine containing portion 28 and output member support portion 30 are illustrated as being of a one-piece integrated monolithic construction. In contrast, the valve cover portion 16, the cylinder head portion 18 and the cylinder case portion 20 in FIG. 1 are illustrated as separate components which are interconnected with the other components of the housing to form the overall housing 10.

At least one cylinder, as previously mentioned, is included within the engine housing in the case of a single cylinder engine. For plural cylinder engines, a plurality of cylinders are provided. A respective reciprocatable piston is positioned within each of the cylinders included in the engine for reciprocation therein. In the engine of FIG. 1, a piston 36 is positioned for reciprocation within a cylinder 38 which has longitudinal axis 22. In addition, a piston 40 is positioned for reciprocation within a cylinder 42 which has the longitudinal axis 24.

A rotatable output member is coupled to the housing and rotatable about a first axis. In the embodiment of FIG. 1, the rotatable output member comprises an output assembly rotatably coupled by bearings 46 to a bearing retaining portion 48 of the housing portion 30. The illustrated output assembly includes a first output shaft section 50 supported by the bearings 46 for rotation about an output axis which, in FIG. 1, corresponds to the longitudinal axis 26 of the engine. The axis about which the output member 50 rotates may be defined as a first axis regardless of whether it is coextensive or aligned with the longitudinal axis of the engine. The output assembly of FIG. 1 also comprises a second output shaft section 52 which is coupled to output shaft section 50, such as by a bolt 54, such that the shaft sections 50,52 rotate together. The rotating output sections 50,52 may be coupled in any convenient manner to a drive axle or other power utilization apparatus of the engine. For example, a fly wheel with a gear 58 for coupling to an engine starter motor may be fastened, such as by bolts, to output section 50 for use as a power output device.

The engine of FIG. 1 comprises at least first and second swash plate assemblies with two such assemblies being indicated respectively at 60 and 70 in FIG. 1. Each of these assemblies 60,70 is shown positioned within the swash plate portion 28 of housing 10. In the FIG. 1 embodiment, each of the first and second swash plate assemblies 60,70 are positioned closer to an end portion 72 of the engine than the engine cylinders (e.g., cylinders 38,42 and the other cylinders of the engine). Thus, all of the cylinders are at the same side of the swash plate assemblies. This is a desirable option as it reduces the overall length of the engine in comparison to an embodiment wherein some cylinders are disposed at one side of the swash plate assemblies and other cylinders are disposed at the opposite side of the swash plate assemblies.

Swash plate assembly 60 comprises a first member 62 and a second member 64 (which members may take forms other than those shown in FIG. 1). The first member 62 is rotatably coupled to the second member 64, such as by bearings 66. Bearings 66 may comprise, for example, ball bearings or conical barrel bearings. The bearings may also be friction bearings in the form of bearing surfaces that slide in contact with one another. These friction bearings may be lubricated using a pressure lubrication system, such as in the form described in an embodiment below. As a result, the first member 62 is rotatable relative to the second member 64 and about the first axis, in this case axis 26. In addition, as explained in greater detail below, the second member 64 is coupled to the housing 10 so that the second member is restrained against rotation. However, the second member is capable of reciprocation, and as it reciprocates it drives the first member in rotation. The first member may be pivotally coupled to the output member for pivoting about a second axis which is transverse to the first axis 26. In the embodiment of FIG. 1, this second axis is indicated at 68, is perpendicular to axis 26, and extends into the page in FIG. 1. As explained below, the engine of FIG. 1 has variable stroke capabilities with the stroke being varied by varying the angle of the first swash plate assembly relative to the first axis. In a less desirable embodiment, wherein the variable stroke feature is eliminated, the first member need not be pivoted to the output member. As a result of the connection of the first member to the output member, the first member 62 is rotated to thereby rotate and drive the output member as the second member 64 is reciprocated. In the FIG. 1 embodiment, the first member 62 is pivoted to a coupling element such as a portion of a collar assembly indicated generally at 74. The collar assembly in the FIG. 1 embodiment is coupled to the output section 52. For example, collar assembly 74 and output section 52 may have splines indicated at 76 which are aligned with axis 26. This permits collar assembly 74 to shift axially relative to section 52 with these components being drivingly interconnected.

A piston rod 80 is pivotally coupled to piston 36 and also pivotally coupled to the second member 64. Similarly, a piston rod 82 is pivotally coupled to piston 40 and to the second member 64. In the same manner, each piston of the engine is coupled by an associated piston rod to the second member. The piston rods reciprocate with the reciprocal movement of the piston. Reciprocal movement of the pistons and piston rods results in reciprocal movement of the second member 64. This reciprocal movement of the second member causes rotation of the first rotatable member 62 and the output section 50 about the first axis. In FIG. 1, the first swash plate assembly 60 is shown generally aligned in a first plane 86 which is at a first angle $\alpha$ with respect to the axis 26.

The second swash plate assembly is shown in solid lines in FIG. 1 generally aligned with a plane 88 which is at an angle $\beta$ relative to the first axis. As a result, the swash plate assemblies 60 and 70 are generally at angles which are opposite to one another such that the reciprocating movements of the swash plate assemblies are counterbalanced by one another. The second swash plate assembly 70 comprises a third rotatable member 90 and a fourth member 92. The third member 90 is rotatably coupled to the fourth member 92 for rotation relative to the fourth member and about the first axis, in this case axis 26. The fourth member 92 is coupled to the housing 10, such as explained below, so that the fourth member is restrained against rotation. The third member 90 may also be pivotally coupled to the output member for pivoting about a third axis which is transverse to the first axis. In this example, member 90 is pivotally coupled to section 50, in this case via components 74 and 96, for pivoting about an axis 94 which is not only transverse to the axis 26, but in this example is perpendicular to axis 26 and extends into the page of FIG. 1. As a specific example, in FIG. 1 the member 90 is pivoted to a collar assembly 96 carried by collar assembly 74. The term collar in this description encompasses a component which at least partially surrounds another component as well as a component which entirely surrounds another component such as shown by the specific embodiment of FIG. 1. In addition, the rotatable member 90 is coupled by a coupling assembly to the rotatable member 62 such that member 90 and member 62 rotate together and about the axis 26. Rotational movement of the third member results in reciprocal movement of the fourth member 92. Although not required, in FIG. 1 the axes 68 and 94 are spaced apart from one another. In addition, these two axes lie in a common plane which also contains the axis 26. That is, axes 68 and 94 in the FIG. 1 embodiment are parallel to one another.

With the construction shown in FIG. 1, as the second member 64 reciprocates due to the reciprocation motion of the pistons, the member 92 also reciprocates. Because of the respective oppositely angled inclinations of the swash plate assemblies 60 and 70, the reciprocating members of these two swash plate assemblies, namely members 64 and 92, reciprocate in opposite directions to counterbalance one another. Bearings, such as ball bearings or conical barrel bearings 93, or friction bearings, may also rotatably interconnect members 90,92 of the swash plate assembly 70.

A variety of alternative constructions may be utilized to restrict the motion of members 64 and 92 of the respective swash plate assemblies to reciprocation without rotation about the axis 26.

Figure 2:
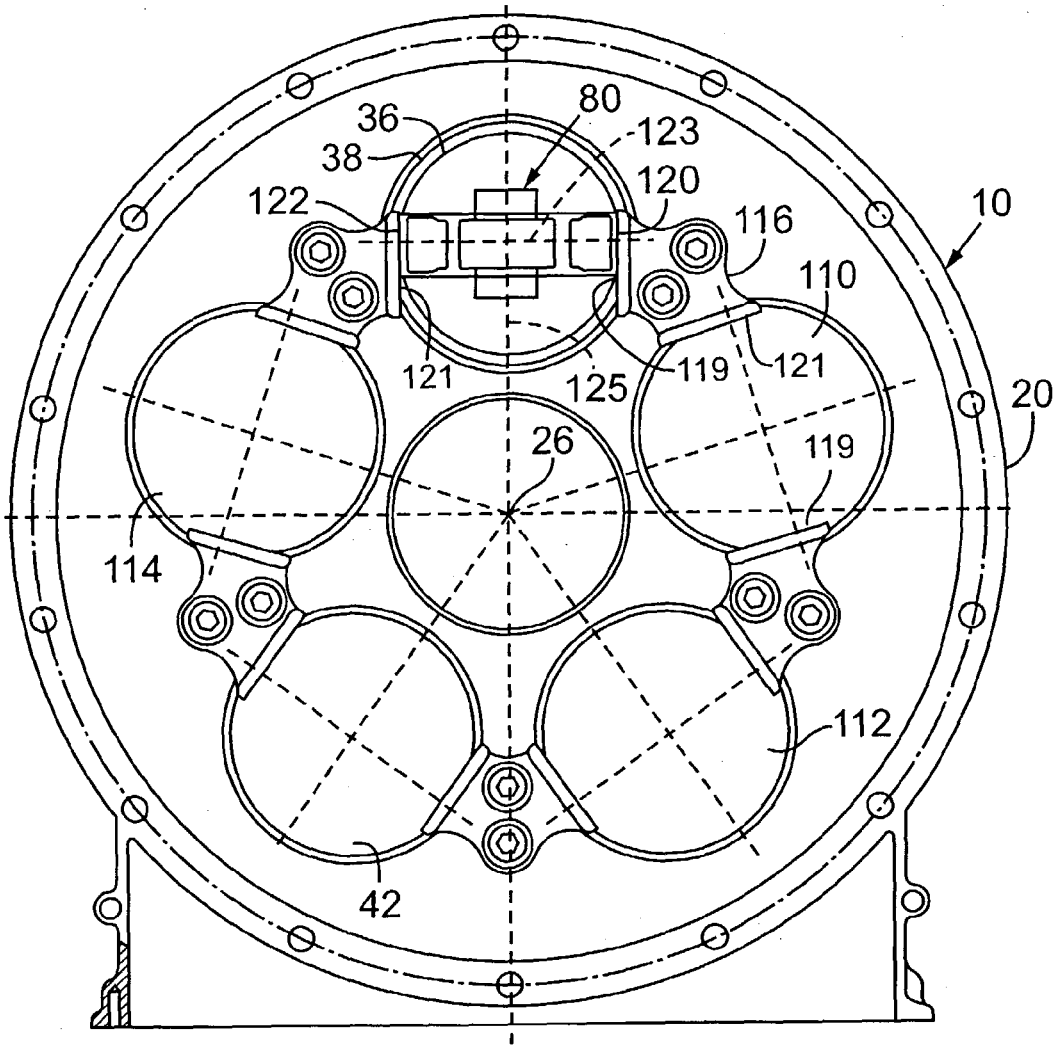
FIG. 2 is a view of one form of a cylinder case portion of an engine usable in the embodiment of FIG. 1, looking from the right toward the left in FIG. 1, and showing a portion of one form of a piston rod structure positioned in one of the cylinders.

For example, at least one piston rod motion confining member coupled to the housing (such as coupling members 116, mounted to cylinder case portion 20, two of which are numbered in FIG. 2, with piston rod engaging surfaces 119,121) and to a piston rod (e.g., to rod 82) may be used to engage the piston rod (e.g., to engage guide surfaces 120, 122 of piston rod 80, FIG. 2) to limit the motion of the piston rod to reciprocation without rotation about the first axis. Since the second member 60 is coupled to the housing by the piston rod motion confining member, and because the piston rod is thereby restricted against rotation about the first axis 26, the second member 64 is also restricted against rotation about axis 26 and thus its motion is limited to reciprocation. The piston rod engaging guide restricts the piston rod against rotation about the first axis and thereby confines the second member 64 to reciprocation without rotation about the first axis.

Consider FIGS. 2 and 8–10. FIG. 2 illustrates the cylinder case portion 20 of the engine of FIG. 1 having five cylinders 38, 110, 112, 42 and 114. The respective cylinders in this embodiment are shown interconnected by coupling or sliding friction members, two of which are indicated at 116. The underside of piston 36 (looking from the right in FIG. 1) and cylinder 38 is illustrated in FIG. 2. A specific exemplary form of a piston rod 80 is also shown in this figure. Piston rod 80 comprises sliding member engaging surfaces 120,122 which are positioned to slide against respective portions (e.g., surfaces 119,121) of the members 116. The engaging surfaces 120,122 are opposed from one another along a line 123 which is perpendicular to a line 125 through the axis 26.

Figures 8, 9, 10, 11, 12, 13, 14:
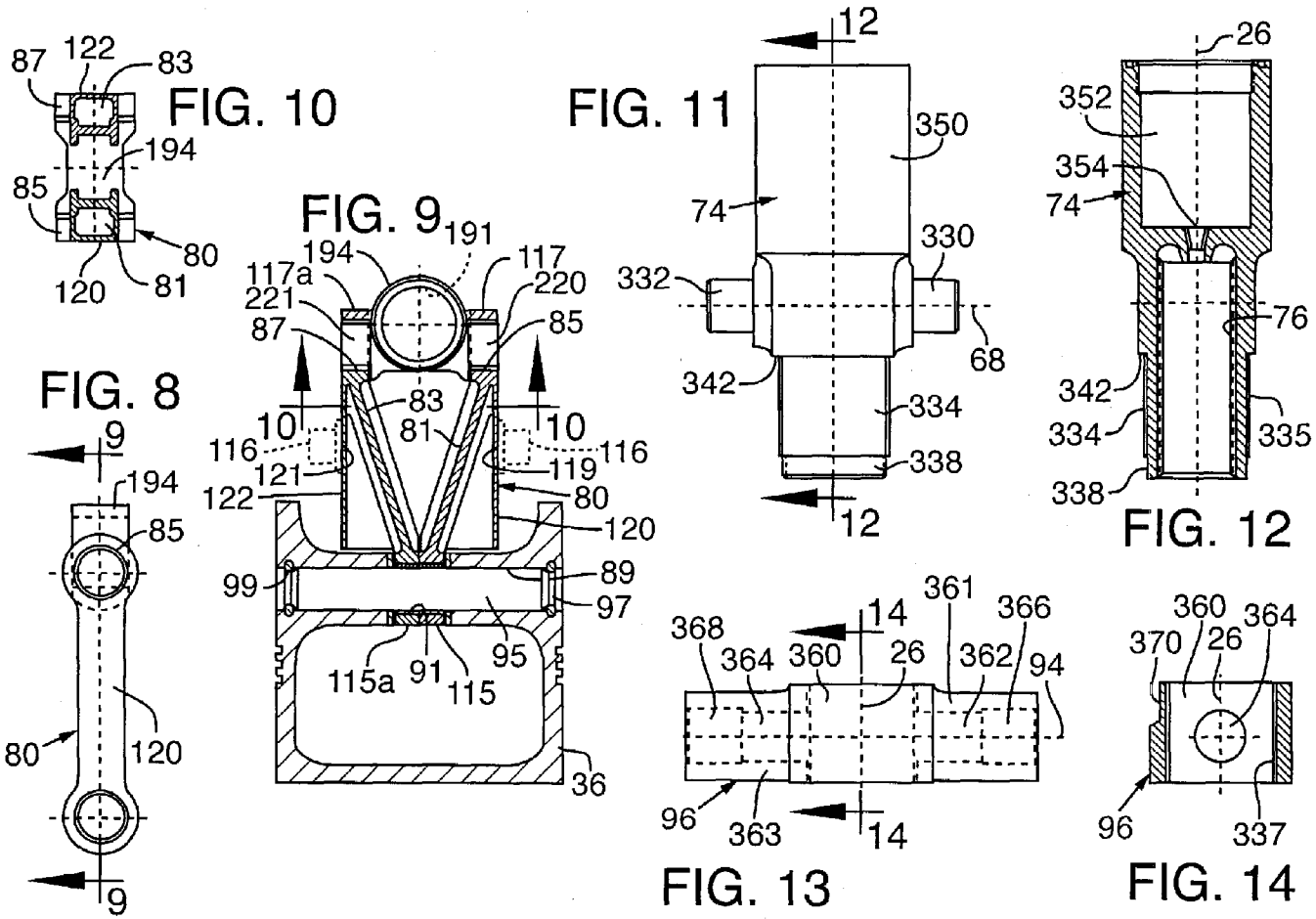
FIG. 8 is a side elevational view of one form of piston rod usable for coupling a piston of the FIG. 1 embodiment to a swash plate assembly.
FIG. 9 is a vertical sectional view through the piston rod of FIG. 8 illustrating one form of a slide guide which restricts the piston rod against rotation about the longitudinal axis of the engine of FIG. 1.
FIG. 10 is a cross-sectional view of the piston rod of FIG. 8, taken along lines 10—10 of FIG. 9.
FIG. 11 is a side view of one form of a collar or coupling mechanism for coupling the first swash plate assembly to an engine output member, such as an output shaft.
FIG. 12 is a vertical sectional view of the coupler of FIG. 11, taken along lines 12—12 of FIG. 11.
FIG. 13 is a side view of a form of second coupler or collar usable for coupling a second swash plate assembly of the FIG. 1 embodiment to the output member.
FIG. 14 is a vertical sectional view of the coupler of FIG. 13, taken along lines 14—14 of FIG. 13.

In FIG. 2, axis 26 extends into the page. With this construction, the piston rod 80 is restricted against rotational movement about the axis 26. However, the piston rod 80 may travel in directions along line 125. Correspondingly, member 64 of the first swash plate assembly 60 (FIG. 1) is also restrained against such rotational movement and is restricted to reciprocation. FIGS. 8–10 illustrate the piston rod 80 of the FIG. 2 form in greater detail. The surface 122 of piston rod 82 is also shown in FIG. 1. More specifically, the form of piston rod 80 shown in FIGS. 8–10, as best seen in FIG. 9, is comprised of first and second separate piston rod sections 81,83 which abut one another at respective ends 115,115*a* thereof and which are spaced apart from one another at the respective opposite ends 117,117*a* thereof. A pin receiving opening 191 is defined through ends 115,115*a*. Opening 191 is aligned with an opening 89 through piston 36. The piston rod sections 81,83 are connected, in this example, to piston 36 by inserting a retaining pin 95 through openings 89,91. Retainers, such as snap rings 97,99 disposed in respective grooves at the respective ends of opening 89, hold pin 95 in position. Ends 117,117*a* have respective openings 85,87 aligned along an axis which is parallel to the axis of openings 89,91. Projections 220,221 of a coupler 194 (described below) are respectively disposed within the respective openings 85,87 so that the coupler 194 is captured by the piston rod 80 and is pivotal about the axis defined by openings 85,87. Coupler 194 has an opening 191 for receiving a projection (e.g., a post 190 FIGS. 1,5) from the reciprocating swash plate member 64 (FIG. 1). This latter exemplary coupling approach is described in greater detail below.

FIG. 29 illustrates an alternative form of piston rod confining member. In the embodiment of FIG. 29, a piston rod guide channel or slot 130 is defined by members 132,134 which are rigidly coupled to the housing, such as to cylinder case portion 20 or swash plate receiving portion 28. The piston rod is slidably received within the guide channel 130 with the channel being oriented to restrict piston rod 80 against rotation about axis 26 while permitting reciprocation of the piston rod therein. Although only one piston rod is shown in FIG. 29, similar guide channels may be provided for each of the other piston rods in a plural cylinder engine construction. Collar 74 may shift axially, as indicated by respective arrows 135,137, as the swash plate assembly angle is varied. Alternatively, selected one or more piston rods may be restricted against rotary motion with the mechanical interconnection of the components thereby restricting all of the piston rods to reciprocation without rotation.

As another option, a rotating restriction assembly such as a track and track follower assembly may be used to restrict the motion of reciprocating members of the swash plate assembly to reciprocation without rotation. This construction may be utilized for each or for only one of the swash plate assemblies. For example, in FIG. 1, a track and track follower mechanism is used only for the counterbalancing swash plate assembly 70. In this example, with reference first to FIG. 1, the housing (in this case the swash plate receiving portion of the housing 28) comprises a channel or track, one wall of which is indicated at 140 in FIG. 1 with the base of the track indicated at 142. The illustrated track is generally arcuate in shape and is mounted to the interior wall of housing section 28. A track follower, such as indicated at 144, is coupled to the reciprocating member 92 of swash plate assembly 70. The track follower 144 is positioned to engage the track. The track and track follower cooperate to confine the motion of the fourth member 92 to reciprocal motion without rotation about the first axis. Although other track follower mechanisms may be used, in the FIG. 1 form, a slide shoe 146, which have a durable low friction material surface such as of a conventional copper-bronze alloy, is coupled by a bearing 148, such as a needle bearing or other suitable bearing, to a projecting support 150 extending from the perimeter of reciprocating member 92 of the swash plate assembly 70. This same low friction material may be used for other low friction surfaces mentioned in this description, although such surfaces are not limited to this material. An alternative construction is indicated schematically in FIG. 33. In the FIG. 33 construction, the track wall is indicated at 140' and the track base is indicated at 142'. The track follower is shown at 144' and comprises a rotating or roller member 146' coupled by a bearing 148' to a support structure 150'. The structure 150' is coupled to the reciprocating member 64 of the swash plate assembly 60. In the example of FIG. 33, piston rod confining elements which restrict the rotation of the piston rod about the first axis 26 may be eliminated. The use of a prime designation (') in this description in connection with a number indicates that the element corresponds to a previously described similar element designated by the same number without the prime (').

Referring again to FIG. 1, the track follower in the FIG. 1 embodiment thus comprises a slide member which slides in engagement with a channel having low friction track follower engaging wall surfaces.

Figure 4:
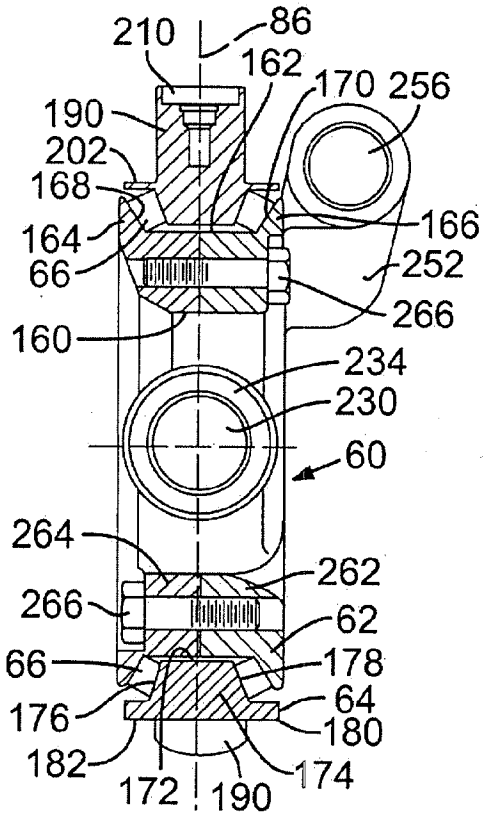
FIG. 4 is a vertical sectional view through the first swash plate assembly of FIG. 3, taken along lines 4—4 of FIG. 3.
Figure 3:
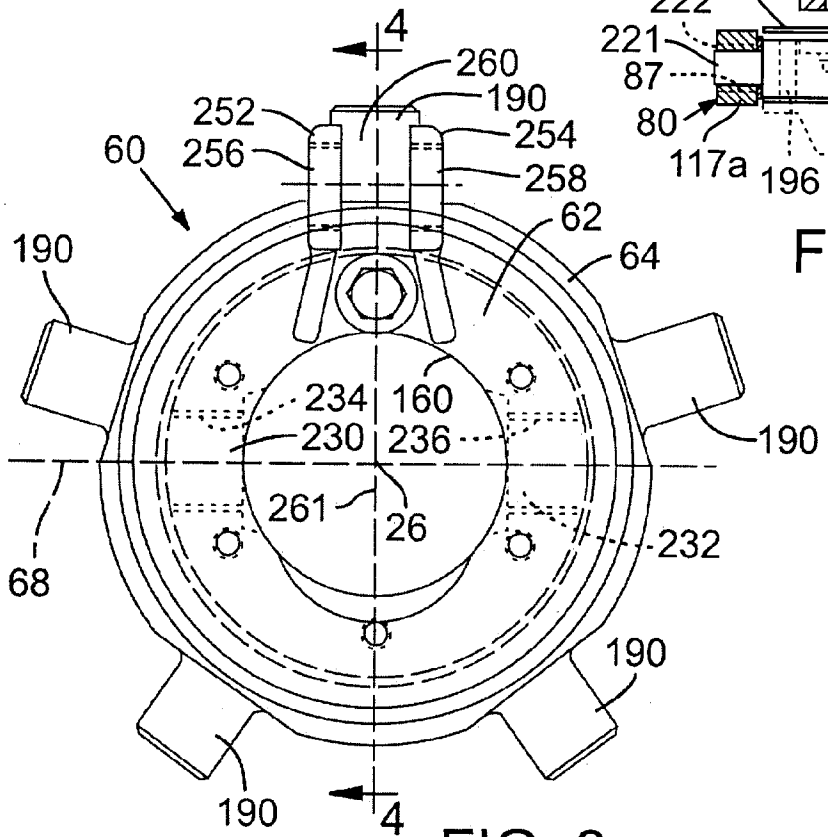
FIG. 3 is a view, looking from the right toward the left in FIG. 1, of one form of a first swash plate assembly usable in the embodiment of FIG. 1.

An exemplary first swash plate assembly 60 is shown in FIGS. 1 and 3–5. More specifically, as illustrated in FIGS. 3 and 4, the rotatable or first member 62 of swash plate assembly 60 comprises an annular structure with a central opening 160 and also comprises an outwardly facing annular surface 162 (FIG. 4). Member 62 has outwardly projecting bearing capture portions 164,166 with respective outwardly facing surfaces 168,170 in which the bearings 66, in this case conical bearings, are seated. The reciprocating member 64 of swash plate assembly 60 has an inwardly facing annular surface 172 (FIG. 4). The illustrated member 64 has an inwardly projecting central section 174 of generally trapezoidal cross-section. Section 174 has side surfaces 176,178 which are also inwardly facing and opposite to the respective surfaces 168,170. The bearings 66 are positioned between these opposed surfaces. Projecting portions 180, 182, extend in a direction perpendicular to a plane 86. The plane 86 in this example bisects the swash plate assembly 60. Portions 180,182 assist in retaining the bearings 66 in place.

Figure 5:
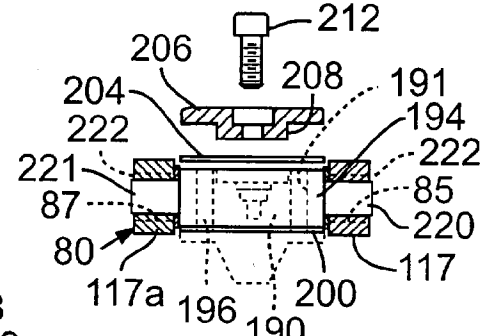
FIG. 5 is a view, partially in section, of one form of a connector usable for mounting a piston rod to an associated piston rod coupler receiving projection of the swash plate assembly of FIG. 3.

The stationary member 64 of swash plate assembly 60 comprises a respective projection for coupling to an associated piston rod of the engine with one such projection being provided for coupling to each piston rod. Thus, in the FIGS. 3 and 4 embodiments, for a five cylinder engine, there are five such projections equally spaced about the perimeter of member 64 and each designated by the number 190 in FIGS. 3 and 4. One such projection is also indicated at 190 in FIG. 1. The respective projections 190 are coupled to the piston rods. In the construction shown in FIGS. 1, 3 and 4, an offset coupling approach is used for coupling the respective piston rods to the projections 190. More specifically, an annular coupler 194 (FIG. 1) is rotatably coupled by bearings 196 to a respective post 190 with a similar coupler being provided for each of the posts or projections. The bearings 196 are positioned within an opening 191 defined by the coupler 194. FIG. 5 illustrates an exemplary coupler 194. A washer 200, with a low friction surface, is positioned between coupler 194 and a shelf portion 202 (FIG. 4) of member 64. A second washer 204 (FIG. 5), with a low friction surface, is positioned between a retaining cap 206 and the coupler 194. Cap 206 has a projecting portion 208 designed to fit within a recess 210 (FIG. 4) in the distal end of the associated post or projection 190. Cap 206 is fastened in place, such as by a bolt 212, to secure the coupler 194 to the associated post 190. A projecting piston rod receiving projection 220 (one being shown in FIG. 1 and in FIG. 5) extends outwardly from the side of coupler 194 and supports bearings 222. A piston rod receiving projection 221 extends outwardly in a direction opposite to projection 220 and supports bearings 222. Piston rod end 117 is pivotally coupled to projection 220 and piston rod end 117*a* is pivotally coupled to projection 221. The piston rod ends are held in place in this construction, following their assembly onto coupler 194 because piston rod section ends 115,115*a* (FIG. 9) are captured and held together by the associated piston and coupling pin (e.g., 36,95 in FIG. 9). Washers with low friction surfaces may be positioned between the piston rod end sections 117,117*a* and adjacent components. With the connection of the piston rod 80 to the reciprocating member 64 of swash plate assembly 60, reciprocation of the piston rod causes a corresponding reciprocation of the member 64. This in turn drives the rotatable member 62 of the swash plate assembly 60 in rotation about the axis 26.

The rotating member 62 of swash plate assembly 60 (as best seen in FIGS. 3 and 4), define respective openings 230,232 which are desirably of circular cross-section and have longitudinal axes which are aligned with the pivot axis 68. Respective bearings, such as tilt bearings 234 and 236 (FIG. 3), are received within the respective openings 230, 232. The bearings 234,236 pivotally couple the swash plate assembly 60 to the output member for pivoting about the pivot axis 68. More specifically, bearings 234,236, in the construction shown, pivot the swash plate assembly 60 to the collar assembly 74 (FIG. 1) which is coupled to the output shaft or member as explained in greater detail below.

In the construction of FIG. 1, the rotating member 62 of swash plate assembly 60 is coupled to the rotating member 90 of swash plate assembly 70 by a rotating member coupling assembly. One form of such a coupling assembly is indicated generally at 250 in FIG. 1. A connector is provided on rotary member 62 for coupling to the coupling assembly. In the form shown, the connector comprises first and second spaced apart flanges 252,254 (FIG. 3) which project from one major surface of rotary member 62. Flanges 252,254 are each provided with a respective coupling pin receiving opening 256,258 for purposes explained below. In the construction shown in FIGS. 3 and 4, flanges 252,254 define a link receiving gap 260 therebetween. The gap 260 in this construction is centered on an axis 261 which is perpendicular to the pivot axis 68. The axis 262 intersects the axis 68 at the location of output pivot axis 26, which extends into the page in FIG. 3.

In the embodiment of FIGS. 1, 3 and 4, at least a major portion of the rotary member 62 is positioned inside the reciprocating member 64 of the swash plate assembly. Alternatively, a major portion of rotary member 62 may be positioned outside of member 64. In this example, the piston rod connection posts would extend inwardly instead of outwardly. That is, depending upon the construction, at least a major portion, and some cases substantially all, of the rotary member 62 is positioned inside the reciprocating member 64. Alternatively, the surface 162 (FIG. 4) may be inwardly directed with a major portion, and in some cases substantially all, of the rotary member 62 being positioned outside the reciprocating member 64. In the same manner, in swash plate assembly 70 (FIG. 1), a major portion of reciprocating member 92, and desirably substantially all of the reciprocating member, may be positioned either outwardly or inwardly of rotating member 90, depending upon the construction.

Desirably, at least one of the members 62 and 64 are of a plural piece construction. This facilitates the assembly of the swash plate mechanism and the positioning of the bearings, if used, between the respective members 62 and 64. For example, the rotating member 62 may be comprised of first and second sections 262,264 (FIG. 4) which are sandwiched together and interconnected, such as by bolts, some of which are indicated at 266, to comprise the first member. Thus, in the FIG. 4 construction, the first member 62 is formed of two such sections placed together in face-to-face relationship. Each of these sections define a portion of the annular rotating surface 162. As explained in greater detail below, desirably at least one of the third and fourth members 90,92 (FIG. 1) of the second swash plate assembly are also comprised of a plurality of interconnected sections to facilitate the positioning of bearings between such members.

Figure 7:
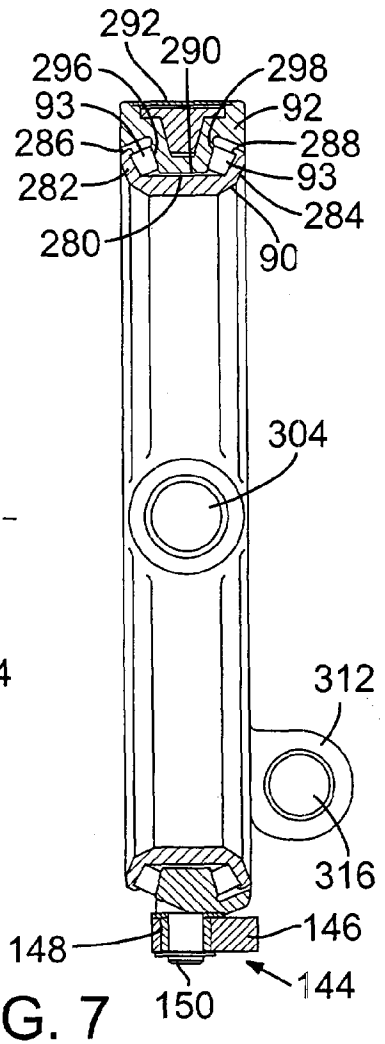
FIG. 7 is a sectional view of the swash plate assembly of FIG. 6 taken along lines 7—7 of FIG. 6.
Figure 6:
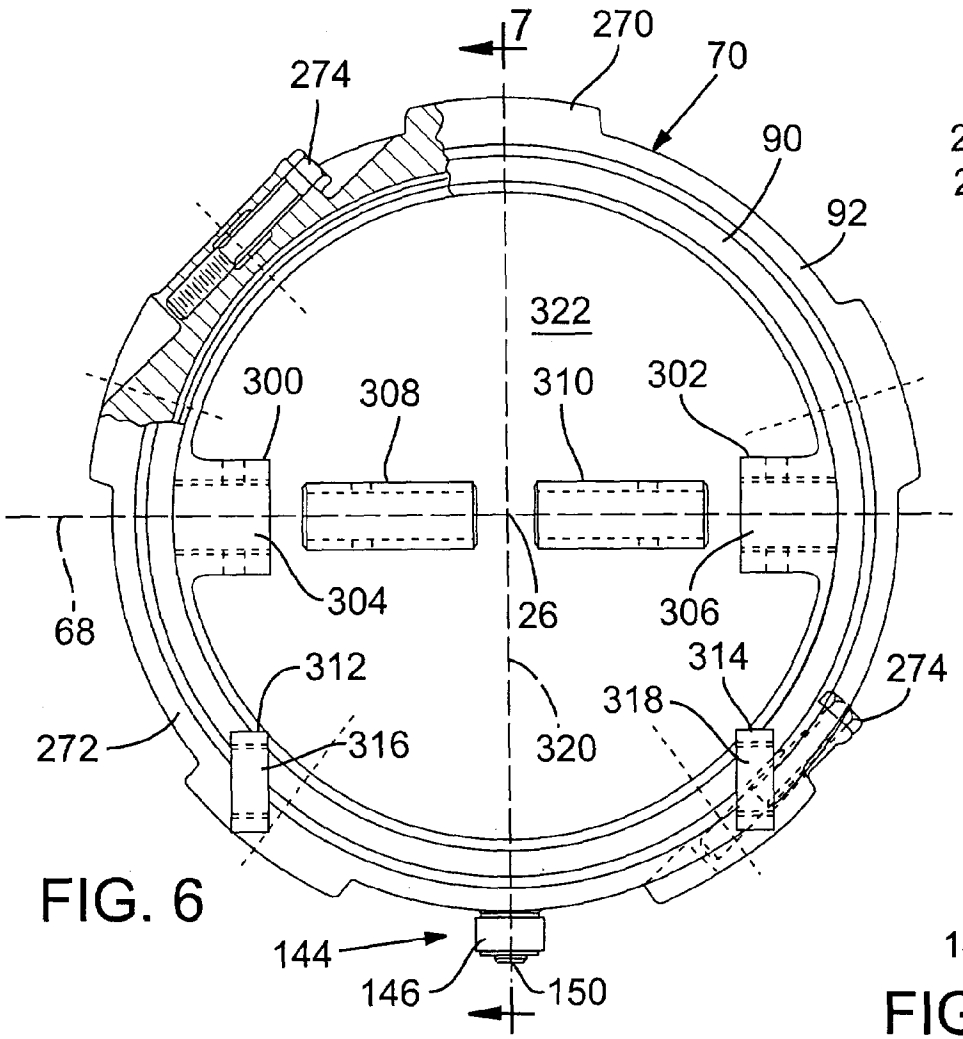
FIG. 6 is a view, looking from the right toward the left in FIG. 1, of a second or counterbalancing swash plate assembly usable in the FIG. 1 engine, with a portion thereof shown broken away.

With reference to FIGS. 6 and 7, in the construction shown, the reciprocating member 92 comprises first and second ring sections 270,272 which are interconnected, such as by fasteners or bolts indicated at 274, to complete the member 92. Thus, each of the ring sections 270,272 define a portion of an annular rotating surface as described below. The member 90 rotates relative to the annular rotating surface. With reference to FIGS. 6 and 7, rotating member 90 in this example, comprises an annular member which defines an outwardly facing annular rotating surface 280. Member 90 includes side leg portions 282,284 which define a portion of the surface 280 and which include inwardly directed distally positioned bearing retaining flanges indicated respectively at 286 and 288. The reciprocating member 92 comprises an inwardly directed annular surface 290 which generally faces the surface 280. Member 92 includes a central trapezoidal portion 292 with respective bearing engaging side surface 296,298. The bearings 93 are positioned between leg portions 282,284 and the surfaces 296, 298. Thus, in the embodiment shown, at least a major portion and desirably substantially all of the rotary member 90 is positioned inwardly of the reciprocating member 92. Also, at least a major portion and desirably substantially all of member 92 is outwardly of member 90. In alternative constructions, at least a major portion of the member 92 may be positioned inwardly of the member 90 with the respective annular surfaces 280,290 then facing generally in the opposite directions.

The member 90, in this example, comprises inwardly extending projections 300,302 (FIG. 6) each of which defines a respective circular opening 304,306. The openings 304,306 have longitudinal axes which are aligned with the pivot axis 68. Respective pivot pins 308,310 are positioned within the respective openings 304,306. Pins 308,310 may be retained in place by set screws, pins or other fasteners. Transversely extending openings (not numbered) are shown in members 300,308 and 302,310, which may be used for this purpose. Alternatively, pins 308,310 may be pivoted to the respective projections 300,302. Respective coupling members, such as flanges 312,314, are mounted to rotating member 90 and project outwardly therefrom. Each member 312,314 includes a respective pin receiving opening 316, 318. The members 312,314 are used in coupling the rotary member 90 of swash plate assembly 70 to the rotary member 62 of swash plate assembly 60 (in the embodiment of FIG. 1, this coupling is accomplished by coupling assembly 250) as explained below so that these rotary members rotate together. The projections 312,314 are symmetric with respect to a line 320 which intersects the rotation restriction track follower 144. Line 320 is perpendicular to the pivot axis 68. Line 320 intersects the axis 68 at the location of pivot axis 26, which extends into the page in FIG. 6.

As best seen in FIG. 6, the swash plate assembly 70 defines an interior passageway 322. This passageway is also shown in FIG. 1. As the swash plate assembly 60 (FIG. 1) is driven to rotate the output member 52 (FIG. 1), the reciprocating member 64 of swash plate assembly 60 reciprocates back and forth. Similarly, because of the coupling of the rotary members 62 and 90 (FIG. 1) together, as explained in greater detail below, at the same time the member 92 reciprocates in generally the opposite direction to the member 64. The passageway 322 provides clearance such that the member 64 (FIG. 1) and swash plate assembly 60 may pass through the passageway 322 of swash plate assembly 70 at least in part as the engine is driven. This occurs at least during certain operating positions of the engine of FIG. 1. For example, looking at the lower portion of the engine of FIG. 1, it is apparent that a portion of reciprocating member 64 (and thereby of swash plate assembly 60) has passed through the passageway 322. That is, the portion of the member 64 (and thereby of swash plate assembly 60) at the lower portion of the engine is to the right of the adjacent portion of the reciprocating member 92 of swash plate assembly 70. This construction allows for a more compact engine as the swash plate assemblies need not be spaced apart far enough to avoid traveling past one another during all engine operating positions. Alternatively, the pivot axes 68 and 94 may be spaced far enough apart that these reciprocating portions of the swash plate engine need not travel past one another, although this is less desirable.

Thus, in the FIG. 1 construction, the counterbalancing swash plate assembly 70 passes within at least a portion of the driven swash plate assembly 60 during certain operating positions of the engine. In other constructions, as explained more fully below, the axes 68 and 94 may be aligned with one another.

Although the swash plate assemblies 60,70 may be mounted directly to the output shaft with or without a pivotal coupling to the output shaft, in the FIG. 1 construction, intermediate couplers are utilized to interconnect the swash plate assemblies and the output member 50. With reference to FIGS. 11–14, a first coupler comprises a collar mechanism 74 shown in FIGS. 11 and 12. The collar 74 comprises first and second outwardly projecting swash plate assembly supporting projections 330,332 which, in this example, are circular in cross-section. Projection 330 is coupled by bearing 232 (FIG. 3) to the first swash plate assembly 60 (FIG. 1). Projection 332 is coupled by bearing 230 (FIG. 3) to the first swash plate assembly. Thus, collar assembly 74 supports the first swash plate assembly for pivoting about the pivot axis 68 as shown in FIG. 11. One end portion of collar assembly 74 defines an annular surface 334 which supports the collar assembly 96 as can be seen in FIG. 1. A lower portion 338 of the collar 74 shown in FIG. 11 may be threaded to receive a keeper 340 (FIG. 1) which retains the collar assembly 96 in place. A stop, such as an enlarged shelf portion 342 of collar 74 cooperates with keeper 340 to retain the collar 96 at the appropriate location on collar 74. One or more splines 335 may be positioned on the surface 334 (FIG. 12) of the collar 74. These splines 335 extend axially in a direction parallel to axis 26. Desirably, one or more axially extending mating splines 337, projecting inwardly from the interior surface of collar 96, interfit with splines 335 so that collars 74,96 rotate together. Other mechanisms may be used to couple components 74,96 together. The upper end portion 350 of collar 74 in the FIG. 11 embodiment defines an interior chamber 352 (FIG. 12) for use in one embodiment of a mechanism described below for varying the stroke or displacement of the engine. A central shaft receiving passageway 354 (FIG. 12) is also provided within the interior of collar assembly 74. The chamber 352 and opening 354 are aligned with the axis 26 in this embodiment.

The collar 96 is best understood with respect to FIGS. 13 and 14. The illustrated collar 96 includes a central opening 360 having a longitudinal axis which is aligned with the axis 26. Opening 360 receives the surface 334 of the collar 74 with splines 335,337 in interfitting engagement. In addition, the collar 96, in the form shown, includes first and second projections 361,363 each having a respective internal passageway 362,364 extending therethrough and communicating with the passageway 360. The longitudinal axes of passageways 362,364 are aligned with the pivot axis 94. In addition, passageway 362 includes an outer section 366 of an enlarged diameter for receiving a tilt bearing or other bearing or bushing for pivotally coupling the collar to the swash plate assembly 70. In the same manner, passageway 364 includes an outer end portion with an enlarged passageway 368 for receiving a similar bearing or bushing. With reference to FIGS. 6 and 13, the pin 310 is received within passageway 366 with the bearing disposed between the pin and the wall of the passageway. Similarly, the pin 308 is received in the passageway 368 with the bearing disposed between the pin and wall of the passageway. As can be seen in FIG. 14, a recess 370 is provided in collar 96 to accommodate the inclination of the first swash plate assembly 60. The operation of recess 370 to provide clearance for swash plate assembly 60 is shown in FIG. 1.

Figure 16:
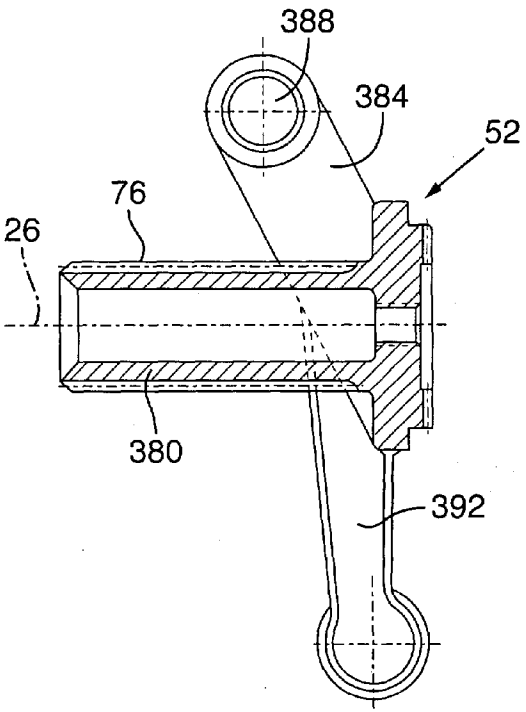
FIG. 16 is a vertical sectional view through the coupling member of FIG. 15, taken along lines 16—16 of FIG. 15.
Figure 15:
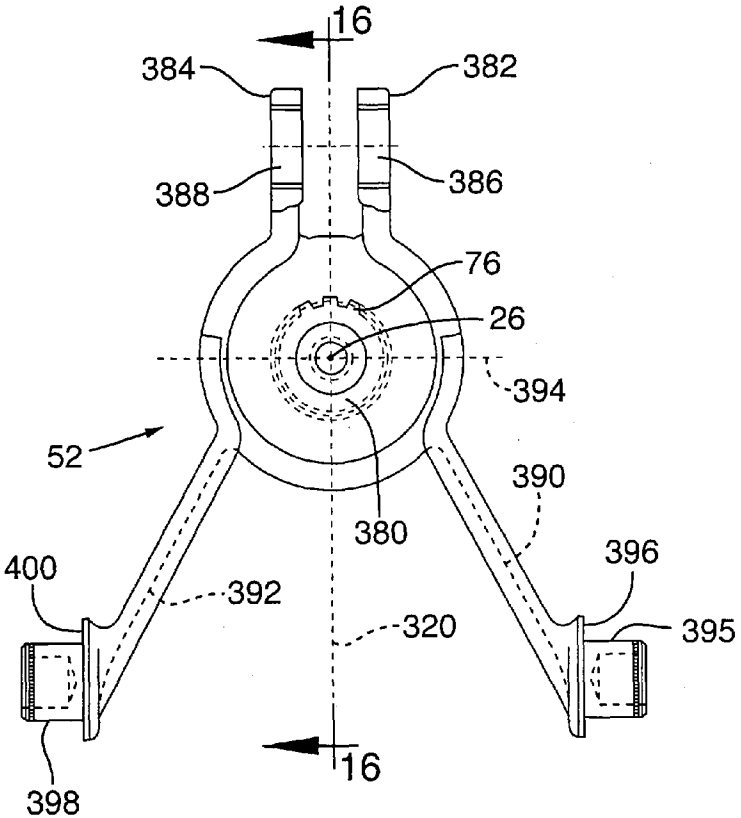
FIG. 15 is a first view, looking from the left to the right in FIG. 1, which is partially broken away, of a portion of a form of coupling member usable to interconnect the rotating members of the two swash plates of the FIG. 1 engine.

With reference to FIGS. 1, 15 and 16, and as previously mentioned, a mechanism is provided in the embodiment of FIG. 1 for interconnecting the rotating member 62 of the first swash plate assembly 60 to the rotating member 90 of the second swash plate assembly 70. A plurality of links or other coupling elements may be used for this coupling purpose. In one form specifically shown in FIGS. 15 and 16, the output section 52 comprises a portion of the coupling mechanism. Specifically, the illustrated output section 52 comprises a cylindrical or collar portion 380 projecting away from output section 50 in FIG. 1. The illustrated collar portion 380 comprises a right cylinder with a longitudinal axis which is coincident with the first axis 26. Elongated splines 76 project outwardly from the outer surface of collar portion 380. Splines 76 engage corresponding inwardly projecting splines of the collar 74 (FIG. 1) to permit axial sliding motion of the collar 74 relative to collar portion 380 while maintaining these components drivenly connected together. That is, collar 74 rotates with the rotation of collar portion 380 and the output section 52. The illustrated member 52 comprises first and second upwardly extending spaced apart legs 382,384, each with a respective opening 386,388 extending therethrough. The leg 384 is visible in FIG. 1. Section 52 also comprises first and second projecting leg portions 390,392 positioned at the opposite side of a plane 394 bisecting member 52 from the projections 382,384. Plane 394 also intersects the first axis 26, which extends into the page in FIG. 15. Leg 390 terminates in a projection 395 of circular cross-section having an axis which extends in a direction parallel to the plane 394. An enlarged shelf or stop 396 is positioned inwardly of the distal end of projection 395. Leg 392 terminates in an outwardly extending projection 398 which is also of circular cross-section and which has an axis which is parallel to the plane 394. The projection 398 extends in an opposite direction from projection 395. An enlarged stop or shelf 400 is positioned inwardly of the distal end of projection 398. The projection 398 is shown in FIG. 1. A link 402 (FIG. 1) pivotally couples the projections 382,384 to the projections 256,258 (FIG. 3) of the first swash plate assembly. Second links, one being indicated at 404 in FIG. 1, pivotally interconnect the respective projections 395,398 to the projections 312,314 (FIG. 6) of the second swash plate assembly. As a result, the rotating members of the two swash plate assemblies are interconnected to rotate together with the rotation of section 52 and the output member 50.

The illustrated construction has a desirable geometry. That is, whether one or more pistons are included in the engine, such as a plurality of pistons as shown in the FIG. 1 embodiment, a respective piston and piston rod is associated with each cylinder. Each piston repeatedly travels within its associated cylinder between a top dead center position and a bottom dead center position and back to the top dead center position during a piston stroke. During normal operation of an internal combustion engine, the piston exerts a force against a first portion of the wall of the associated cylinder during one portion of a piston stroke and against a second portion of the cylinder wall during another portion of a piston stroke. With the illustrated geometry, a swash plate engine is disclosed wherein each piston shifts from exerting a force against the first portion of the cylinder wall to the second portion of the cylinder wall when the piston is either in the top dead center or bottom dead center position. This improves the wear and reduces the noise of the engine and holds true in the illustrated construction in embodiments where the stroke of the engine is varied. It will be apparent to those of ordinary skill in the art that other geometries may be utilized which still achieve this desirable result. Although desirable, it is possible to construct an engine incorporating inventive features of this disclosure without this feature. As a desirable property of the engine of FIG. 1, the stroke of the engine may be varied, for example as the engine operates. In addition, as the stroke of the engine is varied, the extent of counterbalancing provided by the counterbalancing swash plate assembly may also be varied to provide improved counterbalancing benefits.

Referring again to FIG. 1, in this figure the respective swash plate assemblies 60 and 70 are shown in solid lines in the maximum displacement position or maximum stroke position of the engine. When in this position, the plane 86 defined by the first swash plate assembly is at an angle of inclination of $\alpha$ relative to the first axis. In addition, the plane 88 defined by the counterbalancing swash plate assembly 70 is at an angle $\beta$ relative to the first axis about which the output member rotates, in this case axis 26. In addition, $\alpha$ and $\beta$ are, in the construction shown in FIG. 1, opposite to one another. A mechanism is desirably provided for changing the angle $\alpha$ to thereby vary the stroke of the engine. Desirably, the angle $\beta$ is also changed in the opposite direction from the change in the angle $\alpha$. By shifting the location of the pivot axis 68 along axis 26 toward at least one of the piston cylinders, the angle $\alpha$ increases toward 90 degrees. At the same time, in the construction shown in FIG. 1, because of the manner of coupling the second swash plate assembly 70 via collar 96 to collar 74, the angel $\beta$ also shifts in the opposite direction toward 90 degrees. When the engine is in its minimum stroke or displacement position, the plane 88 is shifted to the dashed line position shown by the number 88' in FIG. 1 and the second swash plate assembly 70 is also shifted to the dashed line position shown by the number 70' in FIG. 1. In addition, the first swash plate assembly 60 has been shifted to the dashed line position shown by the number 60' in FIG. 1 with the plane 86 being shifted to the dashed line position indicated by the number 86' in FIG. 1. This shifting of the angle of inclination of the swash plate assembly 60 to vary the stroke of the engine can be accomplished in any suitable manner.

In the specific approach shown in FIG. 1, a fluid actuated cylinder mechanism is utilized for accomplishing this stroke variation. In the embodiment of FIG. 1, the section 350 of collar 74 is mounted to a shaft 410 having a longitudinal axis aligned with the axis 26. Shaft 410 has an enlarged head portion 412 slidable within the interior of a cylinder 414 which is rotatably coupled by bearings 416,418 to the engine housing. The cylinder 414 is also fastened, as by a bolt 420, to a drive pulley 422 useful in driving other components of a vehicle (e.g., air conditioning, alternator, etc.) or of another apparatus in which the engine is used. The exterior surface of section 350 is rotatably coupled to a wall section 424 (which may be a low friction surface) of a portion of the cylinder case portion 20 of the housing. Wall section 424 defines a pocket 426 within which collar section 350 may slide. Thus, section 350 may move axially in the direction of axis 26 while rotating relative to the housing. A piston 428 fixedly mounted to the housing is disposed within the interior of chamber 352. A cap 430 closes the end of the chamber 352. A first fluid supply passageway 432 communicates with the interior chamber 352 at one side of piston 428. A second fluid supply passageway 434 communicates with chamber 352 at the opposite side of piston 428. Pressurized fluid from a source (not shown) is delivered through one of the passageways 432,434 while being bled from the other of the passageways to shift the collar section 350 in a first direction. Fluid is delivered to the opposite passageway while bled from the other passageway to shift the section 350 in the opposite direction. For example, by delivering fluid under pressure through line 432 to the chamber 352 at the left side of piston 428 in FIG. 1, while bleeding fluid through line 434, the section 350 is shifted to the left with its maximum leftward shifted position being indicated by the dashed line 350' in FIG. 1. The dashed line 412' in FIG. 1 indicates the leftwardmost position of enlarged head 412 of shaft 410. As section 350 is shifted to the left in FIG. 1, the angle $\alpha$ increases towards 90 degrees and the angle $\beta$ also increases towards 90 degrees, eventually reaching the dashed positions 60' and 70' shown in FIG. 1. The position of the swash plate assemblies 60,70 may be varied to any location intermediate the maximum and minimum displacement positions illustrated in FIG. 1. As explained below, the angle of the swash plate assembly may be varied in response to at least one vehicle parameter such as a vehicle throttle pedal position.

As another example, each engine cylinder has a bore. In the construction shown in FIG. 1, the ratio of the piston stroke to the bore may be less than one under certain engine operating conditions and greater than one under other engine operating conditions. For example, under high torque and/or high horsepower engine demand conditions, the ratio may be greater than one. As another example, the ratio may be greater than one under conditions where it is desirable to use the engine in braking the vehicle, such as when traveling downhill. As another example, the ratio may be greater than one at first vehicle speeds and less than one at other vehicle speeds. For example, at highway cruising speed on level roadways, the ratio may be less than one (e.g., at 55 miles per hour). Fuel throttle position is another vehicle parameter which may be sensed and used in controlling the ratio of piston stroke to bore. Less fuel is needed to power the engine at lower piston stroke to bore ratios and the engine fuel consumption is more efficient. Combinations of one or more of these and other vehicle parameters may be used in controlling the engine displacement.

As a more specific example, at low horsepower conditions where the engine is not being used in braking the vehicle, the stroke to bore ratio may be from 0.3 to 0.8 although the engine is not limited to this example. As another specific example, and without limiting the generality of the engine, the bore of a typical cylinder may be 80 mm. At engine idle condition, the engine may be adjusted to provide a 30 mm stroke. At highway speeds, the engine may be adjusted to provide a 60 mm stroke. At full load (high torque conditions), the engine may be adjusted to provide a stroke of 100 mm.

Each cylinder included in the engine comprises a cylinder head portion, such as indicated at 440 for cylinder 42 and a cylinder wall portion. The piston also comprises a piston head surface 442 (for piston 40 in FIG. 1) which is adjacent to the cylinder head portion of the associated cylinder within which the piston travels. The piston repeatedly travels during a piston stroke between a top dead center position in which the piston head surface is closest to the cylinder head portion and a bottom dead center position in which the piston head surface is furthest from the cylinder head portion. The term "combustion chamber" is defined as the volume of the cylinder between the cylinder head portion and the piston head surface when the piston head surface is in the top dead center position. A piston stroke length adjuster, which may be in the form described above, is coupled to at least the first swash plate assembly (e.g., 60) and is operable to vary the angle of the first swash plate assembly relative to the first axis 26 to vary the stroke of the piston. As previously mentioned, desirably the angle of the second swash plate assembly (e.g., 70), the counterbalancing swash plate assembly in some constructions, is also simultaneously varied. In the construction shown in FIG. 1, the piston 40 is coupled to the first swash plate assembly 60 such that the combustion chamber volume associated with piston 40 increases as the length of the piston stroke increases and decreases as the length of the piston stroke decreases. This is true for the other cylinders in the plural cylinder engine of FIG. 1. That is, the volume of the combustion chamber associated with each piston increases as the length of the piston stroke increases and decreases as the length of the piston stroke decreases. In addition, in the FIG. 1 construction, the term "combustion ratio" is defined as the ratio $(V_c+V_H)/V_c$. In this formula, $V_c$ is the volume of the combustion chamber. In addition, $V_H$ is the volume of the portion of the cylinder through which the piston travels between the top dead center position and bottom dead center position (the volume swept by the piston during a stroke). In the construction shown in FIG. 1, the combustion ratio is substantially constant as the stroke of the piston is varied by varying the angular operating position of the swash plate assembly 60. For example, the combustion ratio may be maintained substantially at 1 to (9–12) (desirably 1 to 10) for a gasoline engine and from 1 to (14–17) (desirably 1 to 16) for a diesel engine. Other engine geometries may be used to achieve this characteristic if desired in the particular engine construction. Alternatively, the engine may be designed such that the combustion ratio may be variable, such as being maintained substantially constant for a range of swash plate angles and gradually varied for other ranges of swash plate angles. As a specific example, the combustion ratio may be gradually increased at small swash plate angles for low engine load conditions (e.g., engine idle).

With further reference to FIG. 1, at least one combustion air intake port is provided in communication with each cylinder and at least one exhaust gas port is provided in communication with each cylinder. An air intake port 450 is shown for cylinder 42 in FIG. 1 and an air exhaust gas port 452 is shown in FIG. 1 for cylinder 38. An air intake valve 454 is shown to selectively open and close air intake port 450. Although not visible in FIG. 1, there may be two air inlet ports and two air inlet valves for each cylinder. An exhaust valve 456 is shown for selectively opening and closing the exhaust port for cylinder 42. An exhaust valve 458 is shown in position to selectively open and close the exhaust port 452 for cylinder 38. An air intake valve 460 is shown for selectively opening and closing an air intake port for the valve cylinder 38. Under the control of a valve actuator, each air intake valve is operable to open to permit the ingress of combustion air into the associated cylinder and close during (a) combustion of an air-fuel mixture within the associated cylinder in the case of a gasoline engine; and (b) compression of air to cause combustion of injected fuel in the case of a diesel engine. In addition, each exhaust valve is opened to permit the exhaust of combustion gases from the associated cylinder and through the associated exhaust gas port following combustion of the air-fuel mixture within the associated cylinder.

Although not required, desirably the exhaust gas ports are shorter than the air intake ports. Consequently, the hot exhaust gases have less of an opportunity to transfer heat to the engine, thereby reducing the engine cooling requirements. In addition, in the embodiment of FIG. 1, the air intake ports and the exhaust gas ports exit from the cylinder head portion 18 in directions extending generally radially outwardly from the axis 26. In addition, the exhaust gas port for each cylinder communicates with the cylinder at a location which is positioned radially outwardly from the axis 26 relative to the location where the air intake port communicates with the cylinder.

A valve actuator is positioned within the valve cover portion of the housing and operable to selectively open and close the air intake valves and the exhaust valves. Valve actuation is well known in the art and thus a commercially available valve actuator mechanism may be used. However, a desirable embodiment is illustrated in connection with FIG. 1. Since the mechanisms are the same, the same numbers will be used for the actuating mechanism shown in connection with cylinder 38 and cylinder 42. The air intake and air exhaust valves are biased to a closed position. A rocker arm 470 is pivoted to a support coupled to the housing for pivoting about a pivot axis 472. A first end portion 474 of the rocker arm is coupled to the exhaust valve 458. A second end portion 476 of the rocker arm is positioned for engagement by a cam when the air intake valve(s) of the associated cylinder in FIG. 1 are to be opened. In FIG. 1, in association with cylinder 38, a first projection 477 (hidden by end portion 476) extends from end portion 476 to a position where it engages the upper end of valve 460. A second projection, like projection 479 visible in FIG. 1 for cylinder 42, extends from end portion 476 into engagement with the other air intake valve 454 (shown for cylinder 42 but not shown for cylinder 38 in FIG. 1) associated with cylinder 38. As the rocker arm end portion 476 is engaged by a cam, the projections 477,479 are pivoted and open the air intake valves. A cam body 478 is supported for rotation about the perimeter of cylinder 414 and also about the axis 26. Cam body 478 comprises respective cams positioned on the cam body, such as explained below, for operating the respective rocker arms to open and close the air intake and exhaust valves at desired times. A first cam follower 480, comprising, in this example, a tapered roller rotatably coupled to a projecting end portion 476 is positioned to follow a track along one major surface of cam body 478. As cam follower 480 engages a projecting cam, the end portion 476 is urged to the right in FIG. 1 to open the air intake valves. Roller or cam follower 480 returns to the position shown in FIG. 1 after the cam passes. A cam follower comprising a roller 482 pivotally coupled to an inwardly projecting portion of rocker arm 470 bears against the outer perimeter of the cam body 478. As a cam along the outer perimeter of the cam body engages the roller 482, the rocker arm is urged in a direction which pivots the end portion 474 to the right in FIG. 1, resulting in opening of the exhaust valve. The rocker arm returns to the position shown in FIG. 1 following the passage of the cam. A suitable location of the cams on the cam body will become more apparent from the description below.

The cam body in FIG. 1 for a five cylinder engine may be driven in the following manner in a specific example. A first gear 490 is coupled to member 414 such that gear 490 is driven in the same direction as the output shaft section 54 about the axis 26. In the FIG. 1 construction, an idler gear 492 is pivoted by a pin 494 to the housing section 16. Idler gear 492 is coupled to gear 490 such that it is driven by gear 490. Gear 492 engages a ring gear 496 and drives the ring gear in rotation. A coupling plate 498 carried by ring gear 496 extends radially inwardly from the ring gear and overlays a major surface of the cam body 478. The coupling plate 498is mounted to the cam body 478 such that rotation of the ring gear drives the cam body in rotation. In a specific example, the gears are selected such that the cam body is rotated at a rate which is one-fourth of the rate of rotation of the engine output section 50. In addition, for this five cylinder engine, the cam body is rotated in a direction which is opposite to the direction of rotation of the output section 50. Also, as explained below, the illustrated cam body comprises a first set of two cams spaced 180 degrees apart from one another on the cam body in position to selectively open and close the air intake valves and a second set of two cams spaced 180 degrees apart on the cam body and positioned to selectively open and close the exhaust valves. In embodiments where it is desired to drive the cam body in a direction which is the same direction as the direction of rotation of output section 50, the gear 490 may be enlarged to engage the ring gear 496 (and/or the ring gear may corresponding be reduced in dimension) or, alternatively, an additional intermediate idler gear, such as gear 492, may be positioned between gear 490 and the ring gear 496. The gear sizes and gear design may be selected to achieve the desired rotating rate of the cam body relative to the engine output rotation and to achieve the desired direction of cam body rotation in relation to the engine output rotation.

Other configurations of cams and cam bodies as well as mechanisms for rotating the cam body may also be used.

Figure 19:
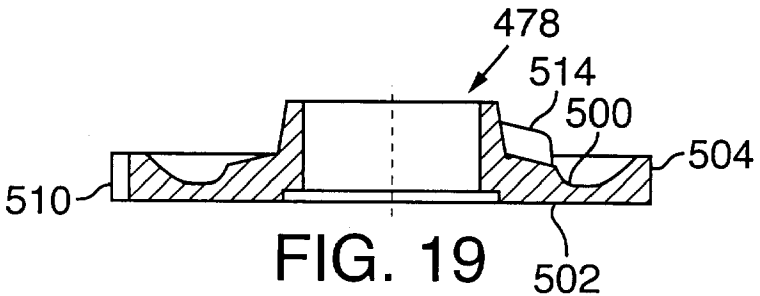
FIG. 19 is a sectional view of a portion of the cam body of FIG. 17, taken along lines 19—19 of FIG. 17.
Figure 18:
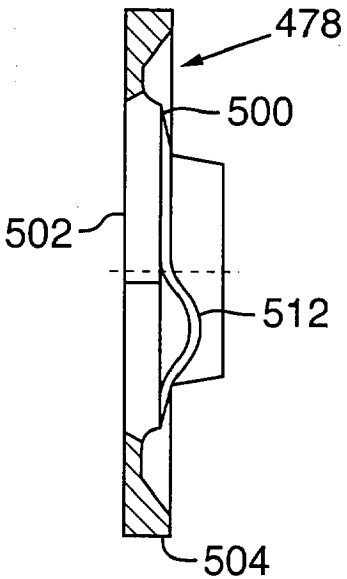
FIG. 18 is a sectional view through a portion of the cam body of FIG. 17, taken along lines 18—18 of FIG. 17.
Figure 17:
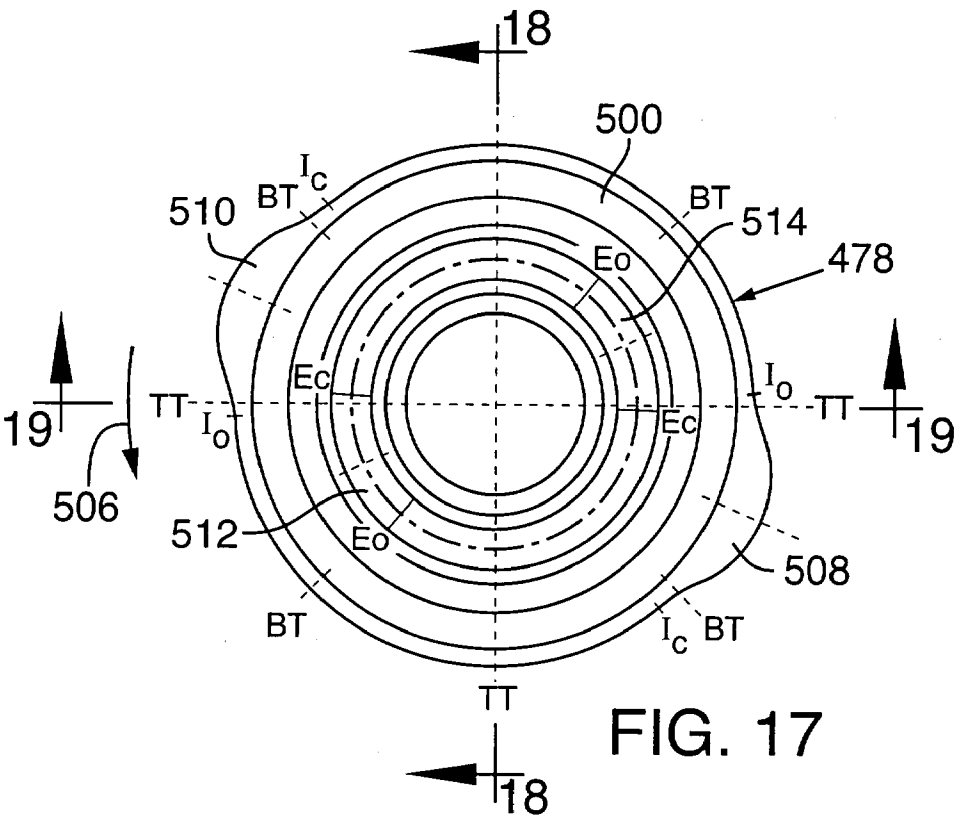
FIG. 17 is a side view, looking from the right to the left in FIG. 1, of one form of cam body with cams for operating the air intake and exhaust valves of the engine of FIG. 1.

An exemplary cam body for a five cylinder engine is illustrated in FIGS. 17–19. The illustrated cam body comprises first and second generally opposed major surfaces 500,502 and an outer periphery 504. The direction of rotation of cam body 478 is indicated by arrow 506 in FIG. 17. First and second diametrically opposed exhaust valve operating cams 508,510 are shown projecting outwardly from the periphery of the cam body. In addition, air intake valve actuating cams 512,514 are shown projecting outwardly from the major surface 500 of the cam body. In the cam body of FIG. 17, $I_0$ is 10 degrees before TT; $I_c$ is 20 degrees after BT, $E_0$ is 20 degrees before BT; and $E_c$ is 10 degrees after TT.

Desirably, the number of cylinders included in the engine, the firing order for each such number of cylinders and the swash plate rotation angle through which the first member rotates between firing one cylinder and the next cylinder to fire of the engine are in accordance with the following table:

| Number of Cylinders | Firing Order | Swash Plate Rotation Angle |
|---|---|---|
| 1 | 1 | 720° |
| 2 | 1, 2, 1 | 360° |
| 3 | 1, 3, 2, 1 | 240° |
| 5 | 1, 3, 5, 2, 4, 1 | 144° |
| 7 | 1, 3, 5, 7, 2, 4, 6, 1 | 102.857° |
| 9 | 1, 3, 5, 7, 9, 2, 4, 6, 8, 1 | 80° |
| 11 | 1, 3, 5, 7, 9, 11, 2, 4, 6, 8, 10, 1 | 65.454° |

and wherein the first member rotates 720° during a complete firing cycle.

Other configurations, although less desirable, may also be used. In the above table, an equal firing gap is assumed.

In the embodiment of FIG. 17, the cam body comprises a cam disk. In addition, the cam body comprises first and second major surfaces 500,502 as previously described. The surface 500 in the FIG. 1 embodiment is positioned adjacent to the cylinders while the surface 502 is positioned furthest from the cylinders. The cam body in the FIG. 1 embodiment thus comprises at least one projection extending from the first surface 500 and away from the second surface. The cam body 478 may take any suitable form. FIGS. 45–47 show examples of alternative cam body constructions. FIG. 45 illustrates a cam body with a cam 510' projecting outwardly from the periphery of the cam body. FIG. 46 shows a cam 510' projecting outwardly from the periphery of the cam body; a cam 510" projecting from major surface 500 of the body (thus cams 510' and 510" are similar to cams shown in FIG. 17). Alternatively, the cam body of FIG. 46 may have a cam 510''' projecting from surface 502 and away from the surface 500. In the FIG. 47 construction, the cam body comprises a cam supporting projection 520 spaced from the axis 26 about which the cam body rotates. The illustrated projection 520 is annular and extends from the major surface 500 and away from major surface 502. At least one cam, such as cam 522, projects radially inwardly from the cam supporting projection 520 and toward the axis 26. FIGS. 45–47 are provided to illustrate examples of the wide variety of cams and cam body designs which may used in a swash plate engine. The invention is not limited to any particular valve actuator mechanism.

As specific desirable examples for a swash plate engine having a specified number of cylinders (a five cylinder engine example is not described below since an example of such an engine is set forth above), the following constructions may be employed. In these constructions, where plural cylinders are utilized, the cylinders are desirably spaced equally about the axis of the engine. The number of posts 190 (e.g., such as shown in FIG. 1) or other connections provided for coupling piston rods to the swash plate assemblies match the number of cylinders and are positioned at symmetric locations about the driven swash plate assembly.

For a one cylinder engine, the cam body may be rotated at one-half of the speed of the output member (e.g., shaft section 50). The cam body may be rotated in either direction (the same or opposite) relative to the direction of rotation of the output member. In addition, a first cam is provided on the cam body in a position to selectively open and close the air intake valve and a second cam is provided on the cam body in a position to selectively open and close the exhaust valve.

For an engine consisting of two cylinders and two associated pistons, the cam body may be rotated at one-half the speed of the output member and in either direction relative to the direction of rotation of the output member. A first cam is provided on the cam body in a position to selectively open and close the intake valves and a second cam is provided on the cam body in a position to selectively open and close the exhaust valves.

For an engine consisting of three cylinders and three associated pistons, the cam body may be rotated at one-half the speed of the output member, the cam body being rotated in a direction which is opposite to the direction of rotation of the output member. The cam body includes a first cam in a position to selectively open and close intake valves and a second cam in position to selectively open and close exhaust valves.

For an engine consisting of seven cylinders and seven associated pistons, the cam body may be rotated at a rate which is one-fourth of the speed of rotation of the output member, the cam body being rotated in a direction which is the same as the direction of rotation of the output member, the cam body including a first set of four cams spaced 90 degrees apart from one another on the cam body in position to selectively open and close the air intake valves and a second set of four cams spaced 90 degrees apart on the cam body and positioned to selectively open and close the exhaust valves.

Referring again to FIG. 1, the illustrated engine in this figure has a longitudinal axis which is oriented horizontally. Although this orientation is not required, when employed the housing may comprise an oil pan 530 for collecting lubricating oil that flows downwardly through the engine. An oil pump 532 may be provided to take oil from the oil pan 530 and distribute it to various components of the engine within the at least the swash plate case portion, the cylinder head portion and the cylinder case portion of the housing.

Figure 20:
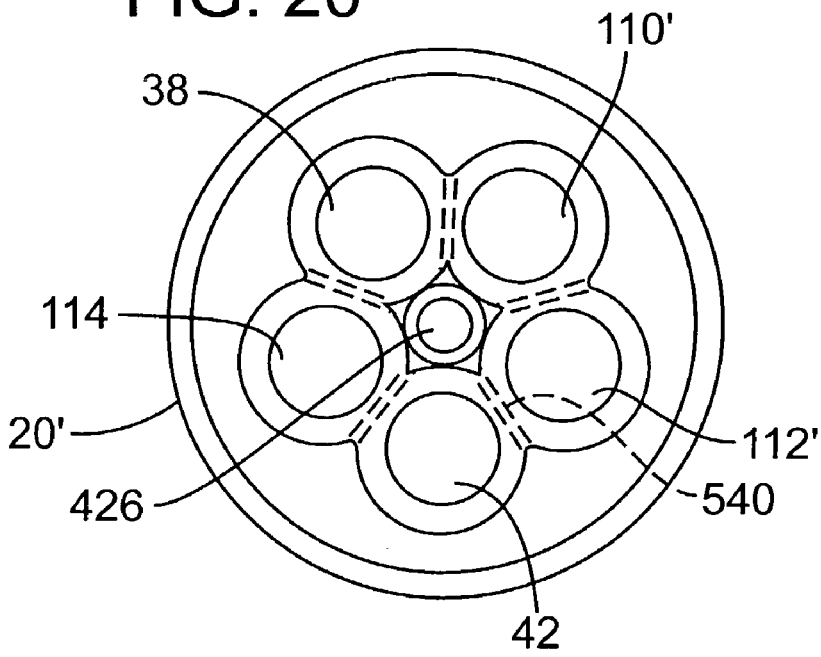
FIG. 20 is a view of a form of cylinder case portion of a housing in which the cylinders are formed together as a unit, as by casting, and illustrating optional coolant fluid flow passageways (in dashed lines) extending between the respective cylinders.

In the cylinder case portion construction of FIG. 2, all of the cylinders are interconnected and desirably at least one coolant fluid flow passageway is provided between each of the adjacent cylinders of the engine. In the embodiment of FIG. 20, the illustrated cylinders are also coupled together. However, in the FIG. 20 embodiment, the cylinders, as well as the central chamber defining portion 426, if included, are of a monolithic one-piece construction which may be machined but more desirably is formed by casting all of the cylinders together as a unit. A coolant fluid flow passageway is desirably provided between each of the adjacent cylinders of the engine. Coolant fluid flow passageways are shown by dashed lines in FIG. 20 with one of them being numbered at 540. As a specific example, when formed by casting, the gap between the cylinders provided by the coolant fluid flow passageway may be about 6 mm in width, although this is variable. If the fluid flow passageways are formed by machining instead of during casting, typically a closer tolerance is more easily provided, such as a gap of 1–2 mm in width. This can result in an engine of a reduced overall dimension.

Figure 21:
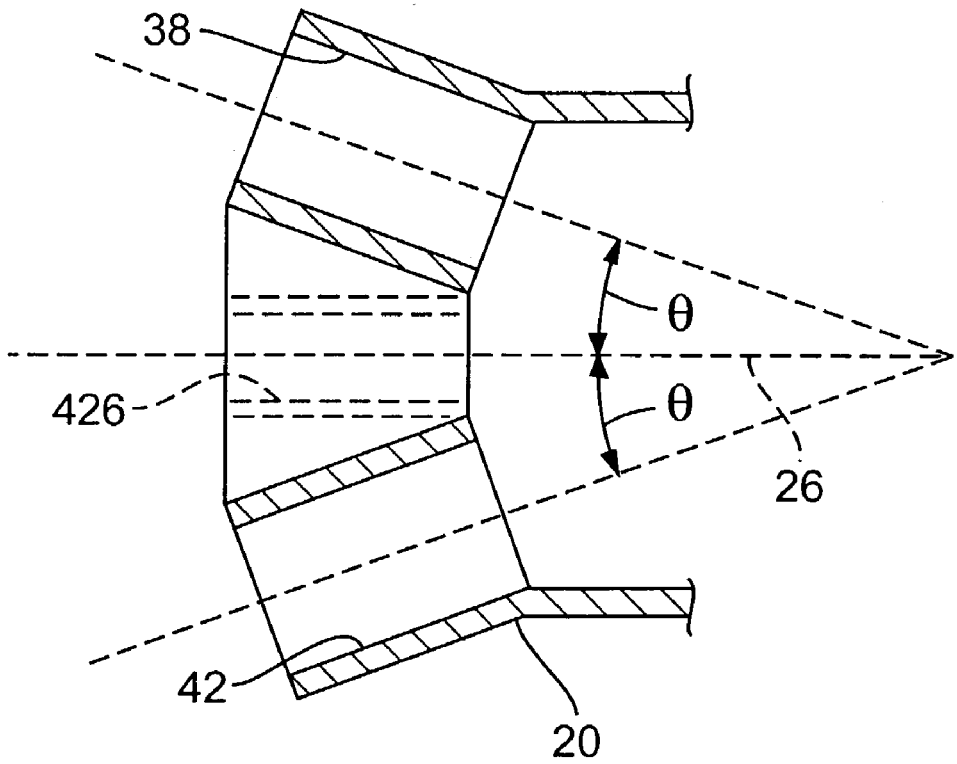
FIG. 21 is a sectional view through an alternative form of cylinder case portion in which the cylinders have longitudinal axes which are at an acute angle relative to an axis of the engine.

In the embodiment of FIG. 1, the longitudinal cylinder axis of each of the respective cylinders is parallel to one another and desirably positioned at a common radius from the first axis. However, different cylinders may be located at different radii from the first axis. In the embodiment of FIG. 21, a cylinder case portion 20 is provided with cylinders having respective longitudinal axes which are skewed with respect to one another. For example, the longitudinal axes of the respective cylinders may be at an acute angle, for example, of no greater than 30 degrees, relative to the first axis 26. In FIG. 21, the axis of cylinder 38 and the axis of cylinder 42 are at an angle of θ from the axis 26.

Desirably, the chamber 426 is positioned at least partially between the cylinders and most desirably the chamber 426 is positioned entirely between these cylinders. This is shown in both the FIG. 1 and FIG. 20 constructions. Although not required, this design results in a more compact engine construction.

Figure 22:
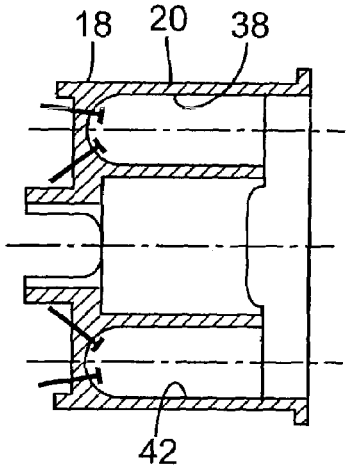
FIG. 22 is a sectional view through a portion of an embodiment in which a cylinder head portion and a cylinder case portion of an engine housing are formed together, as by casting, as a single piece monolithic element and which also schematically illustrates the positioning of respective air intake and exhaust gas valves.

FIG. 22 illustrates an engine housing construction which may be utilized in the FIG. 1 embodiment wherein the cylinder head portion 18 and cylinder case portion 20 of the engine are of a single monolithic one-piece construction, for example formed by casting. In FIG. 22, intake and exhaust valves for the respective cylinders 38 and 42 are shown in schematic form.

Figure 23:
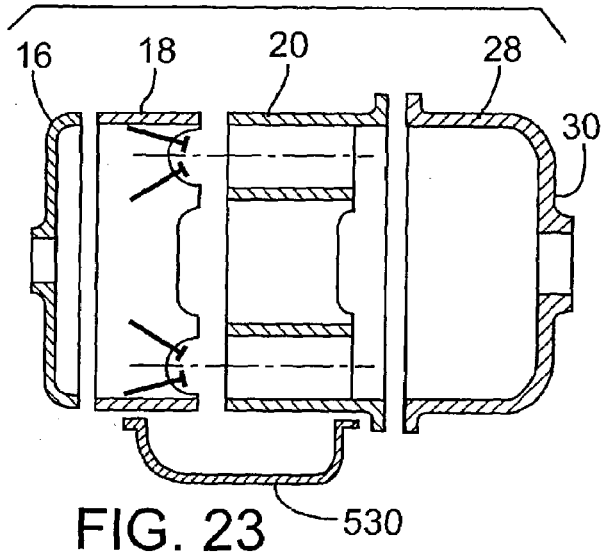
FIG. 23 is a vertical sectional view through an engine housing having a valve cover portion, a cylinder head portion, a cylinder case portion, a swash plate case portion and an output member support portion, and also illustrating the positioning of an oil pan relative to the housing.

FIG. 23 schematically illustrates an engine housing with housing components which are similar to those of FIG. 1. In the FIG. 23 construction, various components may be formed as single piece monolithic elements, such as by casting. In FIG. 23, the swash plate case portion 28 and output member support portion 30 are of a one-piece monolithic construction. As an alternative, in FIG. 23, the swash plate case portion 28 and cylinder case portion 20 may be formed as a monolithic one-piece construction. In this case, the output member supporting portion 30 would typically be formed as a separate piece.

FIGS. 24, 25 and 26 illustrate exemplary bearing arrangements for interconnecting rotatable swash plate members to reciprocating swash plate members. Although these designs can be used in connection with swash plate assembly 70, they are shown with respect to swash plate assembly 60 for convenience. In FIG. 24, ball bearings are used to rotatably couple rotary member 62 to reciprocating member 64 of the swash plate assembly 60. These ball bearings are indicated schematically at 550. In FIG. 25, needle or barrel bearings 552 are shown for this purpose. An alternative needle or barrel bearing construction is shown in FIG. 26 with the bearings indicated by the number 554. The bearing arrangement may also be friction surfaces which slide in contact with one another.

In FIG. 27, a roller bearing construction is utilized to interconnect the piston rod 80 to the post 190 of reciprocating member 64 of the swash plate assembly 60. Lines 558 and 560 illustrate exemplary angles through which the plane 562 defined by the swash plate assembly may be pivoted. The collar 74 shifts axially in the FIG. 27 embodiment in the directions indicated by respective arrows 563,565, as the swash plate angle is varied.

In FIGS. 28 and 28 A, a universal shaft coupling employing a universal bearing 564 is utilized to couple the piston rod 80 to the support post 190 of reciprocating member 64 of the swash plate assembly 60.

FIGS. 30 and 31 illustrates a swash plate assembly 60 usable, for example, in embodiments where three piston rods are to be coupled to the first swash plate assembly. In this case, three of the coupling posts 190 are provided and project outwardly from the reciprocating member 64 of the swash plate assembly. In this example, the rotating member 62 of the swash plate assembly is of a single piece construction. In addition, the reciprocating member 64 is formed of plural ring sections 570,572. These ring sections, which may be more than two such sections if desired, may be interconnected by fasteners, such as bolts 574. Like the FIG. 1 embodiment, the members 62 and 64 define respective annular rotating surfaces against with which bearings 66 may ride. FIG. 31 should be compared with FIG. 4 as this will assist in clarifying the understanding of the FIG. 31 embodiment.

The embodiment of FIG. 32 illustrates a mechanism which may be incorporated into any of the swash plate assemblies heretofore described for delivering lubricating fluid to the bearings, including friction bearings, of the swash plate assembly. In the FIG. 32 embodiment, a source of pressurized lubricating fluid is coupled via a line 576 (shown schematically in FIG. 32) to respective passageways 578 and 580. The passageway 578 communicates with a respective tilt or other bearing which pivotally couples the swash plate assembly to the output member. The passageway 580 communicates with the bearings which couple the reciprocating member of the swash plate assembly to the rotary member of the swash plate assembly. Thus, passageway 580 communicates with the bearings 66 and passageway 578 is coupled to, for example, tilt bearings (e.g., bearings 234,236 as shown in FIG. 3).

FIG. 34 illustrates an embodiment wherein the rotating member 62 of the swash plate assembly 60 is positioned generally outwardly of the reciprocating member 64 of the swash plate assembly. In the embodiment of FIG. 34, the annular rotating surface defined by member 62 is generally inwardly facing while the annular surface of member 64 is generally outwardly facing. Bearings (not shown in FIG. 34) are typically positioned between members 64 and 62, such as shown in the FIG. 1 embodiment. Schematic coupling of piston rods 80,82 to respective post elements 190 of reciprocating member 64 are also shown in this figure.

In the embodiment of FIG. 35, which is like that of the embodiment of FIG. 34, the rotating member 62 is formed of plural sections which are typically each annular in cross-section. Section 62*a* is shown in face-to-face orientation with section 62*b* with these sections then being interconnected, such as by fasteners 586, to hold sections 62*a* and 62*b* together. In FIG. 36, the sections 62*a* and 62*b* have been replaced by ring sections 62*a*' and 62*b*' which are each semi-circular in configuration and which are held together by fasteners, such as bolts 588.

In the embodiment of FIG. 37, a universal bearing 594 pivotally connects a coupler 595 to the post 190 (a cap or other retainer being omitted from FIG. 37). Coupler 595 includes a projection 596 which is pivoted by a pivot pin 592 to the piston rod 80. This provides an alternative form of off-center coupling of the piston rod to the swash plate assembly.

An alternative mechanism for varying the angle a of swash plate assembly 60 is illustrated in FIG. 38. In the embodiment of FIG. 38, the output shaft 50' includes an outwardly extending projection 600. In addition, rotary member 62 comprises a projecting portion 602 which may be similar to projections 252,254 of FIG. 3. A link 604 interconnects projection 600 with projection 602. The link 604 is pivotally coupled to each of these projections. Shaft portion 50' is slidably coupled to support 74' with these elements being drivenly interconnected, such as by splines. A counterbalancing swash plate assembly may also be mounted to member 74'. A hydraulic or mechanical mechanism may be used to axially shift member 74' relative to output shaft member 50'. As axial shifting of member 74' occurs, such as in the respective directions represented by double-headed arrow 606, the angle $\alpha$ is adjusted to thereby vary the stroke of the engine. For example, the plane of swash plate assembly 60 may be shifted from location 86 to location 86' in this figure. In this case, pivot axis 68 is shifted to the location 68'. In the position shown by location 86, the engine is in a minimum or zero displacement position. In the position shown by location 86', the engine in this example is shown shifted to a maximum displacement position. Thus, FIG. 38 provides yet another example of a mechanism which may be used to vary the angle of the swash plate assembly to thereby vary the stroke of the engine. Swash plate assembly 60 is coupled to structure 74' by a bearing, such as tilt bearing 230', to permit this pivoting motion.

FIG. 39 is similar to FIG. 38 except that FIG. 39 schematically illustrates an embodiment having particularly desirable relationships between the various components. Again, a counterbalancing swash plate assembly may be included in the FIG. 39 construction. As is the case of the FIG. 38 construction, the position of swash plate assembly 60 shown in solid lines in FIG. 39 corresponds to a zero displacement position. When the angle of the swash plate assembly has been shifted to angle $\alpha$ to position the plane at location 86', the swash plate assembly is in its maximum displacement position. Increasing the swash plate angle increases the stroke. In a desirable construction, a swash plate engine maintains a substantially constant combustion ratio at minimum and maximum displacement. In a desirable geometry, the radius R1 is less than the radius R2. That is, R1 corresponds to the radius from axis 26 to the location where the piston rod 80 is pivotally coupled to the swash plate member 64. In addition, R2 is the radius from the axis 26 to the pivot axis location where the link 604 is pivoted to the extension 602. In addition, R3 is desirably less than R2. R3 is the radius from the axis 26 to the pivot axis location where link 604 is pivoted to projection 600. These dimension and geometries, as well as the dimensions of the combustion chamber, may be varied in different engines to accomplish a substantially equal combustion ratio for all engine displacements. Thus, a more or less equal combustion ratio is desirable in some cases for all engine displacements (swash plate angles). Alternatively, the engine may have a combustion ratio which may be variable in some engine embodiments, such as to improve fuel efficiency or to reduce undesirable emissions, under certain engine loads.

FIG. 40 illustrates an alternative mechanism for varying the engine stroke. In the embodiment of FIG. 40, the swash plate assemblies 60,70 are pivoted to a collar 610 which is slidably mounted to an output shaft section 50' such that collar 610 is movable in the respective directions indicated by double arrow 612. The swash plate assemblies may also be coupled together, that is the rotating members of each swash plate assembly may be interconnected so that such members rotate together (although this is not shown in FIG. 40). Shaft section 50' rotates about the axis 26 as indicated by arrows 613. The collar 610 is coupled to a pin 614 which extends through shaft section 50'. Therefore, the collar 610 is also rotationally linked to the output shaft section 50'. An elongated slot 616 is provided in the shaft section to allow the collar 610 and pin 614 to move in the respective directions of arrow 612. Movement of the collar adjusts the angles of the swash plate assemblies 60 and 70 to thereby vary the stroke of the engine as previously described. The pin 614 is connected to a shaft extension 618 positioned within the interior of output shaft section 50'. Shaft extension 618 has an enlarged head portion 620 which is rotatably coupled by bearings 622 to a second shaft section 624. Thus, shaft extension 618 is supported for a rotation with the output shaft member 50'. The shaft section 624 is axially shiftable in directions indicated by arrows 626. Shifting of shaft section 624 in either direction indicated by arrow 626 causes a corresponding movement of shaft extension 618 and of the collar 610 to vary the engine displacement. In the embodiment of FIG. 40, a mechanical mechanism is utilized to shift shaft section 624. In this embodiment, a rack gear or other gear 628 is coupled to the exterior of shaft section 624. Gear 628 is engaged by a gear 630 which is rotated in respective first and second directions to shift the shaft section 624 in the respective directions indicated by arrows 626. Gear 630 may be driven in any convenient manner such as by an electric motor or a hydraulic motor. Gear 630 in combination with gear 628 rotates shaft section 624 respectively in either direction indicated by double-headed arrow 615. A feedback loop may be included to provide an indication of the gear position. The housing, such as a portion of the cylinder case section of the housing indicated at 640, is coupled to shaft section 624 to support the shaft section while permitting the movement of the shaft section in the respective directions of arrows 626. In the embodiment shown in FIG. 40, an endless ball bearing track 642 is defined by the interior surface of housing section 640 and the exterior surface of shaft section 626. As shaft section 624 is moved either of the directions of arrows 626, the shaft section rotates as permitted by the ball bearing track 642. As a result, the collar 610 is respectively slid in one of the directions indicated by double-headed arrow 612 corresponding to the direction of movement of shaft section 624 to thereby adjust the displacement of the engine. In the embodiment of FIG. 41, the respective swash plate assemblies may be interconnected and supported, for example, in the same manner as described above in connection with FIG. 1. However, in the FIG. 41 embodiment, the locations of pivots 68,94 are far enough apart that the respective swash plate assemblies, that is the reciprocating members of the respective swash plate assemblies, may swing without either of the swash plate assemblies needing to pass through a portion the other of the swash plate assemblies. Again, desirably, the reciprocating portions of the swash plate assemblies are designed to swing opposite to one another for mass balancing purposes. In addition, the reciprocating member of the counterbalancing swash plate assembly, swash plate assembly 70 in FIG. 41, as well as in the other embodiments, may be entirely or at least partially comprised of a material of a greater density or weight than the reciprocating member of swash plate assembly 60. As a result, the counterbalancing swash plate assembly may be of a reduced dimension while still providing the desired counterbalancing function. For example, the reciprocating member of swash plate assembly 60 may be comprised primarily of steel while the reciprocating member of swash plate assembly 70 may be comprised of steel with inserts such as lead balancing inserts 659, which may, for example, be annular or of any other suitable configuration.

In the embodiment of FIG. 42, during one operating position of the engine, the driven swash plate assembly 60 and counterbalancing swash plate assembly 70 are aligned in a common plane indicated by the number 660 (a minimum engine displacement position). The angles of the respective swash plate assemblies may be varied, as indicated by dashed lines 662 for swash plate assembly 60 and 664 for swash plate assembly 70, to increase the swash plate angles and correspondingly increase the engine displacement. In FIG. 42, at an increased engine displacement position, the pivots 68 and 94 have been shifted to respective locations 68' and 94'.

In the embodiment of FIG. 43, the counterbalancing swash plate assembly 70 is shown positioned within a driven swash plate assembly 60. The rotary members of the swash plate assemblies are desirably interconnected, such as described above in connection with FIG. 1. In the embodiment of FIG. 43, the annular rotating surface defined by the rotary member of swash plate assembly 60 is inwardly facing while the annular surface of the reciprocating member of swash plate assembly 60 is outwardly facing.

FIG. 44 illustrates a swash plate engine having first and second swash plate assemblies 60,70 arranged for counterbalancing purposes. In the embodiment of FIG. 44, each of the swash plate assemblies are pivotally mounted to a common shaft section 670 which is slidably and drivenly coupled to an output shaft section 50' for rotation with the output shaft section. A first link 672 couples the rotating member of swash plate assembly 60 to a projection 674 from the shaft section 50'. In addition, a second link 676 couples the rotating member 90 of swash plate assembly 70 to a projection 678 of shaft section 50'. Projections 674 and 678 extend in opposite directions from the opposite sides of shaft section 50'. That is, the link 672 and the link 676 are coupled to the shaft section 50' at positions located at 180 degrees apart from one another on opposite sides of the shaft section 50'. In the embodiment of FIG. 44, shifting of shaft section 670 axially in the respective directions indicated by double-headed arrow 680 varies the angles of the respective swash plate assemblies 60,70 to vary the engine displacement. Thus, in the example of FIG. 44, the rotary members of the swash plate assemblies are indirectly interconnected through the output shaft section 50' and their respective links 672 and 676.

An exemplary control mechanism for a swash plate engine of FIG. 1 is illustrated in FIG. 48. In FIG. 48, an engine/vehicle parameter(s) sensor is indicated at 690. This block schematically represents one or more parameters that are being sensed for use in controlling the stroke of the engine. For example, engine torque or horsepower requirements may be sensed in a conventional manner by one or more sensors 691. As another example, the position of a throttle pedal of the vehicle may be sensed by a conventional throttle position sensor indicated at 692. Other vehicle and engine parameters may also be used as a basis for controlling the engine. For example, a braking condition (service brake position) and/or brake temperature may be sensed by associated sensors 694 so that, for example, the engine displacement may be increased in the event the engine is to be used to assist in braking the vehicle. Engine speed may be sensed by sensor 694 and used as a control parameter. Also, fuel consumption may be sensed with the engine displacement being adjusted to improve fuel efficiency. A manually actuated adjustment control 695 may also be included to give the engine or vehicle operator some control over the engine displacement (e.g., to increase displacement under high torque or extreme braking conditions. A signal or signals corresponding to the sensed parameter or parameters is transmitted on a bus 697, which may be the existing data bus of a vehicle, to an engine controller 696. The engine controller 696 includes a signal path 690 for sending appropriate signals to an engine stroke adjuster 699. The engine stroke adjuster comprises a mechanism for varying the angle of at least one swash plate assembly and more desirably the angle of at least a first swash plate assembly and a counterbalancing swash plate assembly with the angles being adjusted in opposite directions to enhance the counterbalancing features of the engine. Examples of the engine stroke adjuster have been previously described. A hydraulic cylinder activated mechanism, a mechanical mechanism and/or an electronically controlled mechanism may be used to cause the shifting of the angle of the desired swash plate assembly. The swash plate assembly is part of a swash plate engine 700. Control signals to a hydraulic fluid control valve, to a gear adjustment motor or other control mechanism are delivered along a path 698 to the swash plate adjuster 699 to cause the swash plate engine 700 to adjust its stroke. Feedback may be provided to the engine controller for use in monitoring the engine stroke adjustment.

In the case of a gasoline fuel engine wherein gasoline fuel and combustion air is delivered as an air-fuel mixture to the combustion chamber for combustion therein to drive an associated piston, the engine controller 696 may send signals via a path 704 to a fuel injector or other fuel supply controller 706 to adjust the amount of fuel delivered to the swash plate engine. Typically, the quantity of fuel is reduced with a reduction in the volume of the engine displacement as a result of a change in the stroke of the swash plate engine. As a result, the amount of fuel that is delivered to the engine may be controlled to maximize fuel efficiency and/or exhaust gas consistency (which may be another control parameter). In the case of a gasoline engine, a combustion air throttle 710 may be used. In the event the engine displacement is reduced, the engine controller 696 may send a signal via a line 705 to the air supply throttle 710 to reduce the amount of air delivered to the swash plate engine in combination with the reduction in the gasoline supplied by fuel supply controller 706. Conversely, if the engine displacement is increased, the engine controller may cause an increase in gasoline delivered to a gasoline swash plate engine via fuel supplier 706 together with an increase in the amount of air being delivered to the engine via air controller 710. The use of an air throttle can increase the responsiveness of the engine and can assist in realizing a more optimum fuel consumption efficiency and/or a more optimum exhaust gas consistency.

In the case of a diesel fuel engine, an air throttle is typically omitted, but the quantity of injected fuel is typically reduced with engine displacement reductions and increased with engine displacement increases. The quantity of fuel may also be adjusted to increase fuel efficiency and/or exhaust gas consistency The swash plate engine 700 may be adjusted to increase the stroke of the engine under high torque or heavy load requirements (e.g., during startup or climbing a hill) and/or during braking events while reducing the stroke under idle conditions and at less demanding times, such as when the vehicle is cruising at highway speed on flat ground.

The operation of the swash plate engine may be controlled in accordance with a wide variety of methods. As a specific example, for a diesel engine, under idle conditions, the engine stroke may be maintained at a level which is greater than the minimum engine stroke with the fuel supply reduced. When the fuel accelerator pedal is depressed, the engine is more responsive because the stroke has not been reduced to a minimum stroke. Under coasting conditions (e.g., when a vehicle is coasting and no engine braking is desired), the fuel supply is reduced to zero and the stroke reduced toward its minimum (e.g., toward or at zero displacement) level. Under an engine braking condition (e.g., a truck is traveling downhill and it is desired to have the engine assist in braking the vehicle), the stroke may be set at a high level, for example at or toward the maximum stroke with the fuel reduced to zero. A direct injection gasoline engine may be operated, for example, in the same manner. For a gasoline engine of the type with an air throttle which regulates the supply of combustion air to the engine, under idle conditions, the engine stroke may be maintained at a level which is greater than the minimum engine stroke with the combustion air supply and fuel supply both being reduced. This improves engine responsiveness in comparison to the case if the displacement had been reduced toward or to the minimum level. In this case, the fuel and combustion air supply is increased when the engine is operated at above idle conditions. Under coasting conditions, the engine displacement is reduced (e.g., toward or at the minimum, such as zero displacement) with the combustion air supply and fuel supply reduced (e.g., toward or at a minimal level or totally closed off). This increases engine fuel efficiency under these conditions. Under engine braking conditions, the engine displacement may be set at a high level (e.g., at or toward the maximum displacement level), the engine fuel may be reduced (e.g., toward a minimum fuel level or shut off), and the air supply may be maintained at a high level. Again, other engine control approaches may also be used. Having described the principles of my invention with reference to several embodiments, it should be apparent to those of ordinary skill in the art that the embodiments may be modified without departing from the principles of my invention. I claim all such embodiments as fall within the scope and spirit of the following claims.

I claim:

1. An internal combustion engine comprising:

an engine housing;

at least one cylinder positioned within the engine housing, the at least one cylinder having a longitudinal cylinder axis extending in a first direction;

a reciprocatable piston positioned within the at least one cylinder for reciprocation therein;

a rotatable output member coupled to the housing and rotatable about a first axis;

at least first and second swash plate assemblies within the engine housing with each cylinder of the engine being positioned at the same side of the swash plate assemblies;

the first swash plate assembly comprising a first member and a second member, the first member being rotatably coupled to the second member for rotation relative to the second member and about the first axis, the second member being coupled to the housing such that the second member is restrained against rotation;

the first member being pivotally coupled to the output member for pivoting about a second axis which is transverse to the first axis;

a piston rod pivotally coupled to the piston and pivotally coupled to the second member, the piston rod reciprocating with the reciprocal movement of the piston, wherein reciprocal movement of the piston results in reciprocal movement of the second member and rotation of the first rotatable member and the output member about the first axis;

the second swash plate assembly comprising a third rotatable member and a fourth member, the third member being rotatably coupled to the fourth member for rotation relative to the fourth member and about the first axis, the fourth member being coupled to the housing such that the fourth member is restrained against rotation; and the third member being pivotally coupled to the output member for pivoting about a third axis which is transverse to the first axis, wherein the third member rotates with the rotation of the output member and with the rotation of the first member, rotational movement of the third member resulting in reciprocal movement of the fourth member; and wherein the first and second swash plate assemblies are positioned relative to one another such that the second and fourth members reciprocate relative to one another in opposite directions with the rotation of the first and third members.

2. An engine according to claim 1 wherein the piston rod comprises a rotation limiting guide movable with the piston as the piston reciprocates, the housing comprising a guide engaging member operable to engage the rotation limiting guide to restrict the piston rod against rotation about the first axis, the second member being coupled to the housing through the rotation limiting guide and the guide engaging member to thereby confine the motion of the second member to reciprocation without rotation about the first axis.

3. An engine according to claim 2 in which the housing comprises a track, a track follower coupled to the fourth member, the track follower being positioned to engage the track, the track and track follower cooperating to confine the motion of the fourth member to reciprocal motion without rotation about the first axis.

4. An engine according to claim 3 in which the track follower comprises a rolling track follower rotatably engaging the track.

5. An engine according to claim 3 in which the track follower comprises a slide member which slidably engages the track.

6. An engine according to claim 3 wherein the track comprises a channel with spaced apart smooth track follower engaging wall surfaces positioned for engagement by the track follower.

7. An engine according to claim 2 in which the guide engaging member comprises at least one piston rod motion confining member coupled to the housing, the piston rod motion confining member slidably engaging the rotation limiting guide to limit the motion of the piston rod to reciprocation without rotation about the first axis, whereby the second member is coupled to the housing by the rotation limiting guide and by the piston rod motion confining member and is restricted by the piston rod motion confining member to reciprocation without rotation about the first axis.

8. An engine according to claim 1 comprising means for restricting the second and fourth members against rotation about the first axis.

9. An engine according to claim 1 comprising a first set of bearings rotatably coupling the first member to the second member and a second set of bearings rotatably coupling the third member to the fourth member.

10. An engine according to claim 9 wherein the first and second sets of bearings comprise ball bearings.

11. An engine according to claim 9 wherein the first and second sets of bearings comprise barrel bearings.

12. An engine according to claim 9 wherein the first and second sets of bearings comprise pressure lubricated friction bearings.

13. An engine according to claim 1 wherein at least one of the first and second members and at least one of the third and fourth members comprise a plurality of interconnected sections.

14. An engine according to claim 13 wherein the first member comprises first and second annular sections which are sandwiched together and interconnected to comprise the first member, the first and second annular sections each defining portion of a first annular rotating surface, the second member comprising a second annular rotating surface which faces the first annular rotating surface, a first set of bearings positioned between the first and second annular rotating surfaces; and the fourth member comprising at least first and second ring sections which each define a portion of a fourth annular rotating surface, the ring sections of the fourth member being interconnected to comprise an annular fourth member with the fourth annular rotation surface, the third member comprising a third annular rotation surface which faces the fourth annular rotating surface, a second set of bearings positioned between the third and fourth annular rotation surfaces.

15. An engine according to claim 1 comprising bearings coupling the piston rod to the second member.

16. An engine according to claim 1 comprising a coupling member pivotally connected to the second member and comprising a projecting portion, the piston rod being pivotally connected to the projecting portion.

17. An engine according to claim 14 comprising a respective universal joint coupling each piston rod to the second member of the first swash plate assembly.

18. An engine according to claim 1 comprising respective tilt bearings for pivotally coupling the respective first and third members to the output member for pivoting about the respective second and third axes.

19. An engine according to claim 1 comprising a first set of bearings pivotally coupling the first member to the output member, a second set of bearings pivotally coupling the third member to the output member, a third set of bearings rotatably coupling the first member to the second member, and a fourth set of bearings rotatably coupling the third member to the fourth member, the engine comprising a pressurized lubricating fluid supply in communication through at least one lubricating fluid passageway with each of the first, second, third and fourth bearings and operable to provide lubricating fluid to such bearings.

20. An engine according to claim 1 wherein the first swash plate assembly, when in a first position, defines a first plane at a first angle of inclination relative to a second plane perpendicular to the first axis and wherein the second plane intersects the second axis, the engine comprising means for changing the first angle of inclination and for shifting the location of the second axis in a direction along the first axis and relative to the location of the at least one piston cylinder to thereby vary the stroke of the engine.

21. An internal combustion engine according to claim 1 comprising a variable engine stroke adjuster, the variable engine stroke adjuster being coupled to at least the first swash plate assembly and operable to vary the tilt of the first swash plate assembly relative to the first axis so as to adjust the stroke of the engine.

22. An internal combustion engine according to claim 1 in which the output member comprises first and second output sections, the first section being drivenly coupled to the second section and being movable along the first axis and relative to the second section, the first and second swash plate assemblies being coupled to the first section, the first section defining an engine stroke varying cylinder positioned at least partially in the center of the plurality of cylinders, an engine stroke varying piston coupled to the housing and positioned within the engine stroke varying cylinder, wherein the delivery of operating fluid to one side of the piston moves the first section in a first direction along the first axis and the delivery of operating fluid to the opposite side of the piston moves the first section in a second direction opposite to the first direction along the first axis, whereby the first section is movable relative to the second section to thereby shift the position of the swash plate assemblies to vary the stroke of the engine.

23. An internal combustion engine according to claim 1 in which the output member comprises first and second sections, the first section being drivenly coupled to the second section and being movable along the first axis and relative to the second section, the first and second swash plate assemblies being coupled to the first section, wherein movement of the first section along the first axis varies the angle of the swash plate assemblies relative to the first axis, at least one adjustment gear drivenly coupled to the first section and rotatable in a first direction to shift the first section in a first direction along the first axis and rotatable in a second direction to shift the first section in a second direction opposite to the first direction, whereby rotation of the adjustment gear shifts the first section in either the first or second direction depending upon the direction of rotation of the adjustment gear to thereby adjust the angle of the swash plate assemblies and vary the stroke of the engine.

24. An engine according to claim 23 comprising an endless ball bearing track coupling the first section to the housing.

25. An engine according to claim 1 wherein the number of cylinders included in the engine, the firing order for each such number of cylinders, and the swash plate rotation angle through which the first member rotates between firing of one cylinder and the next cylinder to fire are in accordance with the following table:

| Number of Cylinders | Firing Order | Swash Plate Rotation Angle |
|---|---|---|
| 1 | 1 | 720° |
| 2 | 1, 2, 1 | 360° |
| 3 | 1, 3, 2, 1 | 240° |
| 5 | 1, 3, 5, 2, 4, 1 | 144° |
| 7 | 1, 3, 5, 7, 2, 4, 6, 1 | 102.857° |
| 9 | 1, 3, 5, 7, 9, 2, 4, 6, 8, 1 | 80° |
| 11 | 1, 3, 5, 7, 9, 11, 2, 4, 6, 8, 10, 1 | 65.454° |

and wherein the first member rotates 720° during a complete firing cycle.

26. An engine according to claim 1 with only five cylinders which fire in the following sequence: 1, 3, 5, 2, 4 and 1 and wherein the first member rotates through 144° between firing of one cylinder and the next cylinder to fire.

27. An engine according to claim 1 wherein one of the first and second swash plate assemblies defines an interior swash plate passageway, the other of the first and second swash plate assemblies being sized and positioned to reciprocate at least partially through the interior swash plate passageway as the second and fourth members reciprocate at least during certain operating positions of the first and second swash plate assemblies.

28. An engine according to claim 1 comprising a plurality of cylinders each comprising a cylinder wall, a respective piston and piston rod being associated with each cylinder, wherein the pistons each repeatedly travel within an associated cylinder between a top dead center position and a bottom dead center position and back to the top dead center position during a piston stroke, the piston exerting a force against a first portion of the wall of the associated cylinder during one portion of a piston stroke and against a second portion of the wall of the cylinder during another portion of a piston stroke, and wherein each piston shifts from exerting a force against the first portion of the wall of the cylinder to the second portion of the wall of the cylinder when the piston is in either the top dead center or bottom dead center position.

29. An engine according to claim 1 wherein the first swash plate assembly defines an interior swash plate passageway, the second swash plate assembly being sized and positioned to reciprocate at least partially through the interior swash plate passageway as the second and fourth members reciprocate at least during certain operating positions of the first and second swash plate assemblies.

30. An engine according to claim 1 wherein the first member is positioned to rotate inwardly of the second member and the third member is positioned to rotate inwardly of the fourth member.

31. An engine according to claim 1 comprising a coupling assembly comprised of first, second and third elements, the first element pivotally coupling the first member to the second element at a first location positioned at one side of a plane bisecting the first axis, and the third element pivotally coupling the third member to the second element at a location at the other side of the plane bisecting the first axis from the first location, and wherein the second element is rotatable about the first axis with the rotation of the first and third members.

32. An engine according to claim 1 wherein the at least one piston cylinder comprises a cylinder head portion and a cylinder wall portion, wherein the piston comprises a piston head surface adjacent to the cylinder head portion of the associated cylinder in which the piston travels, the piston repeatedly traveling during a piston stroke between a top dead center position in which the piston head surface is closest to the cylinder head portion and a bottom dead center position in which the piston head surface is furthest from the cylinder head portion, wherein the combustion chamber is defined as the volume of the cylinder between the cylinder head portion and piston head surface when the piston head surface is in the top dead center position, the engine comprising a piston stroke length adjuster coupled to at least the first swash plate assembly and operable to vary the angle of the first swash plate assembly relative to the second axis to vary the stroke of the piston, and wherein the piston is coupled to the first swash plate assembly such that the volume of the combustion chamber associated with the piston increases as the length of the piston stroke increases and decreases as the length of the piston stroke decreases.

33. An engine according to claim 32 wherein there are plural pistons each reciprocating within an associated cylinder and wherein the volume of the combustion chamber associated with each piston increases as the length of the piston stroke increases and decreases as the length of the piston stroke decreases.

34. An engine according to claim 32 wherein the combustion ratio is defined as the ratio $$\frac{V_c + V_H}{V_c},$$

wherein $V_c$ is the volume of the combustion chamber and $V_H$ is the volume of the portion of the cylinder through which the piston travels between the top dead center position and bottom dead center position, and wherein the combustion ratio is substantially constant as the stroke of the piston is varied.

35. An engine according to claim 32 wherein the combustion ratio is defined as the ratio $$\frac{V_c + V_H}{V_c},$$

wherein $V_c$ is the volume of the combustion chamber and $V_H$ is the volume of the portion of the cylinder through which the piston travels between the top dead center position and bottom dead center position, and wherein the combustion ratio is increased from one level to another higher level when the load on the engine is reduced.

36. An engine according to claim 32 wherein the angle of the swash plate assembly is varied in response to at least one vehicle parameter.

37. An engine according to claim 36 wherein the at least one vehicle parameter comprises a vehicle throttle pedal position.

38. An engine according to claim 21 wherein the cylinder has a bore and wherein the ratio of the piston stroke to the bore is less than one at a first vehicle speed and is greater than one at a second vehicle speed.

39. An engine according to claim 21 wherein the cylinder has a bore and wherein the ratio of the piston stroke to the bore is less than one at a first vehicle engine demand, wherein the engine demand comprises at least one of the horsepower and engine torque, and is greater than one at a second engine demand.

40. An engine according to claim 1 wherein the second and third axes are perpendicular to the first axis.

41. An engine according to claim 1 comprising an oil pan communicating with the interior of the housing and positioned at least partially below the housing, the oil pan collecting lubricating oil which may be delivered from the oil pan to at least the swash plate assemblies.

42. An engine according to claim 1 comprising at least one first link member comprising first and second end portions, the first link member being pivoted at the first end portion to the first member of the first swash plate assembly at a first location, at least one third link member comprising first and second end portions, the third link member being pivoted at the first end portion to the third member of the second swash plate assembly at a second location, the first and second locations being at different sides of the first axis from one another, a second link member rotatable about the first axis and comprising at least one first leg portion projecting outwardly from the first axis toward the first location, the first link member being pivoted at the second end portion thereof to the first leg portion, the second link member comprising at least one second leg portion projecting outwardly from the first axis toward the second location, the third link member being pivoted at the second end portion thereof to the second leg portion.

43. An engine according to claim 42 wherein the second link member comprises a first collar portion having a longitudinal axis aligned with the first axis, the engine comprising a second collar which is slidably and drivenly coupled to the first collar portion such that the second collar rotates with the second link member, the first member of the first swash plate assembly being pivoted to the second collar for pivoting about the second pivot axis, a third collar surrounding a portion of the second collar, the third member of the second swash plate assembly being pivoted to the third collar for pivoting about the third pivot axis, and means for moving the second and third collars axially along the first axis to adjust the angle of the first and second swash plate assemblies relative to the first axis to thereby vary the stroke of the engine.

44. An engine according to claim 43 wherein the second collar and first collar portion are splined together by splines which extend in a direction parallel to the first axis so that the second collar and first collar portion may be moved relative to one another in a direction parallel to the first axis while remaining drivenly coupled together.

45. An internal combustion engine according to claim 1 wherein the first member of the first swash plate assembly is coupled to the output member at a first location and the third member of the second swash plate assembly is coupled to the output member at a second location, the first and second locations being positioned 180 degrees apart about the output member.

46. An engine according to claim 1 in which the fourth member of the second swash plate assembly is at least partially comprised of a material which is heavier than the material comprising the second member of the first swash plate assembly.

47. An internal combustion engine comprising:

an engine housing;

at least one cylinder positioned within the engine housing, the at least one cylinder having a longitudinal cylinder axis extending in a first direction;

a piston positioned within the at least one cylinder for reciprocation therein;

a rotatable output member coupled to the housing and rotatable about a first axis;

at least first and second swash plate assemblies within the engine housing;

the first swash plate assembly comprising a first member and a second member, the first member being rotatably coupled to the second member for rotation relative to the second member and about the first axis, the second member being coupled to the housing such that the second member is restrained against rotation;

the first member being pivotally coupled to the output member for pivoting about a second axis which is transverse to the first axis;

a piston rod pivotally coupled to the piston and pivotally coupled to the second member, the piston rod reciprocating with the reciprocal movement of the piston, wherein reciprocal movement of the piston results in reciprocal movement of the second member and rotation of the first member and the output member about the first axis;

the second swash plate assembly comprising a third rotatable member and a fourth member, the third member being rotatably coupled to the fourth member for rotation relative to the fourth member and about the first axis, the fourth member being coupled to the housing such that the fourth member is restrained against rotation; and the third member being pivotally coupled to the output member for pivoting about a third axis which is transverse to the first axis, wherein the third member rotates with the rotation of the output member and with the rotation of the first member, rotational movement of the third member resulting in reciprocal movement of the fourth member;

wherein the first and second swash plate assemblies are positioned relative to one another such that the second and fourth members reciprocate relative to one another in opposite directions with the rotation of the first and second members; and wherein one of the first and second swash plate assemblies defines an interior swash plate passageway, the other of the first and second swash plate assemblies being sized and positioned to reciprocate at least partially through the interior swash plate passageway as the second and fourth members reciprocate at least during certain operating positions of the first and second swash plate assemblies.

48. An engine according to claim 47 comprising a plurality of cylinders each comprising a cylinder wall, a respective piston and piston rod being associated with each cylinder, wherein the pistons each repeatedly travel within an associated cylinder between a top dead center position and a bottom dead center position and back to the top dead center position during a piston stroke, the piston exerting a force against a first portion of the wall of the associated cylinder during one portion of a piston stroke and against a second portion of the wall of the cylinder during another portion of a piston stroke, and wherein each piston shifts from exerting a force against the first portion of the wall of the cylinder to the second portion of the wall of the cylinder when the piston is in either the top dead center or bottom dead center position.

49. An engine according to claim 47 wherein the piston rod is coupled to the first swash plate assembly by a universal bearing.

50. An engine according to claim 47 comprising a first set of bearings pivotally coupling the first member to the output member, a second set of bearings pivotally coupling the third member to the output member, a third set of bearings rotatably coupling the first member to the second member, and a fourth set of bearings rotatably coupling the third member to the fourth member, the engine comprising a pressurized lubricating fluid supply in communication through a lubricating fluid passageway with each of the first, second, third and fourth bearings and operable to provide lubricating fluid to such bearings.

51. An engine according to claim 47 wherein the second swash plate assembly defines an interior swash plate passageway, the first swash plate assembly being sized and positioned to reciprocate at least partially through the interior swash plate passageway as the second and fourth members reciprocate at least during certain operating positions of the first and second swash plate assemblies.

52. An engine according to claim 47 wherein the first swash plate assembly defines an interior swash plate passageway, the second swash plate assembly being sized and positioned to reciprocate at least partially through the interior swash plate passageway as the second and fourth members reciprocate at least during certain operating positions of the first and second swash plate assemblies.

53. An engine according to claim 47 wherein the first member comprises a first annular rotation surface and the second member comprises a second annular rotation surface, the first annular rotation surface rotating relative to the second annular rotation surface as the first member rotates relative to the second member, wherein the third member comprises a third annular rotation surface and the fourth member comprises a fourth annular rotation surface, the third annular rotation surface rotating relative to the fourth annular rotation surface as the third member rotates relative to the fourth member.

54. An engine according to claim 53 wherein the first annular rotation surface comprises a first outwardly facing surface and the second annular rotation surface comprises a second inwardly facing surface, at least a major portion of the first member being positioned inwardly of the first annular rotation surface and at least a major portion of the second member being positioned outwardly of the second annular rotation surface, wherein the third annular rotation surface comprises a third outwardly facing surface, the fourth annular rotation surface comprises a fourth inwardly facing surface, at least a major portion of the third member being positioned inwardly of the third annular rotation surface, and at least a major portion of the fourth member being positioned outwardly of the fourth annular rotation surface.

55. An engine according to claim 53 wherein the first annular rotation surface comprises a first inwardly facing surface and the second annular rotation surface comprises a second outwardly facing surface, at least a major portion of the first member being positioned outwardly of the first annular rotation surface and at least a major portion of the second member being positioned inwardly of the second annular rotation surface, wherein the third annular rotation surface comprises a third outwardly facing surface, the fourth annular rotation surface comprises a fourth inwardly facing surface, at least a major portion of the third member being positioned inwardly of the third annular rotation surface, and at least a major portion of the fourth member being positioned outwardly of the fourth annular rotation surface.

56. An engine according to claim 53 wherein the first annular rotation surface comprises a first inwardly facing surface and the second annular rotation surface comprises a second outwardly facing surface, at least a major portion of the first member being positioned outwardly of the first annular rotation surface and at least a major portion of the second member being positioned inwardly of the second annular rotation surface, wherein the third annular rotation surface comprises a third inwardly facing surface, the fourth annular rotation surface comprises a fourth outwardly facing surface, at least a major portion of the third member being positioned outwardly of the third annular rotation surface, and at least a major portion of the fourth member being positioned inwardly of the fourth annular rotation surface.

57. An engine according to claim 53 wherein the first annular rotation surface comprises a first outwardly facing surface and the second annular rotation surface comprises a second inwardly facing surface, at least a major portion of the first member being positioned inwardly of the first annular rotation surface and at least a major portion of the second member being positioned outwardly of the second annular rotation surface, wherein the third annular rotation surface comprises a third inwardly facing surface, the fourth annular rotation surface comprises a fourth outwardly facing surface, at least a major portion of the third member being positioned outwardly of the third annular rotation surface, at least a major portion of the fourth member being positioned inwardly of the fourth annular rotation surface.

58. An engine according to claim 47 wherein the first member is positioned to rotate inwardly of the second member and the third member is positioned to rotate inwardly of the fourth member.

59. An engine according to claim 47 comprising a coupling assembly comprised of first, second and third elements, the first element pivotally coupling the first member to the second element at a first location positioned at one side of a plane bisecting the first axis, and the third element pivotally coupling the third member to the second element at a location at the other side of the plane bisecting the first axis from the first location, and wherein the second element is rotatable about the first axis with the rotation of the first and third members.

60. An engine according to claim 47 comprising a plurality of cylinders and pistons, all of the cylinders and piston of the engine being located at the same side of the second member.

61. An engine according to claim 47 wherein the at least one piston cylinder comprises a cylinder head portion and a cylinder wall portion, wherein the piston comprises a piston head surface adjacent to the cylinder head portion of the associated cylinder in which the piston travels, the piston repeatedly traveling during a piston stroke between a top dead center position in which the piston head surface is closest to the cylinder head portion and a bottom dead center position in which the piston head surface is furthest from the cylinder head portion, wherein the combustion chamber is defined as the volume of the cylinder between the cylinder head portion and piston head surface when the piston head surface is in the top dead center position, the engine comprising a piston stroke length adjuster coupled to at least the first swash plate assembly and operable to vary the angle of the first swash plate assembly relative to the first axis to vary the stroke of the piston, and wherein the piston is coupled to the first swash plate assembly such that the volume of the combustion chamber associated with the piston increases as the length of the piston stroke increases and decreases as the length of the piston stroke decreases.

62. An engine according to claim 61 wherein there are plural pistons each reciprocating within an associated cylinder and wherein the volume of the combustion chamber associated with each piston increases as the length of the piston stroke increases and decreases as the length of the piston stroke decreases.

63. An engine according to claim 61 wherein the combustion ratio is defined as the ratio $$\frac{V_c + V_H}{V_c},$$

wherein $V_c$ is of the volume of the combustion chamber and $V_H$ is the volume of the portion of the cylinder through which the piston travels between the top dead center position and bottom dead center position, and wherein the combustion ratio is substantially constant as the stroke of the piston is varied.

64. An engine according to claim 61 wherein the combustion ratio is defined as the ratio $$\frac{V_c + V_H}{V_c},$$

wherein $V_c$ is the volume of the combustion chamber and $V_H$ is the volume of the portion of the cylinder through which the piston travels between the top dead center position and bottom dead center position, and wherein the combustion ratio is increased from one level to another higher level when the load on the engine is reduced.

65. An engine according to claim 61 wherein the angle of the swash plate assembly is varied in response to at least one vehicle parameter.

66. An engine according to claim 65 wherein the at least one vehicle parameter comprises a vehicle throttle pedal position.

67. An engine according to claim 47 wherein the cylinder has a bore and wherein the ratio of the piston stroke to the bore is less than one at a first vehicle speed and is greater than one at a second vehicle speed.

68. An engine according to claim 47 wherein the cylinder has a bore and wherein the ratio of the piston stroke to the bore is less than one at a first vehicle engine demand, wherein the engine demand comprises at least one of the horsepower and engine torque, and is greater than one at a second engine demand.

69. An engine according to claim 47 wherein the second and third axes are perpendicular to the first axis.

70. An engine according to claim 47 wherein the number of cylinders included in the engine, the firing order for each such number of cylinders, and the swash plate rotation angle through which the first member rotates between firing of one cylinder and the next cylinder to fire are in accordance with the following table:

| Number of Cylinders | Firing Order | Swash Plate Rotation Angle |
|---|---|---|
| 1 | 1 | 720° |
| 2 | 1, 2, 1 | 360° |
| 3 | 1, 3, 2, 1 | 240° |
| 5 | 1, 3, 5, 2, 4, 1 | 144° |
| 7 | 1, 3, 5, 7, 2, 4, 6, 1 | 102.857° |
| 9 | 1, 3, 5, 7, 9, 2, 4, 6, 8, 1 | 80° |
| 11 | 1, 3, 5, 7, 9, 11, 2, 4, 6, 8, 10, 1 | 65.454° |

and wherein the first member rotates 720° during a complete firing cycle.

71. An engine according to claim 47 comprising an oil pan communicating with the interior of the housing and positioned at least partially below the housing, the oil pan collecting lubricating oil which may be delivered from the oil pan to at least the swash plate assemblies.

72. An engine according to claim 47 comprising at least one first link member comprising first and second end portions, the first link member being pivoted at the first end portion to the first member of the first swash plate assembly at a first location, at least one third link member comprising first and second end portions, the third link member being pivoted at the first end portion to the third member of the second swash plate assembly at a second location, the first and second locations being at different sides of the first axis from one another, a second link member rotatable about the first axis and comprising at least one first leg portion projecting outwardly from the first axis toward the first location, the first link member being pivoted at the second end portion thereof to the first leg portion, the second link member comprising at least one second leg portion projecting outwardly from the first axis toward the second location, the third link member being pivoted at the second end portion thereof to the second leg portion.

73. An engine according to claim 72 wherein the second link member comprises a first collar portion having a longitudinal axis aligned with the first axis, the engine comprising a second collar which is slidably and drivenly coupled to the first collar portion such that the second collar rotates with the second link member, the first member of the first swash plate assembly being pivoted to the second collar for pivoting about the second pivot axis, a third collar surrounding a portion of the second collar, the third member of the second swash plate assembly being pivoted to the third collar for pivoting about the third pivot axis, and means for moving the second and third collars axially along the first axis to adjust the angle of the first and second swash plate assemblies relative to the first axis to thereby vary the stroke of the engine.

74. An engine according to claim 73 wherein the second collar and first collar portion are splined together by splines which extend in a direction parallel to the first axis so that the second collar and first collar portion may be moved relative to one another in a direction parallel to the first axis while remaining drivenly coupled together.

75. An internal combustion engine according to claim 74 wherein the first member of the first swash plate assembly is coupled to the output member at a first location and the third member of the second swash plate assembly is coupled to the output member at a second location, the first and second locations being positioned 180 degrees apart about the output member.

76. An engine according to claim 47 in which the fourth member of the second swash plate assembly is at least partially comprised of a material which is heavier than the material comprising the second member of the first swash plate assembly.

77. An internal combustion engine comprising:

a housing, the housing comprising a valve cover portion, a cylinder head portion, a cylinder case portion, a swash plate case portion, and an output member supporting portion;

a plurality of cylinders having respective bores, the plurality of cylinders being positioned within the cylinder case portion, each cylinder bore having a bore diameter and a longitudinal cylinder axis;

at least one combustion air intake port being provided in communication with each cylinder and at least one exhaust gas port provided in communication with each cylinder;

a respective air intake valve for each air intake port of each cylinder and which is selectively operable to open and close the air intake port;

a respective exhaust valve for each exhaust gas port of each cylinder and which is selectively operable to open and close the exhaust gas port;

each air intake valve being opened to permit the ingress of combustion air into the associated cylinder and closed during a combustion of an air-fuel mixture within the associated cylinder, each exhaust valve being opened to permit the exhaust of combustion gases from the associated cylinder and through the associated exhaust gas port following combustion of the air-fuel mixture within the associated cylinder;

a valve actuator positioned within the valve cover portion of the housing and operable to selectively open and close the air intake valves and exhaust valves;

a respective piston positioned within each cylinder and driven along the longitudinal cylinder axis of the associated cylinder in one direction in response to combustion of the air-fuel mixture in the associated cylinder;

a respective piston rod pivotally coupled to each piston;

a first swash plate assembly positioned within the swash plate case portion of the housing, the first swash plate assembly comprising a first rotatable member for rotating about a first axis, a second member coupled to the first member so as to permit rotation of the first member relative to the second member, the piston rods being pivotally coupled to the second member;

an output member coupled to the output member supporting portion of the housing and rotatable about a first axis;

the first member being coupled to the output member for pivoting about a second pivot axis which is perpendicular to the first axis, the first member being drivenly coupled to the output member such that rotation of the first member rotates the output member;

the second member being coupled to the housing to prevent rotation of the second member relative to the first member while permitting rotation of the first member relative to the second member, the second member being reciprocated by the pistons when the pistons are driven to thereby cause rotation of the first member and rotation of the output member;

a second counterbalancing swash plate assembly pivotally coupled to the output member for pivoting about a third pivot axis which is perpendicular to the first pivot axis;

the second swash plate assembly being positioned within the swash plate case portion of the housing and comprising respective third and fourth members, the third member being rotatable relative to the fourth member and coupled to the output member for pivoting about a third axis which is perpendicular to the first axis, the fourth member being coupled to the housing so as to prevent the fourth member from rotating while permitting the third member to rotate relative to the fourth member, the first member being coupled to the third member such that the first and third members rotate together; and the second swash plate assembly being oriented relative to the first swash plate assembly such that, as the second member of the first swash plate assembly reciprocates in a first direction, the fourth member of the second swash plate assembly reciprocates in a direction which is opposite to the first direction.

78. An engine according to claim 77 in which the exhaust gas ports are shorter than the air intake ports.

79. An engine according to claim 78 in which the air intake ports and the exhaust gas ports exit from the cylinder head portion in directions extending generally radially outwardly from the first axis, and wherein the exhaust gas port for each cylinder communicates with the cylinder at a location which is positioned radially outwardly from the first axis relative to the location where the air intake port communicates with the cylinder.

80. An engine according to claim 77 wherein the cylinder head portion and cylinder case portion are of a single monolithic one-piece construction.

81. An engine according to claim 77 wherein the cylinder case portion and swash plate case portion are of a single monolithic one-piece construction.

82. An engine according to claim 77 wherein the longitudinal cylinder axis of each of the cylinders is parallel to and positioned at a common radius from the first axis.

83. An engine according to claim 77 wherein the longitudinal cylinder axis of each of the respective cylinders are at an acute angle relative to the first axis.

84. An engine according to claim 83 wherein the acute angle is no greater than thirty degrees.

85. An engine according to claim 77 wherein there are plural engine cylinders and all of the engine cylinders are coupled together with at least one coolant fluid flow passageway between each of the adjacent cylinders of the engine.

86. An engine according to claim 77 wherein there are plural cylinders and all of the cylinders are of a monolithic one-piece construction formed by casting all of the cylinders together as a unit.

87. An engine according to claim 86 comprising at least one coolant fluid flow passageway between each of the adjacent cylinders of the engine and formed during casting of the cylinders.

88. An engine according to claim 86 comprising at least one coolant fluid flow passageway between each of the adjacent cylinders of the engine and formed by machining.

89. An engine according to claim 77 wherein the number of cylinders included in the engine, the firing order for each such number of cylinders, and the swash plate rotation angle through which the first member rotates between firing of one cylinder and the next cylinder to fire are in accordance with the following table:

| Number of Cylinders | Firing Order | Swash Plate Rotation Angle |
|---|---|---|
| 1 | 1 | 720° |
| 2 | 1, 2, 1 | 360° |
| 3 | 1, 3, 2, 1 | 240° |
| 5 | 1, 3, 5, 2, 4, 1 | 144° |
| 7 | 1, 3, 5, 7, 2, 4, 6, 1 | 102.857° |
| 9 | 1, 3, 5, 7, 9, 2, 4, 6, 8, 1 | 80° |
| 11 | 1, 3, 5, 7, 9, 11, 2, 4, 6, 8, 10, 1 | 65.454° |

and wherein the first member rotates 720° during a complete firing cycle.

90. An engine according to claim 77 wherein the valve actuator comprises a cam body coupled to the housing for rotation about a cam body axis which is aligned with the first axis, at least one cam projecting from the cam body, and at least one cam follower, the at least one cam and at least one cam follower being operable to open and close air intake and exhaust valves as the cam body rotates.

91. An apparatus according to claim 90 wherein the cam body comprises a cam disk with an outer periphery, the cam comprising at least one projection extending outwardly from the outer periphery of the cam disk, the cam follower being engaged by the cam to operate at least one of the air intake and exhaust valves.

92. An engine according to claim 90 wherein the cam body comprises first and second major surfaces, the second major surface being positioned adjacent to the cylinders, the first major surface being positioned further from the cylinders than the second major surface, the cam comprising at least one projection extending from the first surface and away from the second surface.

93. An engine according to claim 90 wherein the cam body comprises first and second major opposed surfaces, the second major surface being adjacent to the cylinders, the first major surface being spaced further from the cylinders than the second major surface, a cam supporting projection spaced from the cam body axis and extending from the second major surface and away from the first major surface, at least one cam projecting radially inwardly from the cam supporting projection and toward the cam body axis.

94. An engine according to claim 90 consisting of one cylinder and one associated piston, the cam body being rotated at one-half the speed of the output member and in either direction relative to the direction of rotation of the output member, a first cam provided on the cam body in a position to selectively open and close the intake valve for the cylinder and a second cam provided on the cam body in a position to selectively open and close the exhaust valve for the cylinder.

95. An engine according to claim 90 consisting of two cylinders and two associated pistons, the cam body being rotated at one-half the speed of the output member and in either direction relative to the direction of rotation of the output member, a first cam provided on the cam body in a position to selectively open and close the intake valves and a second cam provided on the cam body in a position to selectively open and close the exhaust valves.

96. An engine according to claim 90 consisting of three cylinders and three associated pistons, the cam body being rotated at one-half the speed of the output member, the cam body being rotated in a direction which is opposite to the direction of rotation of the output member, the cam body including a first cam in position to selectively operate open and close intake valves and a second cam in position to selectively open and close exhaust valves.

97. An engine according to claim 90 consisting of five cylinders and five associated pistons, the cam body being rotated at a rate which is one-fourth of the speed of rotation of the output member, the cam body being rotated in a direction which is opposite to the direction of rotation of the output member, the cam body including a first set of two cams spaced 180 degrees apart from one another on the cam body in position to selectively open and close the air intake valves and a second set of two cams spaced 180 degrees apart on the cam body and positioned to selectively open and close the exhaust valves.

98. An engine according to claim 90 in which there are seven cylinders and seven associated pistons, the cam body being rotated at a speed which is one-fourth the speed of rotation of the output member, the cam body being rotated in a direction which is the same direction as the direction of rotation of the output member, the cam body including a first set of four cams spaced 90 degrees apart on the cam body and positioned to selectively open and close the intake valves and a second set of four cams spaced 90 degrees apart on the cam body and positioned to selectively open and close the exhaust valves.

99. An engine according to claim 77 in which the first axis is horizontal, the engine comprising an oil pan communicating with the interior of the housing and positioned at least partially below the housing, the oil pan collecting lubricating oil which may be delivered from the oil pan to components of the engine within at least the swash plate case portion, the cylinder head portion and the cylinder case portion of the housing.

100. An engine according to claim 77 in which the valve actuator comprises cam means and cam follower means, the cam means comprising means for shifting the position of the cam follower means to selectively open and close the air intake valves and the exhaust valves.

101. An engine according to claim 77 comprising at least one first link member comprising first and second end portions, the first link member being pivoted at the first end portion to the first member of the first swash plate assembly at a first location, at least one third link member comprising first and second end portions, the third link member being pivoted at the first end portion to the third member of the second swash plate assembly at a second location, the first and second locations being at different sides of the first axis from one another, a second link member rotatable about the first axis and comprising at least one first leg portion projecting outwardly from the first axis toward the first location, the first link member being pivoted at the second end portion thereof to the first leg portion, the second link member comprising at least one second leg portion projecting outwardly from the first axis toward the second location, the third link member being pivoted at the second end portion thereof to the second leg portion.

102. An engine according to claim 101 wherein the second link member comprises a first collar portion having a longitudinal axis aligned with the first axis, the engine comprising a second collar which is slidably and drivenly coupled to the first collar portion such that the second collar rotates with the second link member, the first member of the first swash plate assembly being pivoted to the second collar for pivoting about the second pivot axis, a third collar surrounding a portion of the second collar, the third member of the second swash plate assembly being pivoted to the third collar for pivoting about the third pivot axis, and means for moving the second and third collars axially along the first axis to adjust the angle of the first and second swash plate assemblies relative to the first axis to thereby vary the stroke of the engine.

103. An engine according to claim 102 wherein the second collar and first collar portion are splined together by splines which extend in a direction parallel to the first axis so that the second collar and first collar portion may be moved relative to one another in a direction parallel to the first axis while remaining drivenly coupled together.

104. An internal combustion engine according to claim 77 wherein the first rotatable member of the first swash plate assembly is coupled to the output member at a first location and the third rotatable member of the second swash plate assembly is coupled to the output member at a second location, the first and second locations being positioned 180 degrees apart about the output member.

105. An engine according to claim 77 comprising a plurality of cylinders each comprising a cylinder wall, a respective piston and piston rod being associated with each cylinder, wherein the pistons each repeatedly travel within an associated cylinder between a top dead center position and a bottom dead center position and back to the top dead center position during a piston stroke, the piston exerting a force against a first portion of the wall of the associated cylinder during one portion of a piston stroke and against a second portion of the wall of the cylinder during another portion of a piston stroke, and wherein each piston shifts from exerting a force against the first portion of the wall of the cylinder to the second portion of the wall of the cylinder when the piston is in either the top dead center or bottom dead center position.

106. An internal combustion engine comprising:

an output member rotatable about a first axis;

first and second swash plate assemblies, the first swash plate assembly comprising a first rotatable member coupled to the output member for rotation with the output member and for pivoting about a second pivot axis which is transverse to the first axis, the first swash plate assembly comprising a second member, the first rotatable member being rotatable relative to the second member, the second member being restrained against rotation;

the second swash plate assembly comprising a third rotatable member coupled to the output member for rotation with the rotation of the output member, the third rotatable member also being coupled to the output member for pivoting about a third pivot axis which is transverse to the first axis, the second swash plate assembly also comprising a fourth member coupled to the third rotatable member so as to permit rotation of the third rotatable member relative to the fourth member, the fourth member being restrained against rotation;

at least one piston cylinder;

at least one reciprocating piston slidable within the piston cylinder and having a piston rod coupled to the second member to reciprocally move the second member as the piston moves in the piston cylinder, whereby the first member is driven in rotation by the piston to thereby drive the output member in rotation; and the first and second swash plate assemblies being positioned relative to one another and interconnected such that the second and fourth members reciprocate in opposite directions relative to one another as the second member is reciprocated by the at least one piston to thereby counterbalance one another.

107. An internal combustion engine according to claim 106 comprising at least one first link member comprising first and second end portions, the first link member being pivoted at the first end portion to the first rotatable member of the first swash plate assembly at a first location, at least one third link member comprising first and second end portions, the third link member being pivoted at the first end portion to the third rotatable member of the second swash plate assembly at a second location, the first and second locations being at different sides of the first axis from one another, a second link member rotatable about the first axis and comprising at least one first leg portion projecting outwardly from the first axis toward the first location, the first link member being pivoted at the second end portion thereof to the first leg portion, the second link member comprising at least one second leg portion projecting outwardly from the first axis toward the second location, the third link member being pivoted at the second end portion thereof to the second leg portion.

108. An internal combustion engine according to claim 107 wherein the second link member comprises a first collar portion having a longitudinal axis aligned with the first axis, the engine comprising a second collar which is slidably and drivenly coupled to the first collar portion such that the second collar rotates with the second link member, the first rotatable member of the first swash plate assembly being pivoted to the second collar for pivoting about the second pivot axis, a third collar surrounding a portion of the second collar, the third rotatable member of the second swash plate assembly being pivoted to the third collar for pivoting about the third pivot axis, and means for moving the second and third collars axially along the first axis to adjust the angle of the first and second swash plate assemblies relative to the first axis to thereby vary the stroke of the engine.

109. An engine according to claim 108 wherein the second collar and first collar portion are splined together by splines which extend in a direction parallel to the first axis so that the second collar and first collar portion may be moved relative to one another in a direction parallel to the first axis while remaining drivenly coupled together.

110. An internal combustion engine according to claim 106 wherein the first rotatable member is coupled to the output member at a first location and the third rotatable member is coupled to the output member at a second location, the first and second locations being positioned 180 degrees apart about the output member.

111. An internal combustion engine according to claim 106 wherein the second and third axes are parallel to one another and define a common plane, and wherein the first axis lies in the common plane.

112. An internal combustion engine according to claim 106 in which the first swash plate assembly lies generally in a first plane and the second swash plate assembly lies generally in a second plane, the angle of the first plane relative to the first axis and the angle of the second plane relative to the first axis being variable to vary the stroke of the engine, the engine comprising means for varying said angle to vary the stroke of the engine.

113. An engine according to claim 106 in which the fourth member of the second swash plate assembly is at least partially comprised of a material which is heavier than the material comprising the second member of the first swash plate assembly.

114. An engine according to claim 106 wherein there are plural pistons which are each associated with a respective cylinder for reciprocation within the associated cylinder, the respective cylinders each comprising a cylinder wall, wherein the pistons each repeatedly travel within their associated cylinder between a top dead center position and a bottom dead center position and back to the top dead center position during a piston stroke, the piston exerting a force against a first portion of the wall of the associated cylinder during one portion of a piston stroke and against a second portion of the wall of the associated cylinder during another portion of a piston stroke, and wherein each piston shifts from exerting a force against the first portion of the wall of the associated cylinder to the second portion of the wall of the associated cylinder when the piston is in either the top dead center position or bottom dead center position.

115. An internal combustion engine comprising:

an engine housing;

a plurality of cylinders within the housing;

plural swash plate assemblies positioned within the housing, the swash plate assemblies being coupled to one another and to the engine housing such that at least a second swash plate assembly swings in a direction opposite to the swinging of a first swash plate assembly to at least partially counterbalance the motion of said first swash plate assembly;

a plurality of reciprocating pistons each positioned within an associated one of the cylinders, the pistons being drivenly coupled to the first of the swash plate assemblies for driving the first swash plate assembly;

a respective piston rod associated with each piston, each piston rod having a first end portion and a second end portion, and each piston rod having the first end portion pivotally connected to the associated piston and the second end portion pivotally connected to the first of the swash plate assemblies to thereby drivenly couple each of the pistons to the first of the swash plate assemblies;

an output member rotatably coupled to the housing and at least to the first swash plate assembly such that driving of the first swash plate assembly causes the rotation of the output member about a first axis; and all of the cylinders in the engine being positioned at the same side of the first swash plate assembly.

116. An internal combustion engine comprising an engine housing;

a plurality of cylinders within the housing;

plural swash plate assemblies positioned within the housing, the swash plate assemblies being coupled to one another and to the engine housing such that at least a second swash plate assembly swings in a direction opposite to the swinging of a first swash plate assembly to at least partially counterbalance the motion of said first swash plate assembly;

a plurality of reciprocating pistons each positioned within an associated one of the cylinders, the pistons being drivenly coupled to the first of the swash plate assemblies for driving the first swash plate assembly;

an output member rotatably coupled to the housing and at least to the first swash plate assembly such that driving of the first swash plate assembly causes the rotation of the output member about a first axis;

all of the cylinders in the engine being positioned at the same side of the first swash plate assembly; and comprising a variable engine stroke adjuster, the variable engine stroke adjuster being coupled to at least the first swash plate assembly and operable to vary the tilt of the first swash plate assembly relative to the first axis so as to adjust the stroke of the engine.

117. An engine according to claim 116 wherein the cylinders each have a bore, the variable stroke adjuster being operable to adjust the tilt of the first swash plate assembly so as to provide maximum engine displacement which results in a stroke to bore ratio which is greater than one at a first engine demand and less than one at a second engine demand which is smaller than the first engine demand, wherein engine demand is defined to mean at least one of the horsepower and torque requirement on the engine.

118. An engine according to claim 116 wherein the variable engine stroke adjuster is coupled to the second swash plate assembly and is operable to vary the tilt of the second swash plate assembly relative to the first axis in the opposite direction from the change in the tilt of the first swash plate assembly.

119. An internal combustion engine according to claim 116 in which the output member comprises first and second output sections, the first section being drivenly coupled to the second section and being movable along the first axis and relative to the second section, the first and second swash plate assemblies being coupled to the first section, the first section defining an engine stroke varying cylinder positioned at least partially in the center of the plurality of cylinders, an engine stroke varying piston coupled to the housing and positioned within the engine stroke varying cylinder, wherein the delivery of operating fluid to one side of the piston moves the first section in a first direction along the first axis and the delivery of operating fluid to the opposite side of the piston moves the first section in a second direction opposite to the first direction along the first axis, whereby the first section is movable relative to the second section to thereby shift the position of the swash plate assemblies to vary the stroke of the engine.

120. An internal combustion engine according to claim 119 in which the stroke varying cylinder has an axis aligned with the first axis.

121. An internal combustion engine according to claim 116 in which the output member comprises first and second sections, the first section being drivenly coupled to the second section and being movable along the first axis and relative to the second section, the first and second swash plate assemblies being coupled to the first section, wherein movement of the first section along the first axis varies the angle of the swash plate assemblies relative to the first axis, at least one adjustment gear drivenly coupled to the first section and rotatable in a first direction to shift the first section in a first direction along the first axis and rotatable in a second direction to shift the first section in a second direction opposite to the first direction, whereby rotation of the adjustment gear shifts the first section in either the first or second direction depending upon the direction of rotation of the adjustment gear to thereby adjust the angle of the swash plate assemblies and vary the stroke of the engine.

122. An engine according to claim 121 comprising an endless ball bearing track coupling the first section to the housing.

123. An internal combustion engine comprising:

an engine housing;

a plurality of cylinders within the housing;

plural swash plate assemblies positioned within the housing, the swash plate assemblies being coupled to one another and to the engine housing such that at least a portion of a second swash plate assembly swings in a direction which at least partially counterbalances the motion of at least a portion of said first swash plate assembly;

a plurality of reciprocating pistons each positioned within an associated respective one of the cylinders and operable to drive the swash plate assemblies;

an output member rotatably coupled to the housing and at least to the swash plate assemblies such that driving of the swash plate assemblies causes the rotation of the output member about a first axis;

a variable engine stroke adjuster, the variable engine stroke adjuster being coupled to at least the first swash plate assembly and operable to vary the angle of tilt of the first swash plate assembly relative to the first axis so as to adjust the stroke of the engine; and wherein each piston cylinder comprises a cylinder head portion and a cylinder wall portion, wherein each piston comprises a piston head surface adjacent to the cylinder head portion of the associated cylinder in which the piston travels, each of the pistons repeatedly traveling during a piston stroke between a top dead center position in which the piston head surface is closest to the cylinder head portion and a bottom dead center position in which the piston head surface is furthest from the cylinder head portion, wherein the combustion chamber is defined as the volume of the cylinder between the cylinder head portion and piston head surface when the piston head surface is in the top dead center position, and wherein the pistons are coupled to the first swash plate assembly such that the volume of the combustion chamber associated with each piston increases as the length of the piston stroke increases and decreases as the length of the piston stroke decreases.

124. An engine according to claim 123 wherein the combustion ratio is defined as the ratio of the volume of the combustion chamber to the volume of the portion of the cylinder through which each piston travels between the top dead center position and bottom dead center position, and wherein the combustion ratio is substantially constant as the stroke of the piston is varied.

125. An engine according to claim 123 in which the combustion ratio is about 1 to (9–12) for a gasoline fueled engine.

126. An engine according to claim 123 in which the combustion ratio is about 1 to (14 to 17) for a diesel fueled engine.

127. An engine according to claim 123 wherein the engine comprises a diesel fuel engine, wherein diesel fuel is injected into compressed combustion air in the combustion chamber for combustion therein to drive the associated piston, and wherein the quantity of diesel fuel delivered to each cylinder is reduced with a reduction in the piston stroke.

128. An engine according to claim 127 wherein under engine idle conditions, the piston stroke is maintained at a level which is greater than the minimum piston stroke and the supply of fuel reduced from fuel levels delivered when the engine is operated under greater engine torque conditions.

129. An engine according to claim 127 for a vehicle wherein under conditions where vehicle coasting is desired without engine braking, the piston stroke is reduced toward its minimum stroke and the supply of fuel is reduced from fuel levels delivered when the engine is operated under greater engine torque conditions.

130. An engine according to claim 127 for a vehicle wherein under conditions where use of the engine as a brake is desired, the piston stroke is established at or toward the maximum stroke and the supply of fuel is reduced from fuel levels delivered when the engine is operated under greater torque and non-engine braking torque conditions.

131. An engine according to claim 123 wherein the engine comprises a gasoline engine, wherein gasoline and combustion air is delivered as an air fuel mixture to the combustion chamber for combustion therein to drive the piston, and wherein the quantity of gasoline and combustion air delivered to the combustion chamber is reduced with a reduction in the piston stroke.

132. An engine according to claim 131 comprising at least one combustion air supply passageway through which combustion air is delivered for the air fuel mixture, the engine comprising at least one air supply throttle which is selectively operable to limit the combustion air delivered to the air fuel mixture.

133. An engine according to claim 132 wherein under engine idle conditions, the piston stroke is maintained at a level which is greater than the minimum piston stroke and the supply of fuel and the supply of combustion air are both reduced from fuel and combustion air levels delivered when the engine is operated under greater engine torque conditions.

134. An engine according to claim 133 for a vehicle wherein under conditions where vehicle coasting is desired without engine braking, the piston stroke is reduced toward the minimum stroke and the supply of fuel and combustion air are reduced from fuel and combustion air levels delivered when the engine is operated under greater torque conditions.

135. An engine according to claim 133 for a vehicle wherein under conditions where use of the engine as a brake is desired, the piston stroke is established at or toward the maximum stroke, and the supply of fuel is reduced from fuel levels delivered when the engine is operated under greater torque and non-engine braking conditions.

136. An engine according to claim 135 wherein the combustion air is maintained at a level which is higher than the level of combustion air delivered under engine idle conditions.

137. An engine according to claim 123 wherein the angle of tilt of the first swash plate assembly is varied in response to at least one vehicle parameter.

138. An engine according to claim 137 wherein the vehicle parameter is selected from the group comprising a vehicle throttle pedal position.

139. An engine according to claim 123 wherein the piston stroke to bore ratio is less than one at a first vehicle speed and is greater than one at a second vehicle speed.

140. An engine according to claim 123 wherein the piston stroke to bore ratio is selectively variable to be greater than one during certain vehicle braking events.

141. An engine according to claim 123 wherein the piston stroke to bore ratio is greater than one in response to first horsepower or torque requirements on the engine and less than one in response to second lesser horsepower or torque requirements on the engine.

142. An engine according to claim 123 wherein the pistons each repeatedly travel within an associated cylinder between a top dead center position and a bottom dead center position and back to the top dead center position during a piston stroke, the cylinders each having a cylinder wall, the piston exerting a force against a first portion of the associated cylinder during one portion of a piston stroke and against a second portion of the wall of the associated cylinder during another portion of the piston stroke, and wherein each piston shifts from exerting a force against the first portion of the wall of the associated cylinder to the second portion of the wall of the associated cylinder when the piston is in either the top dead center or bottom dead center position.

143. An internal combustion engine comprising:

an engine housing;

a plurality of piston cylinders within the housing;

plural swash plate assemblies positioned within the housing, the swash plate assemblies being coupled to one another and to the housing such that at least one swash plate assembly swings in a direction opposite to the swinging of the other swash plate assembly to counterbalance the motion of said other swash plate assembly;

a plurality of reciprocating pistons coupled to a first of the swash plate assemblies for driving the first swash plate assembly, each of said pistons reciprocating within an associated piston cylinder;

an output member rotatably coupled to the housing and at least to the first swash plate assembly such that driving of the first swash plate assembly causes the rotation of the output member about a first axis;

wherein all of the cylinders of the engine are positioned at the same side of the first swash plate assembly; and the output member comprising first and second output shaft sections, the first section being drivenly coupled to the second section and being movable along the first axis and relative to the second section, the first and second swash plate assemblies being pivotally coupled to the first section, the first section defining an engine stroke varying cylinder, an engine stroke varying piston coupled to the housing and positioned within the engine stroke varying cylinder wherein the delivery of operating fluid to one side of the piston moves the first section in a first direction along the first axis and delivery of operating fluid to the opposite side of the piston moves the first section in a second direction opposite to the first direction, whereby the first section is movable relative to the second section to thereby shift the tilt and position of the swash plate assemblies to vary the stroke of the engine.

144. An internal combustion engine comprising:

a housing;

a plurality of cylinders supported by the housing;

a respective piston positioned for reciprocating within each of the cylinders;

a respective piston rod coupled to each of the pistons;

first swash plate means drivenly coupled to all of the piston rods of all of the cylinders supported by the housing and coupled to the housing such that reciprocation of the pistons rotates a rotatable member of the first swash plate means;

an output member rotatably coupled to the housing for rotation about a first axis, the output member being pivotally coupled to the first swash plate means such that rotation of the rotatable member of the first swash plate means drives the output member in rotation about the first axis;

second swash plate means coupled to the output member and to the first swash plate assembly without being directly connected to any of the piston rods, the second swash plate means comprising means for counterbalancing the reciprocation of the first swash plate means; and the second swash plate means reciprocating in a generally opposite manner to the reciprocation of the first swash plate means under operating conditions in which the first swash plate means is driven by the pistons.

145. An internal combustion engine comprising a housing;

a plurality of cylinders supported by the housing;

a respective piston positioned for reciprocating within each of the cylinders;

a respective piston rod coupled to each of the pistons;

first swash plate means drivenly coupled to each of the piston rods and coupled to the housing such that reciprocation of the pistons rotates a rotatable member of the first swash plate means;

an output member rotatably coupled to the housing for rotation about a first axis, the output member being pivotally coupled to the first swash plate means such that rotation of the rotatable member of the first swash plate means drives the output member in rotation about the first axis;

second swash plate means coupled to the output member and to the first swash plate assembly without being directly connected to any of the piston rods, the second swash plate means comprising means for counterbalancing the reciprocation of the first swash plate means;

the second swash plate means reciprocating in a generally opposite manner to the reciprocation of the first swash plate means under operating conditions in which the first swash plate means is driven by the pistons; and comprising variable stroke adjustment means coupled to the first and second swash plate means for adjusting the tilt of the first and second swash plate means relative to the first axis and for varying the positioning of the first and second swash plate means relative to the cylinder to thereby vary the displacement of the engine.

146. An internal combustion engine comprising:

a plurality of piston cylinders;

a respective piston positioned in each cylinder for reciprocation therein;

an output member rotatable about a first axis;

at least one swash plate assembly means for causing the output member to rotate about the first axis in response to reciprocation of the pistons;

at least one counterbalancing swash plate assembly means for at least partially counterbalancing the motion of the first swash plate assembly means; and means adjacent to the piston cylinders for varying the angle of the swash plate assembly relative to the first axis to vary the stroke of the engine.

147. A method of operating an internal combustion engine comprising:

reciprocating plural pistons within cylinders of an engine;

coupling the pistons to a first swash plate assembly located at one side of all of the cylinders such that reciprocation of the pistons drives a portion of the swash plate assembly in rotation;

coupling an output member to the rotatable member of the first swash plate assembly such that rotation of the rotatable member of the swash plate assembly rotates the output member about a first axis; and operating a counterbalancing swash plate assembly generally in opposite directions to that of the first swash plate assembly to counterbalance the motion of the first swash plate assembly, the counterbalancing swash plate assembly also being positioned at said one side of all of the cylinders.

148. A method of operating an internal combustion engine comprising:

reciprocating plural pistons within cylinders of an engine;

coupling the pistons to a first swash plate assembly located at one side of all of the cylinders such that reciprocation of the pistons drives a portion of the swash plate assembly in rotation;

coupling an output member to the rotatable member of the first swash plate assembly such that rotation of the rotatable member of the swash plate assembly rotates the output member about a first axis;

operating a counterbalancing swash plate assembly generally in opposite directions to that of the first swash plate assembly to counterbalance the motion of the first swash plate assembly; and comprising the act of varying the angle of tilt of the first and second swash plate assemblies and moving the first and second swash plate assemblies relative to the cylinders and along the first axis to vary the stroke of the engine.

* * * * *

UNITED STATES PATENT AND TRADEMARK OFFICE

CERTIFICATE OF CORRECTION

PATENT NO. : 6,988,470 B2
APPLICATION NO. : 10/365256
DATED : January 24, 2006
INVENTOR(S) : Helmut Bruckmueller It is certified that error appears in the above-identified patent and that said Letters Patent is hereby corrected as shown below:

On Title page item 76
The inventor's name should read --Helmut Bruckmueller--.

Col. 33, line 51, please replace "a" with --α--.

Signed and Sealed this

Tenth Day of April, 2007

JON W. DUDAS
*Director of the United States Patent and Trademark Office*